US009423724B2

(12) United States Patent
Ichikawa et al.

(10) Patent No.: US 9,423,724 B2
(45) Date of Patent: Aug. 23, 2016

(54) PRESSING DEVICE, IN AN IMAGE FORMING APPARATUS THAT INCLUDES AN ADJUSTER CONNECTED TO TWO LATERAL PLATES

(71) Applicants: Junichi Ichikawa, Kanagawa (JP); Naohiro Kumagai, Kanagawa (JP); Seiichi Kogure, Kanagawa (JP); Junpei Fujita, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(72) Inventors: Junichi Ichikawa, Kanagawa (JP); Naohiro Kumagai, Kanagawa (JP); Seiichi Kogure, Kanagawa (JP); Junpei Fujita, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/601,445

(22) Filed: Jan. 21, 2015

(65) Prior Publication Data

US 2015/0212454 A1 Jul. 30, 2015

(30) Foreign Application Priority Data

Jan. 30, 2014 (JP) ..... 2014-015355
Jul. 8, 2014 (JP) ..... 2014-140639

(51) Int. Cl.
*G03G 15/08* (2006.01)
*G03G 15/16* (2006.01)

(52) U.S. Cl.
CPC ..... *G03G 15/1605* (2013.01); *G03G 15/168* (2013.01); *G03G 15/1685* (2013.01)

(58) Field of Classification Search
CPC ..... G03G 15/1605; G03G 15/1685; G03G 15/168
USPC ..... 399/121
See application file for complete search history.

(56) References Cited

U.S. PATENT DOCUMENTS

2007/0002122 A1* 1/2007 Murano ..... G03G 15/75 347/115
2009/0162114 A1* 6/2009 Nakura ..... G03G 15/162 399/308

(Continued)

FOREIGN PATENT DOCUMENTS

JP 06-035338 2/1994
JP 2006-039401 2/2006

(Continued)

OTHER PUBLICATIONS

U.S. Appl. No. 14/272,810, filed May 8, 2014.

*Primary Examiner* — Billy Lactaoen
(74) *Attorney, Agent, or Firm* — Oblon, McClelland, Maier & Neustadt, L.L.P.

(57) ABSTRACT

A pressing device includes a pressing member, a first lateral plate including a first connecting portion to support a first end of the pressing member, a second lateral plate including a second connecting portion to support a second end of the pressing member opposite to the first end, a first adjuster connected to the first lateral plate at the first connecting portion and to the second lateral plate at the second connecting portion, and a biasing member. The biasing member biases at least one of the first lateral plate, the second lateral plate, and the first adjuster to press the pressing member against the target in a pressing direction. The first adjuster is connected to the first lateral plate and the second lateral plate such that a relative position of the second connecting portion relative to the first connecting portion is changeable in the pressing direction.

16 Claims, 20 Drawing Sheets

(56) References Cited

U.S. PATENT DOCUMENTS

| | | | | |
|---|---|---|---|---|
| 2010/0067952 | A1 | 3/2010 | Fujita et al. | |
| 2010/0142985 | A1 | 6/2010 | Minbe et al. | |
| 2010/0221029 | A1 | 9/2010 | Minbu et al. | |
| 2011/0158690 | A1 | 6/2011 | Mimbu et al. | |
| 2011/0211855 | A1 | 9/2011 | Kogure et al. | |
| 2011/0229243 | A1* | 9/2011 | Shiba | G03G 15/0131 400/618 |
| 2011/0286759 | A1 | 11/2011 | Ichihashi et al. | |
| 2011/0293312 | A1 | 12/2011 | Mimbu et al. | |
| 2012/0237260 | A1 | 9/2012 | Sengoku et al. | |
| 2013/0223901 | A1 | 8/2013 | Minbe et al. | |
| 2013/0322935 | A1 | 12/2013 | Ichihashi et al. | |
| 2014/0072340 | A1 | 3/2014 | Kato et al. | |
| 2014/0241744 | A1 | 8/2014 | Ichikawa et al. | |

FOREIGN PATENT DOCUMENTS

| | | |
|---|---|---|
| JP | 2010-048915 | 3/2010 |
| JP | 2010-134047 | 6/2010 |
| JP | 2011-248270 | 12/2011 |
| JP | 2012-128229 | 7/2012 |

* cited by examiner

PRESSING DEVICE, IN AN IMAGE FORMING APPARATUS THAT INCLUDES AN ADJUSTER CONNECTED TO TWO LATERAL PLATES

CROSS-REFERENCE TO RELATED APPLICATIONS

This patent application is based on and claims priority pursuant to 35 U.S.C. §119 from Japanese Patent Application Nos. 2014-015355, filed on Jan. 30, 2014, and 2014-140639, filed on Jul. 8, 2014, both in the Japan Patent Office, which are hereby incorporated herein by reference in their entirety.

BACKGROUND

1. Technical Field

Exemplary aspects of the present disclosure generally relate to a pressing device that presses a pressing member against a target such as an image bearer, and more particularly, to a transfer device including the pressing device and an image forming apparatus including the transfer device.

2. Description of the Related Art

Known electrophotographic image forming apparatuses form a latent image on a uniformly charged surface of an image bearer by writing optically an image based on image information. The latent image is developed with toner by a developing device to form a visible image, known as a toner image. Subsequently, the toner image is transferred onto a recording medium (recording material), and is fixed thereon.

In the image forming apparatuses of this kind, the toner image is formed on a drum-shaped photoconductor serving as the image bearer through a known electrophotographic process. An intermediate transfer belt formed into an endless loop contacts the photoconductor to form a so-called primary transfer nip therebetween. In the primary transfer nip, the toner image on the photoconductor is primarily transferred onto the intermediate transfer belt. A secondary transfer roller serving as a nip forming member contacts the intermediate transfer belt to form a so-called secondary transfer nip. A secondary-transfer opposing roller is disposed inside the looped intermediate transfer belt and opposite to the secondary transfer roller with the intermediate transfer belt interposed therebetween.

While the secondary-transfer opposing roller disposed inside the loop of the intermediate transfer belt is grounded, a secondary transfer bias (voltage) is applied to the secondary transfer roller disposed outside the loop. With this configuration, a secondary transfer electric field is formed between the secondary-transfer opposing roller and the secondary transfer roller so that the toner image moves electrostatically from the secondary-transfer opposing roller side to the secondary transfer roller side. A recording medium is fed to the secondary transfer nip in appropriate timing such that the recording medium is aligned with the toner image formed on the intermediate transfer belt. Due to the secondary transfer electrical field and a nip pressure in the secondary transfer nip, the toner image on the intermediate transfer belt is secondarily transferred onto the recording medium.

In recent years, a variety of recording media such Japanese paper known as "Washi" have come on market. Such recording media have a coarse surface through embossing process. A pattern of light and dark according to the surface condition of the recording medium appears in an output image. More specifically, toner does not transfer well to such embossed surfaces, in particular, recessed portions of the surface. This inadequate transfer of the toner appears as a pattern of light and dark patches in the resulting output image.

In order to prevent such a pattern of light and dark patches, the intermediate transfer belt is formed of an elastic belt including an elastic layer so that a higher nip pressure can be applied at the secondary transfer nip when transferring an image onto the recording medium having a coarse surface than when using a smooth recording medium. With a higher nip pressure, the surface of the intermediate transfer belt including the elastic layer can deform and thus fit the embossed surface of the recording medium. Accordingly, the transferability at the recessed portion of the recording medium surface is enhanced.

In order to enable the secondary transfer roller to contact the intermediate transfer belt, generally, the image forming apparatus includes a pressing device including a pressing member and a biasing member such as a spring. The pressing member supports both ends of the secondary transfer roller in an axial direction thereof. The biasing member applies the pressing member a biasing force. With this configuration, the biasing member presses the pressing member against the intermediate transfer belt, thereby enabling the secondary transfer roller supported by the pressing member to contact the intermediate transfer belt.

Although the biasing member with a relatively large biasing force can increase the nip pressure at the secondary transfer nip, the pressing member needs to be strong enough to accommodate such a large biasing force.

SUMMARY

In view of the foregoing, in an aspect of this disclosure, there is provided an improved pressing device including a pressing member, a first lateral plate, a second lateral plate, a first adjuster, and a biasing member. The pressing member includes a first end and a second end opposite to the first end in a longitudinal direction of the pressing member, to contact a target. The first lateral plate includes a first connecting portion, to support the first end of the pressing member. The second lateral plate includes a second connecting portion, to support the second end of the pressing member. The first adjuster is connected to the first lateral plate at the first connecting portion and to the second lateral plate at the second connecting portion to regulate relative movement of the first lateral plate and the second lateral plate in the longitudinal direction. The biasing member biases at least one of the first lateral plate, the second lateral plate, and the first adjuster to press the pressing member against the target in a pressing direction. The first adjuster is connected to the first lateral plate and the second lateral plate such that a relative position of the second connecting portion relative to the first connecting portion is changeable in the pressing direction.

According to another aspect, a transfer device includes a nip forming member and the pressing device. The nip forming member is disposed opposite to an image bearer that travels in a first direction and contacts an entire surface of the image bearer in a width direction perpendicular to the first direction to form a transfer nip. The pressing device presses the nip forming member as the pressing member against the image bearer as the target.

According to another aspect, an image forming apparatus includes an image bearer on which a toner image is formed, and the transfer device to transfer the toner image from the image bearer onto a recording medium.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
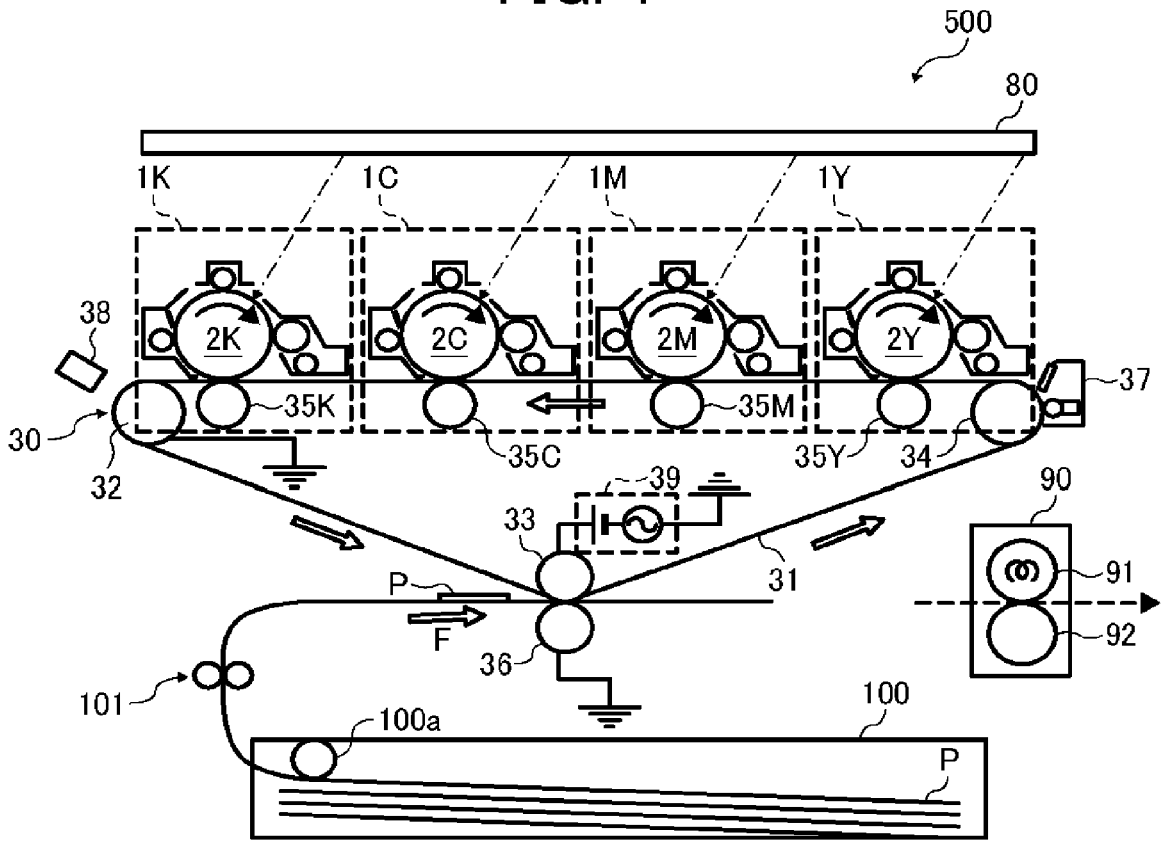
FIG. 1 is a schematic diagram illustrating a printer as an example of an image forming apparatus, according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an electrophotographic color printer as an example of an image forming apparatus 500 according to an illustrative embodiment of the present disclosure.

FIG. 1 is a schematic diagram illustrating the image forming apparatus 500 according to the illustrative embodiment of the present disclosure. As illustrated in FIG. 1, the image forming apparatus 500 includes four image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 500 includes a transfer unit 30 serving as a transfer device, an optical writing unit 80, a fixing device 90, a paper cassette 100, and a pair of registration rollers 101.

The image forming units 1Y, 1M, 1C, and 1K all have the same configuration as all the others, differing only in the color of toner employed. The image forming units 1Y, 1M, 1C, and 1K are replaced upon reaching their product life cycles.

Figure 2:
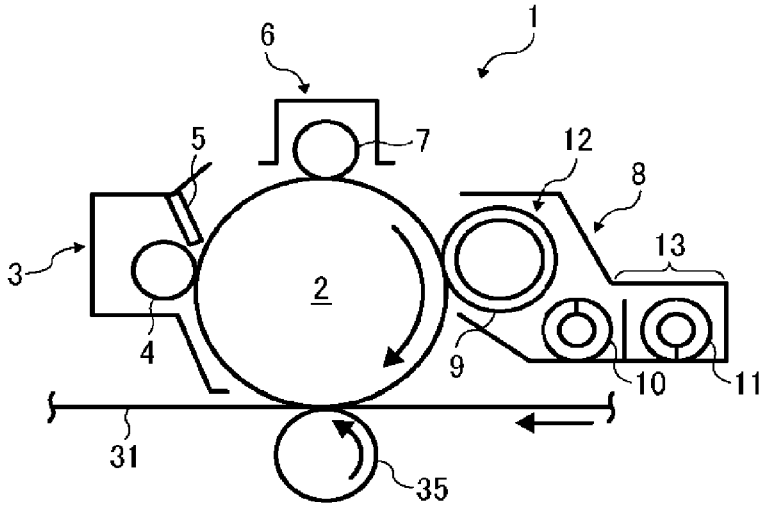
FIG. 2 is a schematic diagram illustrating an image forming unit for the color black as a representative example of image forming units employed in the image forming apparatus of FIG. 1.

FIG. 2 is an enlarged diagram schematically illustrating one of the image forming units 1Y, 1M, 1C, and 1K. The image forming units 1Y, 1M, 1C, and 1K all have the same configuration as all the others, differing only in the color of toner employed. Thus, the description is provided without the suffixes Y, M, C, and K indicating colors unless otherwise indicated.

The image forming unit 1 includes a drum-shaped photoconductor 2 serving as a latent image bearer, a drum cleaning device 3, a static eliminator, a charging device 6, a developing device 8, and so forth. These devices are held by a common holder so that they are detachably attachable together relative to the image forming apparatus 500 and replaced at the same time.

The photoconductor 2 comprises a drum-shaped base on which an organic photosensitive layer is disposed, with the external diameter of approximately 60 mm. The photoconductor 2 is rotated in a clockwise direction by a driving device. The charging device 6 includes a charging roller 7 supplied with a charging bias. The charging roller 7 contacts or is disposed closed to the photoconductor 2 to generate electrical discharge therebetween, thereby charging uniformly the surface of the photoconductor 2.

According to the present illustrative embodiment, the photoconductor 2 is uniformly charged with a negative polarity which is the same polarity as the normal charging polarity of toner. As a charging bias, an alternating current (AC) voltage superimposed on a direct current (DC) voltage is employed. The charging roller 7 is formed of a metal cored bar covered with a conductive elastic layer made of a conductive elastic material. Instead of using the charging roller or the like that contacts or disposed close to the photoconductor 2, a corona charger or the like that does not contact the photoconductor 2 may be employed.

The uniformly charged surface of the photoconductor 2 is scanned by a light beam irradiated from the optical writing unit 80, thereby forming an electrostatic latent image of respective colors on the surface of the photoconductor. The electrostatic latent image on the photoconductor 2 is developed with toner of the respective color by the developing device 8. Accordingly, a visible image, also known as a toner image, is formed. As will be described later in detail, the toner image is transferred primarily onto an intermediate transfer belt 31 in a process known as a primary transfer process.

The drum cleaning device 3 removes toner residues remaining on the surface of the photoconductor 2 after the primary transfer process, that is, after the photoconductor 2 passes through a primary transfer nip. The drum cleaning device 3 includes a brush roller 4 and a cleaning blade 5. The cleaning blade 5 is cantilevered, that is, one end of the cleaning blade 5 is held, and the other end which is a free end contacts the surface of the photoconductor 2. The brush roller 4 rotates and brushes off the toner residues from the surface of the photoconductor 2 while the cleaning blade 5 removes the toner residues by scraping. It is to be noted that the cantilevered side of the cleaning blade 5 is positioned downstream from its free end contacting the photoconductor 2 in the direction of rotation of the photoconductor 2 so that the free end of the cleaning blade 5 faces or becomes counter to the direction of rotation.

The static eliminator removes residual charge remaining on the photoconductor 2 after the surface thereof is cleaned by the drum cleaning device 3 in preparation for the subsequent imaging cycle. The surface of the photoconductor 2 is initialized in preparation for the subsequent imaging cycle.

The developing device 8 includes a developing portion 12 and a developer conveyer 13. The developing portion 12 includes a developing roller 9 inside thereof. The developer conveyer 13 mixes and transports the developing agent. The developer conveyer 13 includes a first chamber equipped with a first screw 10 and a second chamber equipped with a second screw 11. The first screw 10 and the second screw 11 are each constituted of a rotatable shaft and helical flighting wrapped around the circumferential surface of the shaft. Each end of the shaft of the first screw 10 and the second screw 11 in the axial direction is rotatably held by shaft bearings.

The first chamber with the first screw 10 and the second chamber with the second screw 11 are separated by a wall, but each end of the wall in the direction of the screw shaft has a connecting hole through which the first chamber and the second chamber are connected. The first screw 10 mixes the developing agent by rotating the helical flighting and carries the developing agent from the distal end to the proximal end of the screw in the direction perpendicular to the surface of the recording medium while rotating. The first screw 10 is disposed parallel to and facing the developing roller 9. The developing agent is delivered along the axial (shaft) direction of the developing roller 9. The first screw 10 supplies the developing agent to the surface of the developing roller 9 along the direction of the shaft line of the developing roller 9.

The developing agent transported near the proximal end of the first screw 10 passes through the connecting hole in the wall near the proximal side and enters the second chamber. Subsequently, the developing agent is carried by the helical fighting of the second screw 11. As the second screw 11 rotates, the developing agent is transported from the proximal side to the distal end while being mixed in the direction of rotation.

In the second chamber, a toner density detector for detecting a density of toner in the developing agent is disposed at the bottom of a casing of the chamber. As the toner density detector, a magnetic permeability detector is employed. There is a correlation between the toner density and the magnetic permeability of the developing agent consisting of toner and magnetic carrier. Therefore, the magnetic permeability detector can detect the density of the toner.

Although not illustrated, the image forming apparatus 500 includes toner supply devices to supply independently toner of yellow, magenta, cyan, and black to the second chamber of the respective developing devices 8. A controller of the image forming apparatus includes a Random Access Memory (RAM) to store a target output voltage Vtref for output voltages provided by the toner density detectors for yellow, magenta, cyan, and black. If the difference between the output voltages provided by the toner density detectors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the developing device 8.

The developing roller 9 in the developing portion 12 faces the first screw 10 as well as the photoconductor 2 through an opening formed in the casing of the developing device 8. The developing roller 9 is formed of a cylindrical developing sleeve made of a non-magnetic pipe which is rotated, and a magnetic roller disposed inside the developing sleeve. The magnetic roller is fixed to prevent the magnetic roller from getting rotated together with the developing sleeve. The developing agent supplied from the first screw 10 is carried on the surface of the developing sleeve due to the magnetic force of the magnetic roller. As the developing sleeve rotates, the developing agent is transported to a developing area facing the photoconductor 2.

The developing sleeve is supplied with a developing bias having the same polarity as that of the toner. The developing bias is greater than the bias of the electrostatic latent image on the photoconductor 2, but less than the charging potential of the uniformly charged photoconductor 2. With this configuration, a developing potential that causes the toner on the developing sleeve to move electrostatically to the electrostatic latent image on the photoconductor 2 acts between the developing sleeve and the electrostatic latent image on the photoconductor 2. A non-developing potential acts between the developing sleeve and the non-image formation areas of the photoconductor 2, causing the toner on the developing sleeve to move to the sleeve surface. Due to the developing potential and the non-developing potential, the toner on the developing sleeve moves selectively to the electrostatic latent image formed on the photoconductor 2, thereby developing the electrostatic latent image to a visible image, known as a toner image.

The optical writing unit 80 for writing a latent image on the photoconductor 2 is disposed above the image forming units 1Y, 1M, 1C, and 1K. Based on image information received from external devices such as a personal computer (PC), the optical writing unit 80 illuminates the photoconductors 2Y, 2M, 2C, and 2K with a light beam projected from a light source such as a laser diode of the optical writing unit 80. Accordingly, the electrostatic latent images of yellow, magenta, cyan, and black are formed on the photoconductors 2Y, 2M, 2C, and 2K, respectively.

More specifically, the potential of the charged portion of the photoconductor 2 irradiated with the light beam is attenuated. The potential of the irradiated portion of the photoconductor 2 with the light beam is less than the potential of the other area, that is, a background portion (non-image formation area), thereby forming an electrostatic latent image on the surface of the photoconductor 2. The optical writing unit 80 includes a polygon motor, a polygon mirror, a plurality of optical lenses, and mirrors. The light beam projected from the light source is deflected in a main scanning direction by the polygon mirror rotated by the polygon motor. The deflected light, then, strikes the optical lenses and mirrors, thereby scanning the photoconductor 2. Alternatively, the optical writing unit 80 may employ, as a latent image writer, an LED array including a plurality of LEDs that projects light.

Still referring to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearer formed into an endless loop and entrained about a plurality of rollers, thereby rotating endlessly in the counterclockwise direction indicated by hollow arrows. The transfer unit 30 also includes a drive roller 32, a secondary-transfer back surface roller 33, a cleaning auxiliary roller 34, four primary transfer rollers 35Y, 35M, 35C, and 35K (which may be referred to collectively as primary transfer rollers 35), a nip forming roller 36 as a secondary transfer roller, a belt cleaning device 37, a voltage detector 38, and so forth. The primary transfer rollers 35Y, 35M, 35C, and 35K are disposed opposite the photoconductors 2Y, 2M, 2C, and 2K, respectively, via the intermediate transfer belt 31.

The intermediate transfer belt 31 is entrained around and stretched taut between the pluralities of rollers. i.e., the drive roller 32, the secondary-transfer back surface roller 33, the cleaning auxiliary roller 34, and the four primary transfer rollers 35Y, 35M, 35C, and 35K. The drive roller 32 is rotated in the counterclockwise direction by a motor or the like, and rotation of the driving roller 32 enables the intermediate transfer belt 31 to rotate in the same direction. The intermediate transfer belt 31 has the following characteristics. The intermediate transfer belt 31 has a thickness in a range of from 20 μm to 200 μm, preferably, approximately 60 μm. The volume resistivity thereof is in a range of from $1.0\times10^{6}$ Ωcm to $1.0\times10^{12}$ Ωcm, preferably, approximately $1.0\times10^{9}$ Ωcm. The volume resistivity is measured with an applied voltage of 100V by a high resistivity meter, Hiresta UPMCPHT 45 manufactured by Mitsubishi Chemical Corporation. The intermediate transfer belt 31 is made of resin such as polyimide resin in which carbon is dispersed.

The intermediate transfer belt 31 is interposed between the photoconductors 2 and the primary transfer rollers 35. Accordingly, primary transfer nips are formed between the front surface (image bearing surface) of the intermediate transfer belt 31 and the photoconductors 2Y, 2M, 2C, and 2K contacting the intermediate transfer belt 31. A primary transfer bias is applied to the primary transfer rollers 35 by a transfer bias power source, thereby forming a transfer electric field between the toner images on the photoconductor 2 and the primary transfer rollers 35.

The toner image for yellow formed on the photoconductor 2Y enters the primary transfer nip for yellow as the photoconductor 2Y rotates. Subsequently, the toner image of yellow is primarily transferred from the photoconductor 2Y to the intermediate transfer belt 31 by the transfer electric field and the nip pressure. The intermediate transfer belt 31 on which the toner image of yellow has been transferred passes through the primary transfer nips of magenta, cyan, and black. Subsequently, the toner images on the photoconductors 2M, 2C, and 2K are superimposed on the yellow toner image which has been transferred on the intermediate transfer belt 31, one atop the other, thereby forming a composite toner image on the intermediate transfer belt 31 in the primary transfer process. Accordingly, a composite toner image, in which the toner images of yellow, magenta, cyan, and black are superimposed on one another, is formed on the surface of the intermediate transfer belt 31 in the primary transfer process.

Each of the primary transfer rollers 35Y, 35M, 35C, and 35K is formed of an elastic roller including a metal cored bar on which a conductive sponge layer is disposed. The outer diameter of the primary transfer rollers 35Y, 35M, 35C, and 35K is approximately 16 mm. The diameter of the metal cored bar is approximately 10 mm.

The resistance R of the sponge layer is measured such that a metal roller having an outer diameter of 30 mm is pressed against the sponge layer at a load of 10[N] and the current is measured when a voltage of 1000V is supplied to the metal cored bar of the primary transfer roller 35. Accordingly, the resistance R of the sponge layer is obtained using Ohm's law: R=V/I, where V is a voltage, I is a current, and R is a resistance. The resistance R of the sponge layer thus obtained is approximately $3.0\times10^{7}\Omega$. The primary transfer rollers 35Y, 35M, 35C, and 35K described above are supplied with a primary transfer bias under constant current control.

According to the illustrative embodiment described above, a roller-type transfer device (i.e., the primary transfer rollers 35) is used as a primary transfer device. Alternatively, in some embodiments, a transfer charger or a brush-type transfer device is employed as a primary transfer device.

As illustrated in FIG. 1, the nip forming roller 36 of the transfer unit 30 is disposed outside the loop formed by the intermediate transfer belt 31, opposite to the secondary-transfer back surface roller 33 which is disposed inside the loop. The intermediate transfer belt 31 is interposed between the secondary-transfer back surface roller 33 and the nip forming roller 36. Accordingly, a secondary transfer nip is formed between the peripheral surface or the image bearing surface of the intermediate transfer belt 31 and the nip forming roller 36 contacting the surface of the intermediate transfer belt 31. The nip forming roller 36 is grounded. By contrast, a secondary transfer bias is applied to the secondary-transfer back surface roller 33 by a secondary transfer bias power source 39. With this configuration, a secondary transfer electrical field is formed between the secondary-transfer back surface roller 33 and the nip forming roller 36 so that the toner having a negative polarity is transferred electrostatically from the secondary-transfer back surface roller side to the nip forming roller side.

As illustrated in FIG. 1, the paper cassette 100 storing a sheaf of recording media sheets P is disposed below the transfer unit 30. The paper cassette 100 is equipped with a feed roller 100*a* to contact the top sheet of the sheaf of recording media P. As the feed roller 100*a* is rotated at a predetermined speed, the sheet feed roller 100*a* picks up the top sheet of the recording media P and sends it to a medium passage. Substantially at the end of the medium passage, the pair of registration rollers 101 is disposed. The pair of the registration rollers 101 stops rotating temporarily as soon as the recording medium P is interposed therebetween. The pair of registration rollers 101 starts to rotate again to feed the recording medium P to the secondary transfer nip in appropriate timing such that the recording medium P is aligned with the composite toner image formed on the intermediate transfer belt 31 in the secondary transfer nip.

In the secondary transfer nip, the recording medium P tightly contacts the composite toner image on the intermediate transfer belt 31, and the composite toner image is transferred onto the recording medium P by the secondary transfer electric field and the nip pressure applied thereto, thereby forming a color image on the surface of the recording medium P. The recording medium P on which the composite color toner image is formed passes through the secondary transfer nip and separates from the nip forming roller 36 and the intermediate transfer belt 31 due to the curvature of the rollers.

The secondary-transfer back surface roller 33 has the following characteristics. The secondary-transfer back surface roller 33 is formed of a metal cored bar on which a conductive nitrile rubber (NBR) layer is disposed. The outer diameter of the secondary-transfer back surface roller 33 is approximately 24 mm. The diameter of the metal cored bar of the secondary-transfer back surface roller 33 is approximately 16 mm. The resistance R of the conductive NBR rubber layer is in a range of from $1.0\times10^{6}\Omega$ to $1.0\times10^{12}\Omega$, preferably, approximately $4.0\times10^{7}\Omega$. The resistance R is measured using the similar or the same method as the primary transfer roller 35 described above.

The nip forming roller 36 has the following characteristics. The nip forming roller 36 is formed of a metal cored bar on which a conductive NBR rubber layer is disposed. The outer diameter of the nip forming roller 36 is approximately 24 mm. The diameter of the metal cored bar is approximately 14 mm. The resistance R of the conductive NBR rubber layer is equal to or less than $1.0\times10^{6}\Omega$. The resistance R is measured using the similar or the same method as the primary transfer roller 35 described above.

According to the present illustrative embodiment, the secondary transfer bias power source 39 serving as a secondary transfer bias output device includes a direct current (DC) power source and an alternating current (AC) power source, and an alternating current (AC) voltage superimposed on a direct current (DC) voltage is output as the secondary transfer bias. An output terminal of the secondary transfer bias power source 39 is connected to the metal cored bar of the secondary-transfer back surface roller 33. The potential of the metal cored bar of the secondary-transfer back surface roller 33 has a similar or the same value as the output voltage output from the secondary transfer bias power source 39. Furthermore, the metal cored bar of the nip forming roller 36 is grounded.

According to the present illustrative embodiment, the nip forming roller 36 is grounded while the superimposed bias is applied to the metal cored bar of the secondary-transfer back surface roller 33. Alternatively, in some embodiments, the secondary-transfer back surface roller 33 is grounded while the superimposed bias is applied to the metal cored bar of the nip forming roller 36.

In this case, the polarity of the DC voltage is changed. More specifically, as illustrated in FIG. 1, when the superimposed bias is applied to the secondary-transfer back surface roller 33 while the toner has a negative polarity and the nip forming roller 36 is grounded, the DC voltage of the same negative polarity as the toner is used so that a time-averaged potential of the superimposed bias has the same negative polarity as the toner. By contrast, in a case in which the secondary-transfer back surface roller 33 is grounded and the superimposed bias is applied to the nip forming roller 36, the DC voltage having the positive polarity opposite that of the toner is used so that the time-averaged potential of the superimposed bias has the positive polarity which is opposite that of the toner.

Instead of applying the superimposed bias to the secondary-transfer back surface roller 33 or to the nip forming roller 36, in some embodiments the DC voltage is supplied to one of the secondary-transfer back surface roller 33 and the nip forming roller 36, and the AC voltage may be supplied to the other roller. According to the present illustrative embodiment, an AC voltage having a sine wave is used. Alternatively, in some embodiments, an AC voltage having a square wave is used. When using a normal sheet of paper, such as the one having a relatively smooth surface, a pattern of dark and light according to the surface conditions of the recording medium P is less likely to appear on the recording medium P. In this case, the transfer bias including only the DC voltage is supplied. By contrast, when using a recording medium having a coarse surface such as pulp paper and embossed paper, the transfer bias needs to be changed from the transfer bias consisting only of the DC voltage to the transfer bias consisting of the superimposed bias.

After the intermediate transfer belt 31 passes through the secondary transfer nip, toner residues not having been transferred onto the recording medium P remain on the intermediate transfer belt 31. The toner residues are removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports cleaning operation by the belt cleaning device 37 from inside the loop of the intermediate transfer belt 31 so that the toner residues on the intermediate transfer belt 31 are removed reliably.

The voltage detector 38 is disposed outside the loop formed by the intermediate transfer belt 31. More specifically, the voltage detector 38 faces a portion of the intermediate transfer belt 31 entrained around the drive roller 32 with a gap of approximately 4 mm between the voltage detector 38 and the intermediate transfer belt 31. The surface potential of the toner image primarily transferred onto the intermediate transfer belt 31 is measured when the toner image comes to the position opposite to the voltage detector 38. According to the present illustrative embodiment, a surface potential sensor EFS-22D manufactured by TDK Corp. is employed as the voltage detector 38.

On the right hand side of the secondary transfer nip between the secondary-transfer back surface roller 33 and the intermediate transfer belt 31, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing nip at which the surface of the recording medium P bearing the unfixed toner image tightly contacts the fixing roller 91 in the fixing device 90. Under heat and pressure, the toner adhered to the toner image is softened and fixed to the recording medium P in the fixing nip.

After the toner image is affixed to the recording medium P, the recording medium P is output from the fixing device 90. Subsequently, the recording medium P is delivered outside the image forming apparatus 500 via a post-fixing medium path.

For monochrome imaging, a support plate supporting the primary transfer rollers 35Y, 35M, and 35C of the transfer unit 30 is moved to separate the primary transfer rollers 35Y, 35M, and 35C from the photoconductors 2Y, 2M, and 2C. Accordingly, the outer peripheral surface of the intermediate transfer belt 31, that is, the image bearing surface, is separated from the photoconductors 2Y, 2M, and 2C so that the intermediate transfer belt 31 contacts only the photoconductor 2K. In this state, only the image forming unit 1K is driven to form a black toner image on the photoconductor 2K.

Next, a description is provided of the intermediate transfer belt 31 according to an illustrative embodiment.

The intermediate transfer belt 31 according to the present illustrative embodiment is an endless looped belt having at least a base layer, an elastic layer, and a surface coating layer.

Examples of materials used for the elastic layer of the intermediate transfer belt 31 include, but are not limited to elastic members such as elastic material rubber and elastomer. More specifically, one or more materials selected from the following group can be used. The materials include, but are not limited to, butyl rubber, fluorine-based rubber, acrylic rubber, Ethylene Propylene Diene Monomer (EPDM), NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrin-based rubber, polysulfide rubber, polynorbornene rubber, thermoplastic elastomers (e.g., polystyrene-based, polyolefin-based, polyvinyl chloride-based, polyurethane-based, polyamide-based, polyurea-based, polyester-based, and fluororesin-based thermoplastic elastomers) and the like can be used. However, the materials for the elastic layer of the intermediate transfer belt 31 are not limited thereto.

The thickness of the elastic layer is preferably in a range of from 0.07 mm to 0.5 mm or less depending on the hardness and the layer structure of the elastic layer. More preferably, the thickness of the elastic layer is in a range of from 0.25 mm to 0.5 mm. When the thickness of the intermediate transfer belt 31 is small such as 0.07 [mm] or less, the pressure to the toner on the intermediate transfer belt 31 increases in the secondary transfer nip, and image defects such as toner dropouts occur easily during transfer. Consequently, the transferability of the toner is degraded.

Preferably, the hardness of the elastic layer is $10° \leq HS \leq 65°$ in accordance with Japanese Industrial Standards (JIS-A). The optimum hardness differs depending on the layer thickness of the intermediate transfer belt 31. When the hardness is lower than 10° JIS-A, toner dropouts occur easily during transfer. By contrast, when the hardness is higher than 65° JIS-A, the belt is difficult to entrain around the rollers. Furthermore, the durability of such a belt with the hardness higher than 65° JIS-A is poor because the belt is stretched taught for an extended period of time, causing frequent replacement of the belt.

The base layer of the intermediate transfer belt 31 is formed of relatively inelastic resin. Specific examples of the materials used for the base layer include, but are not limited to, one or more of polycarbonate, fluorocarbon resin (e.g. ETFE or PVDF), polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyle acrylate copolymer or styrene-phenyl acrylate copolymer), styrene-methacrylate copolymer (e.g. styrene-methyl methacrylate copolymer, styrene-ethyl methacrylate copolymer or styrene-phenyl methacrylate copolymer), styrene-α-methyl chloroacrylate copolymer, styrene-acrylonitrile-acrylate copolymer or similar styrene resin (e.g. polymer or copolymer containing styrene or substituted styrene), methyl methacrylate resin, butyl methacrylate resin, ethyl acrylate resin, butyl acrylate resin, modified acrylic resin (silicone modified acrylic resin, vinyl chloride resin modulated acrylic resin or acryl-urethane resin), vinyl chloride resin, styrene-vinyl acetate resin copolymer, vinyl chloride-vinyl acetate copolymer, rosin modulated maleic ester resin, phenol resin, epoxy resin, polyester resin, polyester-polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, and modified polyphenylene oxide resin. However, the materials for the elastic layer of the intermediate transfer belt 31 are not limited thereto.

To prevent overstretching of the elastic layer made of a rubber material that easily stretches, a core layer made of a material such as canvas may be provided between the base layer and the elastic layer. Preferred materials suitable for the core layer include, but are not limited to, natural fibers (e.g., cotton, silk), synthetic fibers (e.g., polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber, phenol fiber), inorganic fibers (e.g., carbon fiber, glass fiber), and metal fibers (e.g., iron fiber, copper fiber). Two or more of these materials can be used in combination. These materials are used after being formed into yarn or woven cloth.

However, the materials are not limited thereto. The yarn may be comprised of either a single filament or multiple filaments twisted together, a single-twist yarn, a plied yarn, and two-folded yarn, or any other suitable yarns. For example, fibers made of materials selected from the above material group may be mixed and spun. The yarn may be subjected to an appropriate conducting treatment. The woven cloth may be made by any weaving methods such as tricot weaving. Alternatively, the woven cloth may be made by combined weaving, and may be subjected to a conducting treatment.

The surface coating layer of the intermediate transfer belt 31 is a smooth layer that covers the surface of the elastic layer. Any material can be used for the surface coating layer. However, materials that can enhance the transferability of the secondary transfer through reducing the adhesion force of the toner onto the surface of the intermediate transfer belt 31 are generally used. Examples of materials used for the coating layer include, but are not limited to, polyurethane resin, polyester resin, epoxy resin, and combinations of two or more of the above-described materials. Alternatively, a material that reduces surface energy to improve lubricating property, such as fluorocarbon resin grains, fluorine compound grains, carbon fluoride grains, titanium oxide grains, and silicon carbide grains with or without the grain size being varied may be used alone or in combination. The surface coating layer may also be a fluorine-containing layer formed by thermally treating a fluorine-containing rubber, thereby reducing surface energy of the layer.

In order to adjust resistance, each of the base layer, the elastic layer, and the surface coating layer may be formed of metal powder such as carbon black, graphite, aluminum, and nickel, conductive metal oxides such as tin oxide, titanium oxide, antimony oxide, indium oxide, potassium titanate, ATO (antimony oxide-tin oxide), ITO (indium oxide-tin oxide), or the like. The conductive metal oxides may be covered with an insulative fine particles such as barium sulfate, magnesium silicate, or calcium carbonate, for example. However, these materials are not limited thereto.

A lubricant may be applied to the surface of the intermediate transfer belt 31 to protect the surface of the intermediate transfer belt 31. In this case, the image forming apparatus includes a lubricant applicator. The lubricant applicator includes a brush roller to contact and scrape a block (solid) lubricant while the brush roller rotates. The lubricant in powder form thus obtained is applied to the surface of the intermediate transfer belt 31. Depending on the material of the toner and the intermediate transfer belt 31, and the surface friction coefficient or the like of the intermediate transfer belt 31, the lubricant may not be necessary.

Next, a description is provided of a pressing device 40 as a pressing mechanism of the nip forming roller 36 according to the illustrative embodiment of the present disclosure.

In a known configuration using a pressing mechanism which employs, as an elastic member, a spring such as a tension spring to press both axial ends of the nip forming roller 36, when the transfer pressure is switched between 60 [N] and 240 [N], the tension spring disposed at one end of the nip forming roller 36 needs to switch the pressing force pressing the one end between 30 [N] and 120 [N]. In this case, for example, when pressing each end of the nip forming roller 36 with one tension spring, a pressing force of approximately 120 [N] is required for each tension spring at maximum. Therefore, in a case in which the spring constant is 1 [N/mm], the tension spring capable of maintaining elastic deformation without plastic deformation even when the degree of the extension/compression of the tension spring is in a relatively large range, i.e., approximately 120 mm, is necessary.

By contrast, when the degree of extension/compression of the tension spring that can maintain elastic deformation without plastic deformation is in the range of 10 mm, the spring constant necessary for the tension spring needs to be at least 12 [N/mm], which is relatively large. In this case, the sensitivity of the pressing force with respect to the tension of the tension spring is relatively high, and due to the deviation of the tension amount between the tension springs at both ends of the nip forming roller 36 the nip pressure in the axial direction of the nip forming roller 36 varies easily. As a result, image density varies easily in a sheet width direction (main scanning direction).

Figure 3:
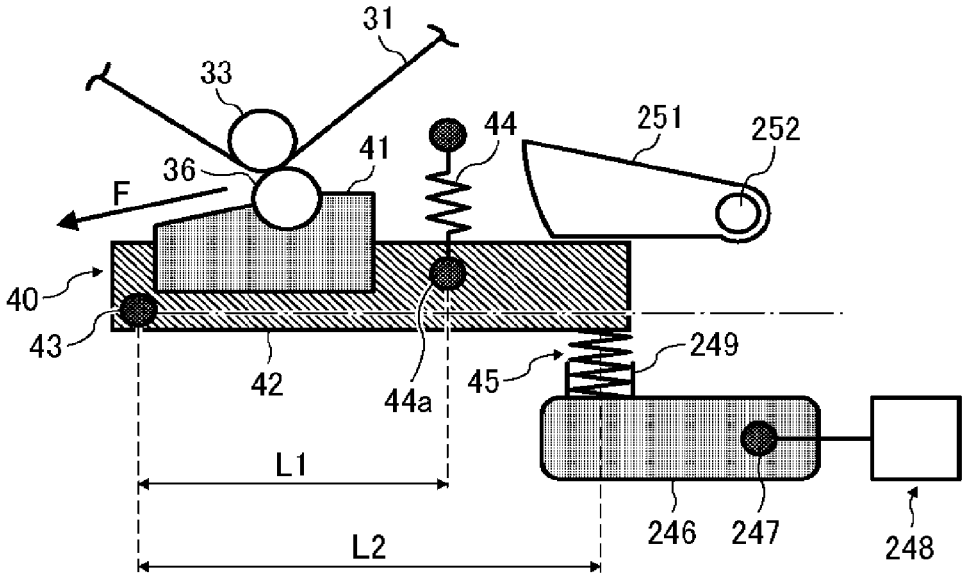
FIG. 3 is a schematic diagram showing a configuration of one end of a pressing device in an axial direction of a nip forming roller at a high nip pressure (in a pressing state) according to an illustrative embodiment of the present disclosure.

FIG. 3 is a schematic diagram illustrating a configuration of the pressing device 40 at one end in the axial direction of the nip forming roller 36 according to the illustrative embodiment of the present disclosure.

The pressing device 40 applies, to the nip forming roller 36, the pressing force with which the nip forming roller 36 contacts the intermediate transfer belt 31 entrained about the secondary-transfer back surface roller 33. The pressing device 40 includes a retainer 42 which holds a secondary transfer unit 41 rotatably supporting both ends of the rotary shaft of the nip forming roller 36. The retainer 42 is rotatable about a rotary shaft 43 parallel to the rotary shaft of the nip forming roller 36.

A portion of the retainer 42 substantially at the nip forming roller side (at the right in FIG. 3) relative to the rotary shaft side receives a biasing force from tension springs as elastic members, that is, a tension spring 44 and a compression spring 45, thereby producing a rotational force about the rotary shaft 43. Due to this rotational force, the nip forming roller 36 contacts the intermediate transfer belt 31 to produce the transfer nip pressure between the nip forming roller 36 and the intermediate transfer belt 31.

The tension spring 44 as a first pressing member is disposed to pull the retainer 42 from above, and to allow a substantially constant biasing force to act on the retainer 42 at all times. On the other hand, the compression spring 45 as a second pressing member is disposed so as to push up the retainer 42 from below, so that the lower end position of the compression spring 45 can be shifted in the vertical or up-down direction in accordance with the rotation angle of a pressure arm 246. The pressure arm 246 is driven to rotate about a rotary shaft 247 by a rotation drive source 248. The controller controls the rotation drive source 248 to change the rotation angle position at which the pressure arm 246 is stopped.

According to the present illustrative embodiment, the biasing force of one set of the tension spring 44 and the compression spring 45 provided at one end side of the nip forming roller 36 in the axial direction needs to change the pressing force at the one end between 30 [N] and 120 [N]. According to the present illustrative embodiment, due to the biasing force of the tension spring 44 the pressing force of 30 [N] is applied at all times. A pressure stay 249 is attached to the bottom end of the compression spring 45. When the pressure arm 246 pushes up the pressure stay 249, the biasing force of the compression spring 45 acts on the retainer 42.

Figure 4:
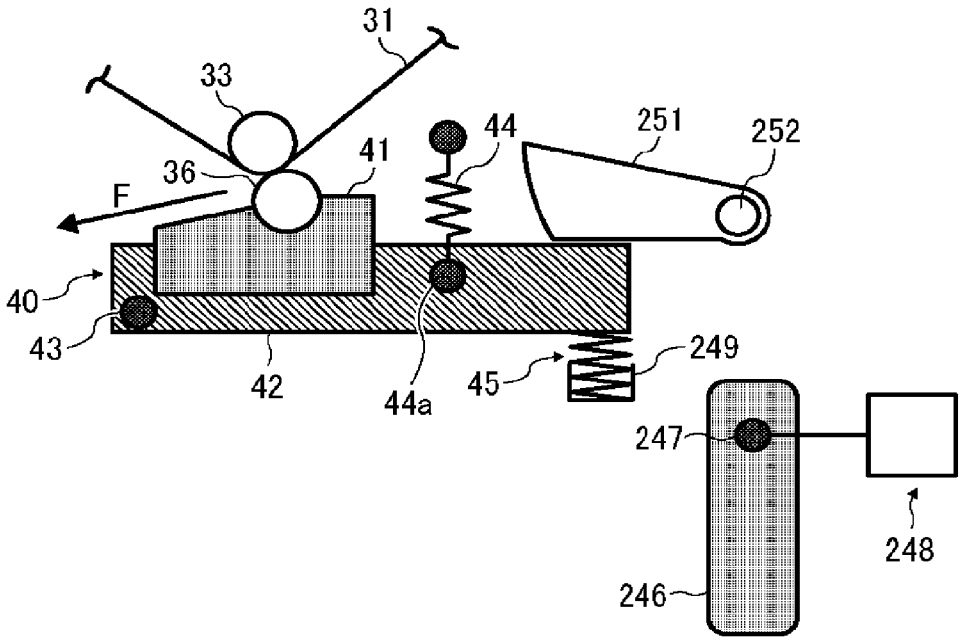
FIG. 4 is a schematic diagram showing a configuration of one end of the pressing device in the axial direction of the nip forming roller at a low nip pressure (in a retracted state) according to an illustrative embodiment of the present disclosure.

In the pressing device 40, in a retracted state in which the pressure arm 246 is stopped at the rotation angle position (second rotation angle) such as shown in FIG. 4, the pressure arm 246 is separated from the pressure stay 249 attached to the lower end of the compression spring 45, so that the compression amount of the compression spring 45 becomes zero (natural length). At this time, the biasing force of the compression spring 45 does not act on the retainer 42, so that the pressing force at the one end is 30 [N] due to the biasing force of the tension spring 44 alone. More specifically, in the present illustrative embodiment, when the pressure arm 246 is stopped at the second rotation angle such as shown in FIG. 4, the pressing force at the one end side is obtained only by the biasing force of the tension spring 44 having the change rate of the restoring force with respect to the unit compression amount or the unit tension amount lower than that of the compression spring 45. With this configuration, the target pressing force (i.e., 30 [N]) can be easily set, thereby obtaining easily the target transfer nip pressure.

In the pressing device 40, in a pressing state in which the pressure arm 246 is stopped at the rotation angle position (first rotation angle) such as shown in FIG. 3, the pressure arm 246 pushes up the pressure stay 249 attached to the lower end of the compression spring 45. Accordingly, the compression spring 45 is compressed, enabling the biasing force of the compression spring 45 to act on the retainer 42. Then, due to the biasing force of the compression spring 45 the pressing force of approximately 90 [N] is applied to the retainer 42. Therefore, the pressing force produced at the one end side of the nip forming roller 36 is approximately 120 [N] which is obtained by adding the biasing force of 90 [N] of the compression spring 45 to the biasing force of 30 [N] of the tension spring 44.

In the present illustrative embodiment, as the tension spring 44, a spring member, for example, having a spring constant of approximately 1.3 [N/mm] can be used. As the compression spring 45, a spring member, for example, having a spring constant of approximately 2.6 [N/mm] can be used.

According to the present illustrative embodiment, when an image is formed on a recording medium P having a coarse surface such as Leathac (registered trademark) paper, two pressure arms 246 provided at both ends of the nip forming roller 36 are positioned at the first rotation angle shown in FIG. 3. With this configuration, the nip forming roller 36 can contact the intermediate transfer belt 31 at the transfer pressure of approximately 240 [N], thereby achieving desired density reproducibility at the recessed portion of the recording medium surface and an image with fewer light and dark patches in accordance with the surface condition of the recording medium P. According to the present illustrative embodiment, the intermediate transfer belt 31 is an elastic belt including an elastic layer. With this configuration, the surface of the intermediate transfer belt 31 can deform and thus fit the embossed surface of the recording medium P when the transfer pressure is increased. Accordingly, the transferability at the recessed portion of the recording medium surface is enhanced.

When the intermediate transfer belt 31 is an elastic belt and an image is formed on a recording medium P having a relatively smooth surface, a high nip pressure at the secondary transfer nip causes degradation of dot reproducibility on the recording medium P. In the image forming apparatus 500, when forming an image on the recording medium having a relatively smooth surface, adequate dot reproducibility is not obtained when the transfer pressure at the secondary transfer nip is equal to or greater than 120 N. When an image is formed on a recording medium P having a relatively smooth surface such as the OK top-coat paper, both pressure arms 246 are positioned at the second rotation angle as shown in FIG. 4. With this configuration, the nip forming roller 36 can contact the intermediate transfer belt 31 at the transfer pressing force of approximately 60 [N], thereby achieving desired dot reproducibility.

According to the illustrative embodiment, an arm 251 is provided as a moving device that moves the nip forming roller 36 from a contact position at which the nip forming roller 36 contacts the surface of the intermediate transfer belt 31 to a separated position at which the nip forming roller 36 is separated from the surface of the intermediate transfer belt 31. The arm 251 is rotatable about a rotary shaft 252 in conjunction with the movement of a lever. With this configuration, the rotation angle position at which the arm 251 is stopped is changed by operating the lever.

The arm 251 is disposed such that its free end is located above the upper surface of the retainer 42. As shown in FIGS. 3 and 4 at the time of the image forming operation, the arm 251 is stopped at the position at which the free end portion of the arm 251 does not push down the retainer 42. At this time, the nip forming roller 36 is situated at the contact position at which the nip forming roller 36 contacts the intermediate transfer belt 31.

Figure 5:
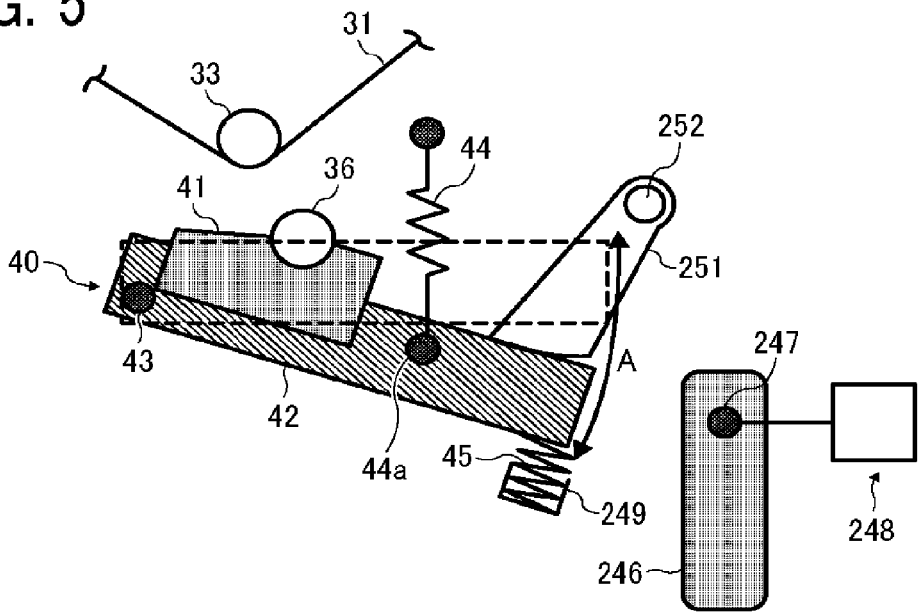
FIG. 5 is a schematic diagram showing a configuration of one end of the pressing device in the axial direction of the nip forming roller when the nip forming roller is located in a separated position.

By contrast, when clearing paper jams and upon maintenance of the secondary transfer unit 41 such as replacement of the secondary transfer unit 41, a technician operates the lever so that the arm 251 moves to the position shown in FIG. 5. At this time, the free end portion of the arm 251 contacts the upper surface of the retainer 42 to push down the retainer 42 against the biasing force of the tension spring 44. Consequently, the retainer 42 is rotated about the rotary shaft 43, and the nip forming roller 36 separates from the intermediate transfer belt 31 as shown in FIG. 5. With this configuration, the nip forming roller 36 can be spaced greatly from the intermediate transfer belt 31, thereby facilitating maintenance and clearance of paper jams by the technician.

According to the illustrative embodiment, as described above, when the nip forming roller 36 is moved from the contact position to the separated position by operating the lever, the arm 246 is retracted. When the pressure arm 246 is retracted, the pressure arm 246 is situated outside the rotational range (moving path) of the retainer 42 rotated about the rotary shaft 43 by the arm 251 in conjunction with the movement of the lever. Here, the rotational range of the retainer 42 refers to a space through which the retainer 42 passes when the retainer 42 is rotated in the rotational range indicated by a double-headed arrow A in FIG. 5. The pressure arm 246 is disposed outside the rotational range of the retainer 42, so that the pressure arm 246 does not hinder the nip forming roller 36 from moving from the contact position to the separated position.

Figure 6:
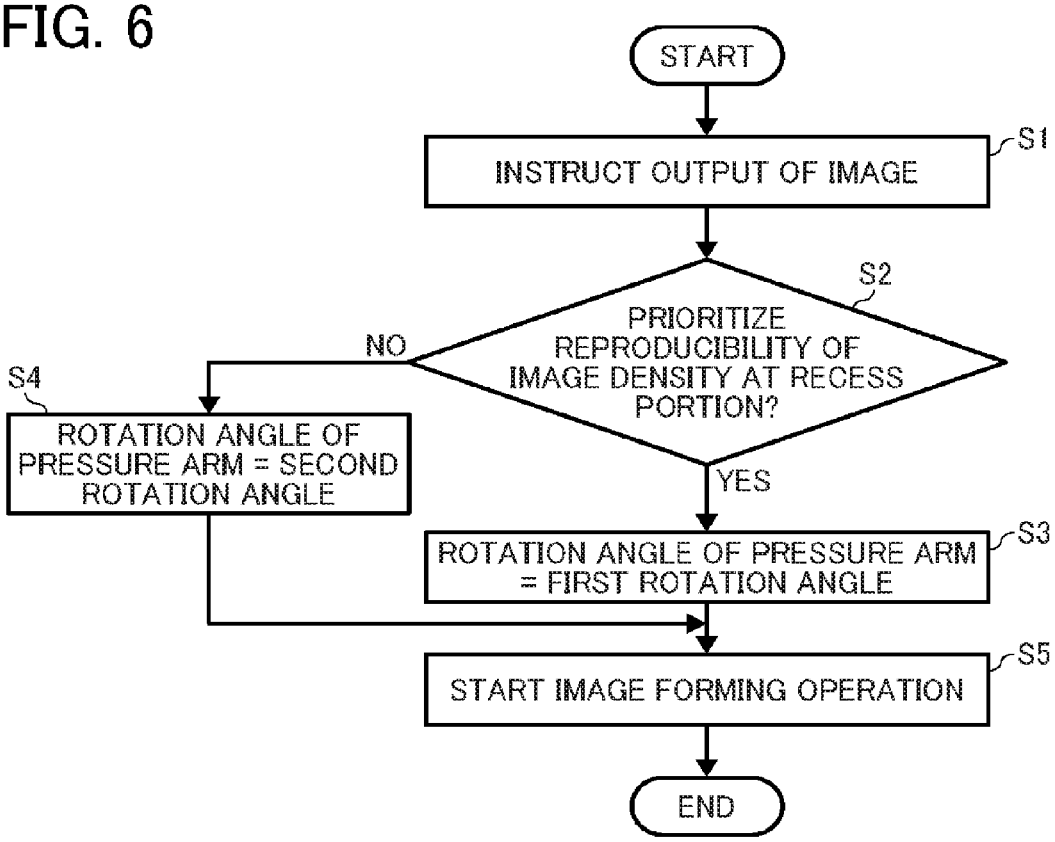
FIG. 6 is a flowchart showing steps of changing the secondary transfer nip pressure according to an illustrative embodiment of the present disclosure.

FIG. 6 is a flowchart showing steps of control for changing the secondary transfer nip pressure according to an illustrative embodiment of the present disclosure.

At step S1, a user operates a control panel to instruct output of an image (S1). In this instruction, when the user instructs that the density reproducibility at the recessed portion is given priority (Yes, at step S2), the rotation drive source 248 of the pressure arm 246 is controlled such that the rotation angle position of the pressure arm 246 of the pressing device 40 comes to the first rotation angle shown in FIG. 3 at step S3. Accordingly, the nip forming roller 36 contacts the intermediate transfer belt 31 at the transfer pressure of approximately 240 [N], hence obtaining a high secondary transfer nip pressure. Thereafter, the image forming operation is started at step S5. With this configuration, the resulting output image has fewer light and dark patches associated with the surface conditions of the recording sheet even when the image is formed on the recording medium P having a coarse surface such as Leathac paper.

By contrast, when the user instructs that the density reproducibility is not given priority upon instructing output of an image (No, at step S2), the rotation drive source 248 of the pressure arm 246 is controlled such that the rotation angle position of the pressure arm 246 of the pressing device 40 comes to the second rotation angle shown in FIG. 4 at step S4. Accordingly, the nip forming roller 36 contacts the intermediate transfer belt 31 at the transfer pressure of approximately 60 [N], hence obtaining a relatively low secondary transfer nip pressure. Subsequently, the image forming operation is started at step S5. With this configuration, the resulting output image on the recording medium having a smooth surface has high dot reproducibility.

In a case in which the user instructs the sheet type upon instructing output of an image, the density reproducibility at the recessed portion may be given priority when the sheet type is paper with a coarse surface (Yes, at step S2), and the density reproducibility at the recessed portion may not be given priority when the sheet type is the smooth paper (No, at step S2).

According to the present illustrative embodiment, the tension spring 44 and the compression spring 45 are used as the elastic members employed in the pressing device 40. This configuration provides greater freedom in the layout of the pressing device 40 as compared with a configuration in which both of the elastic members are the tension springs or the compression springs.

In the pressing device 40 shown in FIG. 3, a distance L2 between a point of the retainer 42 on which the biasing force of the compression spring 45 acts and the rotary shaft 43 is longer than a distance L1 between a point (tension-acting portion 44*a*) of the retainer 42 on which the biasing force of the tension spring 44 acts and the rotary shaft 43.

The pressure applied by the pressing device 40 can be adjusted not only by adjusting the spring constant, the tension amount, and the compression amount of the tension spring 44 and the compression spring 45, but also by adjusting the distances L1 and L2. According to the illustrative embodiment, when the distances L1 and L2 are different, the pressure of the tension spring 44 and the pressure of the compression spring 45 can be individually adjusted as compared with a configuration in which the distances L1 and L2 are the same. Since the distances L1 and L2 are different as in the illustrative embodiment of the present disclosure, this provides greater freedom in the adjustment of the pressure.

More specifically, according to the illustrative embodiment, the distance L2 between the rotary shaft 43 and the compression spring 45 whose biasing force is changed to change the secondary transfer nip pressure is longer than the distance L1 between the rotary shaft 43 and the tension spring 44 which applies the substantially constant biasing force at all times. As the distance from the rotary shaft 43 is longer, the rate of change of the pressure with respect to the amount of change in the biasing force is increased. As for the compression spring 45, a broader switching range of the secondary transfer nip pressure can be achieved with a smaller range of change in the compression amount. Therefore, it is relatively easy to obtain the more appropriate compression spring 45.

According to the present illustrative embodiment, the biasing force of the tension spring 44 that acts on the tension-acting portion 44*a* during the pressing state is set to approximately 44 N for one tension spring 44. Thus, the biasing force of two tension springs 44 will be approximately 88 N. The biasing force of the compression spring 45 that acts on the retainer 42 during the pressing state is set to approximately 66 N for one compression spring 45. Thus, the biasing force of two compression springs 45 will be approximately 132 N. The sum of biasing force is 220 N, which is less than the largest transfer pressure of 240 N of the illustrative embodiment.

In the present illustrative embodiment, the place of the retainer 42 on which the pressure of the compression spring 45 acts serves as the point of effort in the principle of leverage and is disposed spaced apart from the rotary shaft 43 as the fulcrum relative to the nip forming roller 36 as the load. With this configuration, the transfer pressure of 240 N, which is greater than the sum of biasing force 220 N of biasing members such as the tension spring 44 and the compression spring 45, acts.

The image forming apparatus 500 includes the nip forming roller 36 as a nip forming member that contacts the surface of the intermediate transfer belt 31 as the toner image bearer, thereby forming the secondary transfer nip. The image forming apparatus 500 includes the pressing device 40 that generates contact pressure between the nip forming roller 36 and the intermediate transfer belt 31 in accordance with the restoration force of the elastic member when the elastic member deforms elastically. The image forming apparatus 500 includes the pressure arm 246 as a nip-pressure changing device to change the nip pressure of the secondary transfer nip by switching the amount of deformation of the elastic member at least by two steps.

The pressing device 40 of the image forming apparatus 500 includes a plurality of elastic members such as the tension spring 44 and the compression spring 45. While one of the plurality of elastic members, i.e., the tension spring 44, produces the contact pressure, the pressure arm 246 serving as a nip pressure changing device changes the elastic deformation amount (amount of compression) of the different elastic member, that is, the compression spring 45. Accordingly, the nip pressure of the secondary transfer nip is changed.

For example, assuming that a pressure of the pressing device is changed from 30 [N] to 120 [N] to change the transfer nip pressure, when the transfer nip pressure is changed by changing the amount of elastic deformation of one of the elastic members such as in the known configuration, the transfer nip pressure is changed in a manner described below. While the restoring force produced by the elastic deformation of the elastic member produces the pressure of 30 [N], the elastic deformation amount of the elastic member is further increased to the pressure of 120 [N]. In this configuration, the elastic member capable of being elastically deformed with the pressure in the range of from 0 [N] to 120 [N] is needed.

By contrast, according to the present illustrative embodiment, in a state in which all or a part of the pressure of 30 [N] is obtained from the restoring force produced by the elastic deformation of at least one of the elastic members (for the sake of convenience, it is referred to as a first elastic member, i.e., the tension spring 44), the elastic deformation amount of the elastic member (for the sake of convenience, it is referred to as a second elastic member, i.e., the compression spring 45) different from the first elastic member is changed, thereby obtaining the pressure of 120 [N] with the combination of the restoring force of the first elastic member and the restoring force of the second elastic member. At this time, the necessary elastic deformation range for the first elastic member is in a range which can obtain the pressure in a range of from 0 [N] to 30 [N] at maximum.

The necessary elastic deformation range for the second elastic member different from the first elastic member is in a range which can obtain the pressure in a range of from 0 [N] to a pressure obtained by subtracting the pressure (30 [N] at the maximum) supplied by the first elastic member from 120 [N]. That is, the elastic deformation range required for the second elastic member whose elastic deformation amount is switched to change the transfer nip pressure can be narrower than the elastic deformation range required for the elastic member in the known configuration. As a result, the target transfer nip pressure can be stably obtained even when the transfer nip pressure is significantly changed by using the elastic member having a modulus of elasticity within a limited range in which the sensitivity of the transfer nip pressure with respect to the elastic deformation amount of the elastic member is brought into a proper range.

In the known configuration, when the target transfer nip pressure cannot be obtained with the restoring force of a single elastic member, a set of elastic members including two or more elastic members can be used to combine the restoring forces of the elastic members to obtain the target transfer nip pressure. However, when the transfer nip pressure is changed by such a known configuration, each of the elastic deformation amounts of the respective elastic members included in the elastic member set is changed at the same time and to the same level. In other words, the set of elastic members has the function equivalent to a single elastic member. Therefore, according to the illustrative embodiment, with the use of the elastic member set as the second elastic member, the elastic deformation range required for the second elastic member (elastic member set) can be narrower than the elastic deformation range required for the elastic member set in the known configuration.

As described above, in the image forming apparatus 500 of the present illustrative embodiment, the target transfer nip pressure can be stably obtained with the use of an elastic member having a relatively narrow elastic deformation range in a configuration in which the nip pressure is changed.

Embodiment 1

With reference to FIGS. 7 through 11, a description is provided of the retainer 42 of the pressing device 40 according to Embodiment 1 of the present disclosure.

Figure 7:
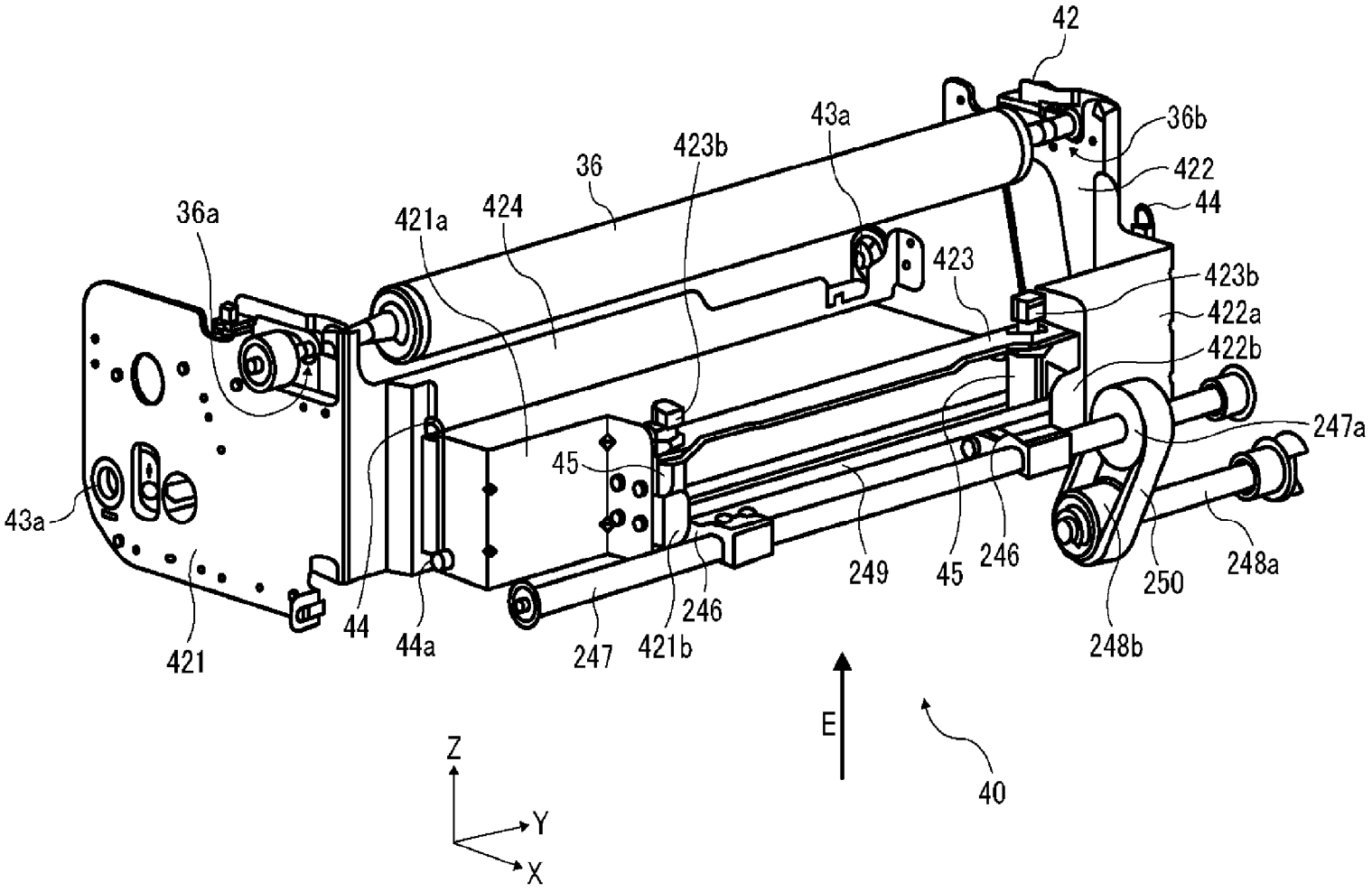
FIG. 7 is a perspective view schematically illustrating the pressing device, according to Embodiment 1.
Figure 8:
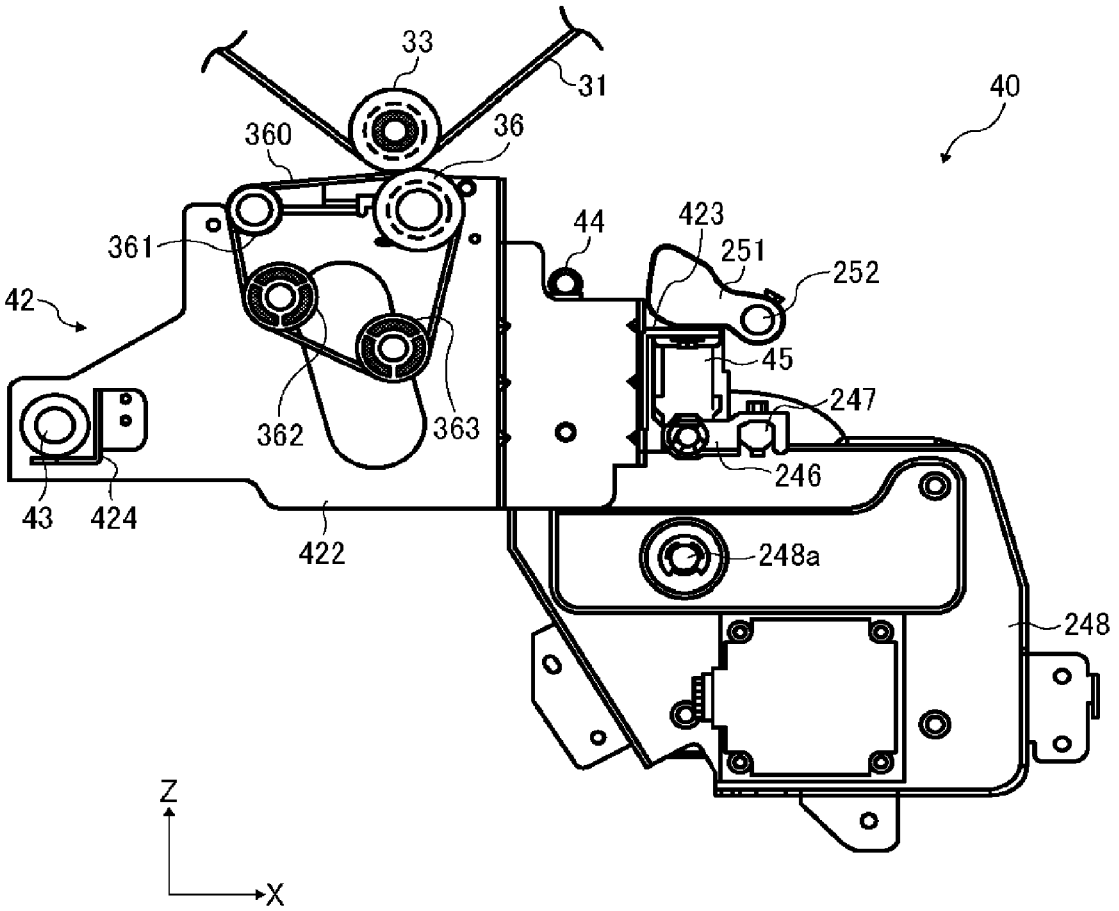
FIG. 8 is a front view schematically illustrating the pressing device of Embodiment 1 in the pressing state.
Figure 9:
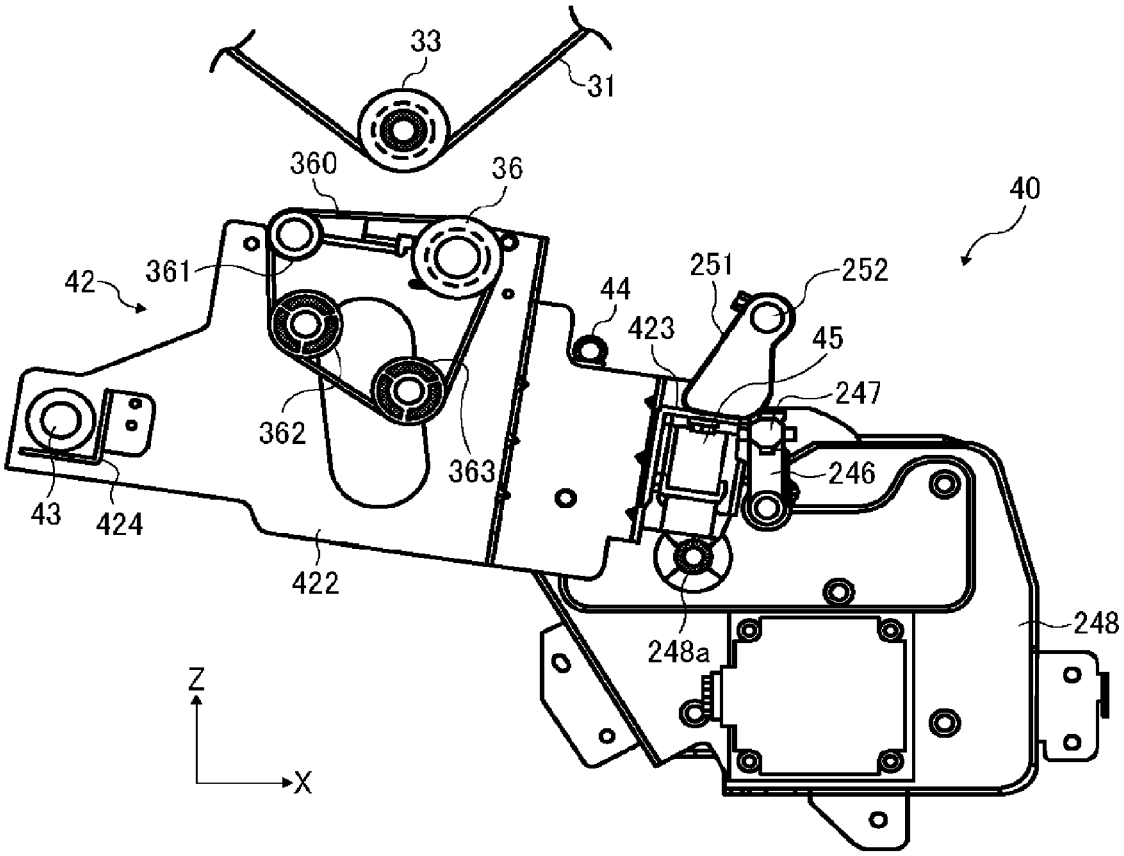
FIG. 9 is a front view schematically illustrating the pressing device of Embodiment 1 in the retracted state.

FIG. 7 is a perspective view schematically illustrating the pressing device 40, according to Embodiment 1. FIG. 8 is a front view schematically illustrating the pressing device 40 of FIG. 3 according to Embodiment 1. FIG. 9 is a front view schematically illustrating the pressing device 40 of FIG. 5 according to Embodiment 1.

As illustrated in FIGS. 8 and 9, the image forming apparatus 500 equipped with the retainer 42 of Embodiment 1 includes a secondary transfer belt 360 serving as a moving member that moves endlessly and contacts the intermediate transfer belt 31 at the secondary transfer nip. The secondary transfer belt 360 is supported by four rollers: the nip forming roller 36, a first secondary-transfer support roller 361, a second secondary-transfer support roller 362, and a third secondary-transfer support roller 363. These four support rollers are held by the secondary transfer unit 41. When the secondary transfer unit 41 is detached from the retainer 42, the secondary transfer belt 360 can be detached from the retainer 42 together with the four support rollers.

The retainer 42 supports both ends of the nip forming roller 36 in the axial direction (i.e., Y-axis direction in FIG. 7). The retainer 42 includes a front lateral plate 421 and a rear lateral plate 422 that position the nip forming roller 36 in place relative to the retainer 42. The front lateral plate 421 and the rear lateral plate 422 are connected via two stays, that is, a first stay 423 at the pressing side and a second stay 424 disposed at the rotary shaft side. The first stay 423 and the second stay 424 extend in the Y-axis direction. The first stay 423 serves as a movable adjuster, and the second stay 424 serves as an adjuster.

As viewed from the top, the retainer 42 has a substantially rectangular shape (on an X-Y plane) with the front lateral plate 421, the rear lateral plate 422, the second stay 424, and the first stay 423. The front lateral plate 421 rotatably supports the front end portion of the nip forming roller 36 at a front-plate shaft bearing 36*a*. The rear lateral plate 422 rotatably supports the rear end portion the nip forming roller 36 at a rear-plate shaft bearing 36*b*.

The second stay 424 is formed of a metal planar member, and as illustrated in FIG. 7 portions of the second stay 424 substantially near the ends at both sides in the axial direction (Y-axis direction) are bent at a right angle, thereby forming opposing planes facing the front lateral plate 421 and the rear lateral plate 422. These opposing planes are fixed to the front lateral plate 421 and the rear lateral plate 422. With this configuration, relative movement of the rotary shaft side of both the front lateral plate 421 and the rear lateral plate 422 in the axial direction (Y-axis direction) is regulated by the second stay 424. Since these opposing planes of the second stay 424 at both ends thereof in the axial direction facing the front lateral plate 421 and the rear lateral plate 422 are fixed to the front lateral plate 421 and the rear lateral plate 422, the front lateral plate 421 and the rear lateral plate 422 are reinforced. In other words, these opposing planes of the second stay 424 at both ends thereof in the axial direction facing the front lateral plate 421 and the rear lateral plate 422 serve as reinforcing members that strengthen the front lateral plate 421 and the rear lateral plate 422.

Figure 10:
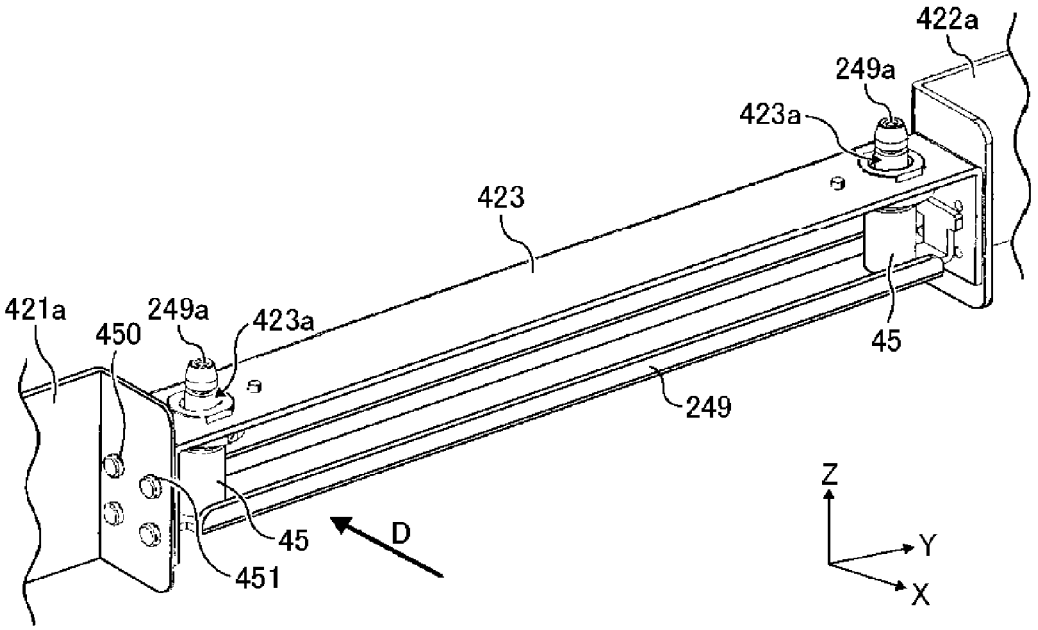
FIG. 10 is a perspective view schematically illustrating an upper stay of a retainer of the pressing device according to Embodiment 1.
Figure 11:
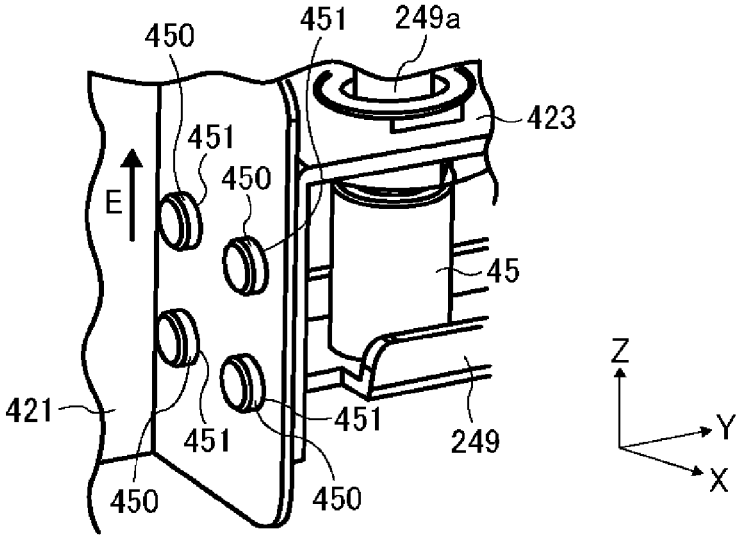
FIG. 11 is a partially enlarged perspective view schematically illustrating a proximal side of the upper stay according to Embodiment 1.
Figure 12:
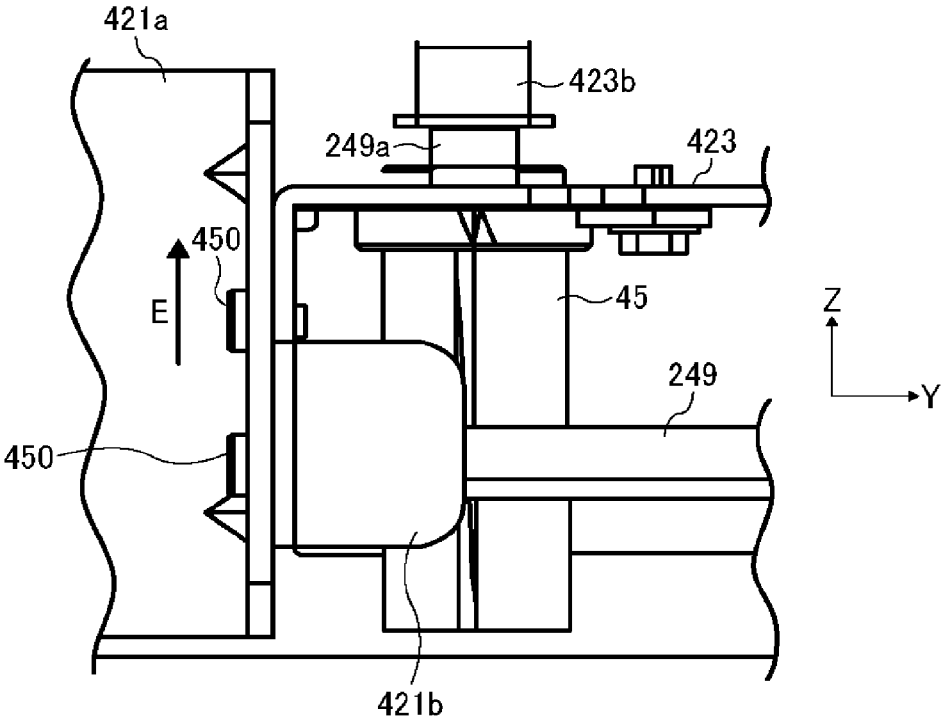
FIG. 12 is a partially enlarged side view schematically illustrating the proximal side of the upper stay as viewed along arrow D in FIG. 10.

FIG. 10 is a partially enlarged perspective view schematically illustrating the first stay 423 of the retainer 42 of the pressing device 40 according to Embodiment 1. FIG. 11 is a partially enlarged perspective view schematically illustrating the proximal side of the first stay 423 of the retainer 42 according to Embodiment 1. FIG. 12 is a partially enlarged side view schematically illustrating the proximal side of the first stay 423 of the retainer 42 as viewed along arrow D in FIG. 10 according to Embodiment 1.

It is to be noted that FIGS. 10 and 11 illustrate a state in which a front spring cover 421*b* of the front lateral plate 421 and a rear spring cover 422*b* of the rear lateral plate 422 are removed.

The retainer 42 of the pressing device 40 of Embodiment 1 is supported rotatably by inserting the rotary shaft 43 fixed to the main body of the image forming apparatus 500 through a shaft bearing 43*a* (shown in FIG. 7) so that the retainer 42 is rotatable about the rotary shaft 43.

Connecting portions of the front lateral plate 421 and the rear lateral plate 422 connected to the first stay 423 are bent inward in the axial direction (Y-axis direction) of the nip forming roller 36 relative to a support portion supporting the end portion of the nip forming roller 36. These bent portions connected to the first stay 423 are referred to as a front-plate connecting portion 421*a* of the front lateral plate 421 and a rear-plate connecting portion 422*a* of the rear lateral plate 422.

As illustrated in FIG. 10, connecting holes 423*a* are formed in the first stay 423 near the ends in the axial direction (Y-axis direction). The connecting holes 423*a* penetrate through the first stay 423 in the vertical direction (up-down direction). The pressure stay 249 includes projections 249*a* disposed near the ends in the axial direction to fit into the connecting holes 423*a*. In a state in which the projections 249*a* are fitted to the connecting holes 423*a* and the tips of the projections 249*a* project beyond the first stay 423 as illustrated in FIG. 10, connecting nuts 423*b* (shown in FIG. 12) are attached to the projections 249*a*. The diameter of the connecting nut 423*b* is larger than the diameter of the connecting holes 423*a* so that the connecting nut 423*b* does not fall through the connecting hole 423*a*. In this configuration, when the pressure stay 249 is not pushed by the pressure arm 246, the pressure stay 249 dangles relative to the first stay 423. It is to be noted that the connecting nuts 423*b* are omitted in FIG. 10.

The compression spring 45 is attached to the projection 249*a* such that the projection 249*a* penetrates through the axial center of the compression spring 45. Accordingly, the compression spring 45 is situated between the pressure stay 249 and the first stay 423.

According to Embodiment 1, when activating the rotation drive source 248, driving force is transmitted to the rotary shaft 247 via a transmission shaft 248*a*, a drive-output gear 248*b*, a timing belt 250, and a drive-input gear 247*a*, thereby rotating the pressure arm 246.

As the pressure arm 246 is rotated, hence pushing up the pressure stay 249 from below, a projecting amount of the projection 249*a* projecting from the first stay 423 increases. As a result, the compression spring 45 comes into contact with the upper surface of the pressure stay 249 and the bottom surface of the first stay 423. As the pressure stay 249 is pushed further up from this state, the compression spring 45 becomes shorter than the natural length thereof, thereby enabling the biasing force of the compression spring 45 to act on the first stay 423. A direction indicated by an arrow E in FIGS. 7, 11, and 12 is a direction in which the biasing force of the compression spring 45 acts. In Embodiment 1, the direction of arrow E coincides with a vertically upward direction.

As illustrated in FIG. 12, the proximal end portion of the first stay 423 in the Y-axis direction is bent at a right angle and extends downward. The bent portion of the first stay 423 faces the front-plate connecting portion of 421*a* of the front lateral plate 421. Similar to the proximal end portion of the first stay 423, the distal end portion of the first stay 423 in the Y-axis direction is bent at a right angle and faces the rear-plate connecting portion of 422*a* of the rear lateral plate 422.

The front-plate connecting portion of 421*a* of the front lateral plate 421 and the rear-plate connecting portion of 422*a* of the rear lateral plate 422 connecting to the first stay 423 include an elongated hole 451 extending in the direction of pressure. A shoulder screw 450 fixed to the first stay 423 is fitted to the elongated hole 451. The shoulder screw 450 is fitted to the elongated hole 451, thereby regulating movement of the shoulder screw 450 in the X-axis direction while allowing the shoulder screw 450 to move in the longitudinal direction of the elongated hole 451 in the Z-axis direction.

The first stay 423 is connected to the front lateral plate 421 and the rear lateral plate 422 by the shoulder screw 450, thereby allowing the first stay 423 to move in the Y-axis direction in a range of the shoulder length of the shoulder screw 450 relative to the front lateral plate 421 and the rear lateral plate 422. According to Embodiment 1, the first stay 423 is movable in a range of approximately 0.3 mm in the Y-axis direction relative to the front lateral plate 421 and the rear lateral plate 422. In other words, there is a backlash in the Y-axis direction.

With this configuration, the movement of the first stay 423 in the X-axis direction is regulated at the connecting portion constituted of the shoulder screw 450 and the elongated hole 451 fitted together while allowing the first stay 423 to move in the Z-axis direction and the Y-axis direction in a predetermined range.

The end portions of the first stay 423 in the axial direction are bent and face the connecting portions of the front lateral plate 421 and the rear lateral plate 422. When the first stay 423 is connected to the front lateral plate 421 and the rear lateral plate 422 using the shoulder screw 450, the end portions of the first stay 423 in the axial direction facing the connecting portions of the front lateral plate 421 and the rear lateral plate 422 contact the front lateral plate 421 and the rear lateral plate 422, thereby reinforcing the front lateral plate 421 and the rear lateral plate 422. In other words, these opposing planes of the first stay 423 at the ends thereof in the axial direction facing the connecting portions of the front lateral plate 421 and the rear lateral plate 422 serve as reinforcing members that strengthen the front lateral plate 421 and the rear lateral plate 422.

With this configuration, the first stay 423 is movably connected to the front lateral plate 421 and the rear lateral plate 422 in the Z-axis direction in a predetermined range. The relative positions of the connecting portion of the first stay 423 at the front lateral plate 421 side and the connecting portion of the first stay 423 at the rear lateral plate 422 side are changeable in the Z-axis direction in a predetermined range.

The biasing force of the tension spring 44 and the compression spring 45 acts in a vertically upward direction. Due to this biasing force, the pressing direction of the retainer 42 pressing the nip forming roller 36 against intermediate transfer belt 31 coincides with the vertically upward direction, that is, a direction parallel to the Z-axis direction. Accordingly, the relative positions of the connecting portion of the first stay 423 at the front lateral plate 421 side and the connecting portion of the first stay 423 at the rear lateral plate 422 side are changeable in the pressing direction in a predetermined range.

The front lateral plate 421, the rear lateral plate 422, the second stay 424, and the first stay 423 which constitute the retainer 42 are made of metal such as aluminum alloy, an electrolytic zinc-coated steel sheet (SECC), and stainless steel (SUS). For the retainer 42, metal having a relatively large stiffness is employed because the image forming apparatus 500 produces a relatively large pressure of 240 N at the maximum as the transfer pressure.

As a known configuration using a relatively small transfer pressure, there is known a secondary transfer unit made of resin that supports the nip forming roller, and a biasing force is exerted to the secondary transfer unit by a biasing member such as a spring, thereby making the nip forming roller to contact the intermediate transfer belt. When the biasing force is applied to the resin secondary transfer unit to produce the transfer pressure of 240 N, the portion of or near the resin secondary transfer unit that receives the biasing force deforms significantly because the stiffness of the resin secondary transfer unit is relatively low. When a part that transmits the biasing force to the nip forming roller deforms partially and significantly, such deformation absorbs the biasing force of the biasing member. As a result, a desired transfer pressure cannot be achieved.

Partial deformation of the part that transmits the biasing force is not limited to the resin secondary transfer unit. Such deformation occurs when the retainer 42 of the illustrative embodiments employs resin. Furthermore, when the part that transmits the biasing force is made of resin and the biasing force is applied to the part to produce the transfer pressure of 240 N, the part may get damaged.

By contrast, according to the illustrative embodiment, the retainer 42, which is applied with the biasing force of the spring and supports the nip forming roller 36, is made of metal having a relatively high stiffness. With this configuration, the retainer 42 that transmits the biasing force to the nip forming roller 36 is prevented from getting partially and significantly deformed, thereby preventing the biasing force of the biasing member from being absorbed. Accordingly, a desired transfer pressure can be applied.

In order to successfully apply a high transfer pressure, in some embodiments, the secondary transfer unit includes a metal housing equipped with the same or similar function as the retainer 42. The secondary transfer unit is detachably attachable relative to the main body, and the biasing member biases the secondary transfer unit. However, the secondary transfer unit having the metal housing weighs more, thus degrading replaceability. The product life cycles of parts constituting the secondary transfer unit 41 of the present illustrative embodiment, such as the secondary transfer belt 360, four support rollers, and so forth, are approximately 800,000 sheets more or less, and the product life cycle of the retainer 42 itself is 10,000,000 sheets or more. If the retainer 42 having such a long product life cycle is assembled with other parts having relatively short product life cycles and hence is replaced periodically based on the shorter product life cycles, the retainer 42 is wasted, which is a waste of money and environmentally-unfriendly.

In view of the above, according to the present illustrative embodiment, the secondary transfer unit 41 and the retainer 42 constitute independent members. More specifically, the secondary transfer unit 41 supports the nip forming roller 36 and other parts as a single integrated unit and is detachably mountable relative to the main body. The retainer 42 transmits the biasing force of the biasing member to the nip forming roller 36. Only the secondary transfer unit 41 is subjected to periodical replacement. With this configuration, the retainer 42, which has a significant weight, is not included in the parts to be replaced periodically. Accordingly, the replaceability of the secondary transfer unit 41 is maintained while the metal retainer 42 enables application of a high transfer pressure. Since the retainer 42 with a relatively long product life cycle is not included in the parts to be replaced periodically, the manufacturing cost, running cost, and adverse effect on the environment can be reduced.

As described above, according to Embodiment 1, with the retainer 42 of the pressing device 40, the movement of the first stay 423 in the X-axis direction is regulated relative to the front lateral plate 421 and the rear lateral plate 422 at the connecting portion at which the shoulder screw 450 and the elongated hole 451 are fitted while allowing the first stay 423 to move in the Z-axis direction and the Y-axis direction in a predetermined range. In order to facilitate an understanding of the novel features of the present disclosure, with reference to FIGS. 22 and 23, a description is provided of a comparative example of the retainer 42 in which the first stay 423 is fixed to the front lateral plate 421 and the rear lateral plate 422.

Generally, the biasing force of the biasing member acts on the pressing member made of resin material. When the biasing force for achieving a desired nip pressure that can enhance transferability at the recessed portion of the recording medium having a coarse surface is applied, strength of such a resin pressing member is not sufficient, resulting in a damage.

In the comparative example, the pressing device 40 includes a retainer 42, a tension spring 44, and a compression spring 45. The tension spring 44 and the compression spring 45 are biasing members. The retainer 42 includes two lateral plates, i.e., a front lateral plate 421 and a rear lateral plate 422 (which may be collectively referred to as lateral plates), and two stays 423 and 424. The front lateral plate 421 and the rear lateral plate 422 support both ends of a nip forming roller 36 serving as a secondary transfer roller. The stays 423 and 424 regulate relative movement of the lateral plates 421 and 422 in an axial direction of the nip forming roller 36. The lateral plates 421 and 422, and the stays 423 and 424 are made of iron having a higher strength than resin and are fixed by screws and welding.

The retainer 42 is rotatably supported by a rotary shaft 43 relative to a main body. The tension spring 44 pulls a tension-acting portion 44*a* upward. The compression spring 45 pushes the stay 423 upward. The tension spring 44 and the compression spring 45 serving as biasing members apply the retainer 42 a biasing force upward, thereby rotating the retainer 42 about the rotary shaft 43 and hence moving the nip forming roller 36 supported by the retainer 42 to contact the intermediate transfer belt. The front lateral plate 421 rotatably supports the nip forming roller 36 at a front-plate shaft bearing 36*a*. The rear lateral plate 422 rotatably supports the nip forming roller 36 at a rear-plate shaft bearing 36*b*.

Figure 22:
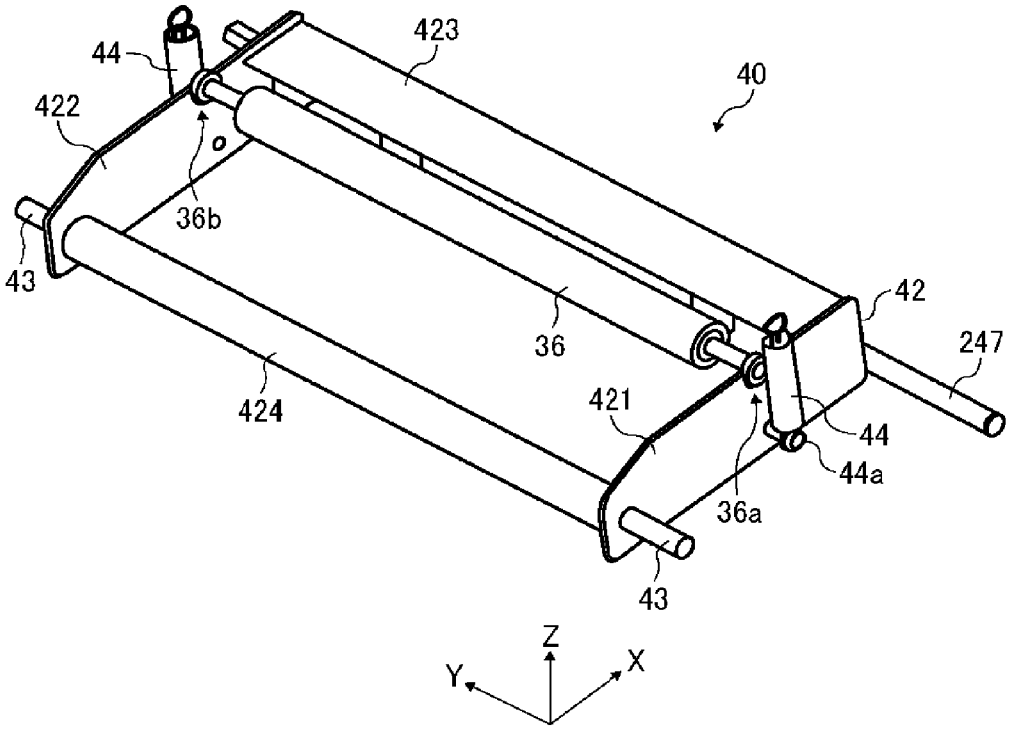
FIG. 22 is a perspective view schematically illustrating a comparative example of the pressing device.
Figure 23:
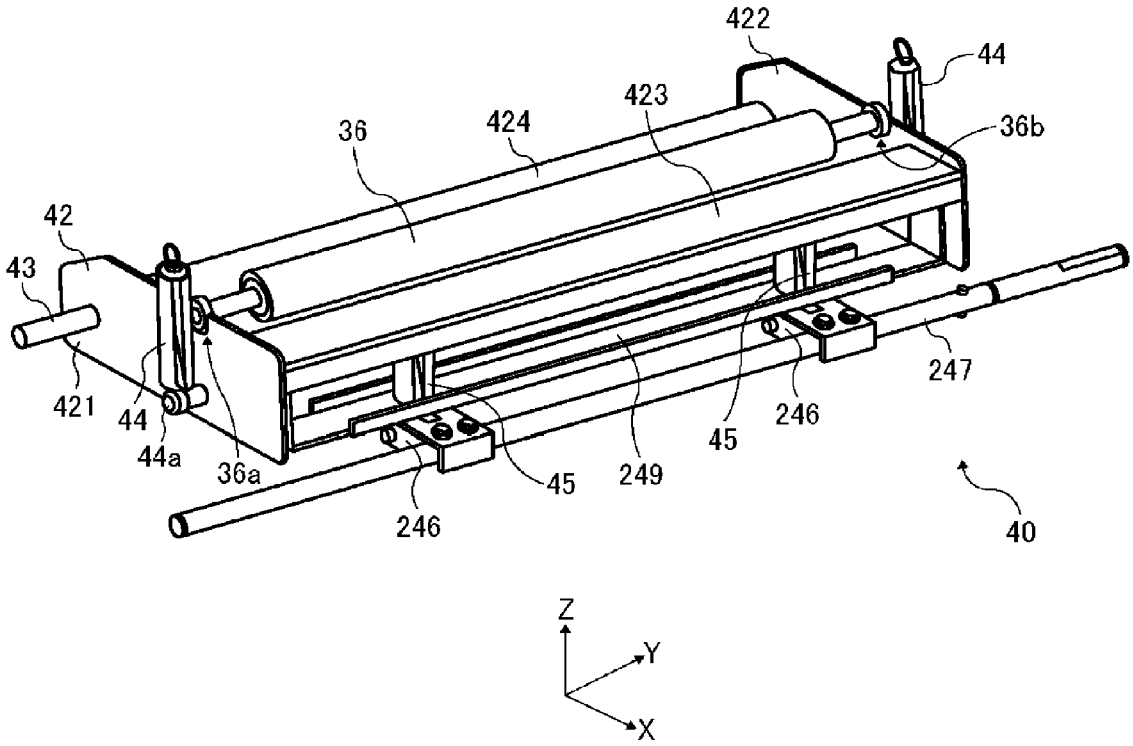
FIG. 23 is a perspective view schematically illustrating the comparative example of the pressing device as viewed along a direction different from the comparative example of the pressing device of FIG. 22.

When the biasing force for achieving a desired nip pressure that can enhance transferability at the recessed portion of the recording medium having a coarse surface is applied by the tension spring 44 and the compression spring 45 of the pressing device 40 shown in FIGS. 22 and 23, the retainer 42 is not damaged over time. However, when a relatively large biasing force is applied to the lateral plates 421 and 422 supporting the nip forming roller 36, the lateral plates 421 and 422 get folded inward or tilted inward in the axial direction. As a result, the position of the nip forming roller 36 relative to the intermediate transfer belt is lowered, causing a decrease in the nip pressure at the transfer nip. The two stays (423 and 424) of the retainer 42 regulate the relative movement of the lateral plates 421 and 422 in the axial direction, hence preventing the lateral plates 421 and 422 from getting folded inward or tilted inward in the axial direction.

The retainer 42 of the pressing device 40 of Embodiment 1 such as shown in FIG. 7 employs, as the second stay 424, a planar member which is bent. By contrast, in the comparative example, the retainer 42 of the pressing device 40 employs a pipe-shaped stay as the second stay. According to the comparative example, a second stay 424 and the first stay 423 of the retainer 42 are fixed to the front lateral plate 421 and the rear lateral plate 422 using a screw and through welding.

Similar to the retainer 42 of Embodiment 1, in the comparative example of the retainer 42 the pressure stay 249 and the first stay 423 are connected by the connecting hole 423*a*, the projection 249*a*, and the connecting nut 423*b*.

The present inventors have recognized that in the pressing device 40 of the comparative example when the tension spring 44 and the compression spring 45 exert biasing force to the nip forming roller 36, enabling the nip forming roller 36 to press, the nip pressure fluctuates in the axial direction (Y-axis direction) of the nip forming roller 36. The following factors can be assumed to have caused changes in the nip pressure.

Due to manufacturing and assembling errors of parts, relative positions of the front lateral plate 421 and the rear lateral plate 422 are changed. As a result, the position of the front-plate shaft bearing 36*a* relative to the rotary shaft 43 differs from the position of the rear-plate shaft bearing 36*b* relative to the rotary shaft 43. Manufacturing errors include, but are not limited to, the difference between the distance from the rotary shaft 43 at the front lateral plate 421 to the front-plate shaft bearing 36*a*, and the distance from the shaft bearing 43*a* at the rear lateral plate 422 to the rear-plate shaft bearing 36*b*. Assembling errors include, but are not limited to, the difference between the position of the front-plate shaft bearing 36*a* relative to the rotary shaft 43 and the position of the rear-plate shaft bearing 36*b* relative to the rotary shaft 43 caused by the difference in an assembling angle around the rotary shaft 43 between the front lateral plate 421 and the rear lateral plate 422.

When the position of the front-plate shaft bearing 36*a* relative to the rotary shaft 43 and the position of the rear-plate shaft bearing 36*b* relative to the rotary shaft 43 are not aligned, the nip forming roller 36 obliquely contacts the secondary-transfer back surface roller 33 when the biasing force of the retainer 42 acts. It is to be noted that the nip forming roller 36 contacts the secondary-transfer back surface roller 33 via the secondary transfer belt 360 and the intermediate transfer belt 31.

As the nip forming roller 36 obliquely contacts the secondary-transfer back surface roller 33, the transfer nip pressure varies at the secondary transfer nip. That is, the contact pressure is higher at the place at which the nip forming roller 36 starts to contact the secondary-transfer back surface roller 33 in the axial direction of the nip forming roller 36. Even when the nip forming roller 36 and the secondary-transfer back surface roller 33 are tilted before contact, unevenness of the transfer nip pressure can be reduced if the retainer 42 is deformed such that the relative positions of the front-plate shaft bearing 36*a* and the rear-plate shaft bearing 36*b* change in the pressing direction.

For example, in a case in which the nip forming roller 36 is oblique relative to the secondary-transfer back surface roller 33 such that the proximal side of the nip forming roller 36 in the axial direction is higher than the distal side of the nip forming roller 36, the proximal side of the nip forming roller 36 starts to contact the secondary-transfer back surface roller 33 first. If the relative positions of the shaft bearings 36*a* and 36*b* do not change while the nip forming roller 36 starts to contact the secondary-transfer back surface roller 33, the nip pressure varies when the pressure arm 246 stops at the first rotation angle to complete the contact. That is, the transfer nip pressure is greater at the proximal side of the secondary transfer nip than at the distal side.

By contrast, if the retainer 42 deforms such that the front-plate shaft bearing 36*a* moves away from the secondary-transfer back surface roller 33 and the rear-plate shaft bearing 36*b* approaches the secondary-transfer back surface roller 33, the nip pressure is prevented from varying. With this configuration, even when the nip forming roller 36 is oblique relative to the secondary-transfer back surface roller 33 so that the proximal side of the nip forming roller 36 in the axial direction starts to contact the secondary-transfer back surface roller 33, the unevenness of the nip pressure can be reduced as compared with the configuration in which the retainer 42 applies pressure while the retainer 42 does not deform and the nip forming roller 36 is oblique.

However, similar to the comparative example of the retainer 42, when the connecting portions of the two stays (424 and 423) and the two lateral plates (421 and 422) are fixed, the retainer 42 cannot deform, forming a closed square shape. With this shape, torsional rigidity increases relative to deformation of the retainer 42 in a twisting manner which changes relative positions of the front-plate shaft bearing 36*a* and the rear-plate shaft bearing 36*b* in the pressing direction. As a result, the retainer 42 is difficult to deform so that the unevenness of the nip pressure is not reduced. If the retainer 42 is difficult to deform to reduce the unevenness of the transfer nip pressure, the deviation of the transfer nip pressure derived from the inclination of the nip forming roller 36 relative to the secondary-transfer back surface roller 33 cannot be reduced, resulting in the unevenness in the nip pressure in the axial direction.

When the nip pressure varies, the transfer rate varies between the high nip pressure and the low pressure, resulting in unevenness of the image density.

In order to reduce the torsional rigidity of the retainer 42 of the comparative example, in some embodiments, the first stay 423 is formed of resin having lower stiffness than that of metal. However, when using material having relatively low stiffness such as resin for the first stay 423 serving as the point of effort of the biasing force of the compression spring 45, the first stay 423 is bent by the pressure of the compression spring 45. As the first stay 423 is bent, the distance between the pressure stay 249 and the first stay 423 increases, hence reducing the compression amount of the compression spring 45 relative to the amount of rise of the pressure stay 249. As a result, a desired transfer pressure cannot be obtained.

The similar difficulty may arise in an image forming apparatus in which a significant change in the transfer nip pressure is required.

Unevenness of the pressure such as the transfer nip pressure may arise not only in the transfer nip, but also a fixing nip of the fixing device or any other nips. The similar difficulty may arise in a pressing device in which a pressing member such as a nip forming member presses against a target and the pressure acting on the target is relatively large.

In view of the above, there is demand for a pressing device capable of pressing an object at a relatively large pressure while preventing unevenness of the pressure at the object, and a transfer device including the pressing device, and an image forming apparatus including the transfer device.

By contrast, according to Embodiment 1, the retainer 42 includes the shoulder screw 450 fitted to the elongated hole 451. With this configuration, the movement of the first stay 423 in the X-axis direction is regulated relative to the front lateral plate 421 and the rear lateral plate 422 while allowing the first stay 423 to move in the Z-axis direction and the Y-axis direction in a predetermined range.

The present inventors have recognized that in the pressing device 40 of Embodiment 1 when the tension spring 44 and the compression spring 45 exert biasing force to the nip forming roller 36, enabling the nip forming roller 36 to press against the intermediate transfer belt 31, the nip pressure does not vary in the axial direction (Y-axis direction) of the nip forming roller 36.

According to Embodiment 1, in a range in which the first stay 423 is movable relative to the front lateral plate 421 and the rear lateral plate 422, the first stay 423 does not contribute to regulation of the relative positions of the front lateral plate 421 and the rear lateral plate 422. Thus, the relative positions of the front lateral plate 421 and the rear lateral plate 422 are restricted only at the rotary shaft 43 side to which the second stay 424 is fixed. As viewed from the top, the retainer 42 has a substantially rectangular shape with three sides (without one side). The relative positions of the front lateral plate 421 and the rear lateral plate 422 forming two opposed sides of the retainer 42 with one side interposed between the front lateral plate 421 and the rear lateral plate 422 can change easily as compared with the retainer 42 having a closed rectangular shape with four sides.

With this configuration, the relative positions of the front-plate shaft bearing 36*a* which is a part of the front lateral plates 421 and the rear-plate shaft bearing 36*b* which is a part of the rear lateral plate 422 can change, thereby enabling the retainer 42 to deform so as to reduce the deviation of the transfer nip pressure. Accordingly, the nip pressure does not vary in the axial direction (Y-axis direction) of the nip forming roller 36.

By preventing the nip pressure from varying in the axial direction (Y-axis direction) of the nip forming roller 36, unevenness of the image density is prevented.

According to Embodiment 1, the end portions of the front lateral plate 421 and the rear lateral plate 422 at the rotary shaft 43 side are fixed via the second stay 424. The range in which the relative positions thereof can change coincides with a range in which the second stay 424 deforms. Therefore, the amount of change in the relative positions of the end portions of the front lateral plate 421 and the rear lateral plate 422 at the rotary shaft 43 side is relatively small. By contrast, the end portions of the pressing side of the front lateral plate 421 and the rear lateral plate 422 are not fixed. The range in which the relative positions thereof can change coincides with a range which is a sum of amounts of deformation of three parts, i.e., the front lateral plate 421, the second stay 424, and the rear lateral plate 422. Therefore, the amount of change in the relative positions of the end portions of the front lateral plate 421 and the rear lateral plate 422 at the pressing side is relatively large.

The retainer 42 of Embodiment 1 that can reduce the deviation of the transfer nip pressure deforms such that the amount of change in the relative positions of the end portions of the front lateral plate 421 and the rear lateral plate 422 at the rotary shaft 43 side is relatively small, while the amount of change in the relative positions thereof at the pressing side is relatively large. In other words, the retainer 42 deforms in a twisting manner.

Figure 13A:
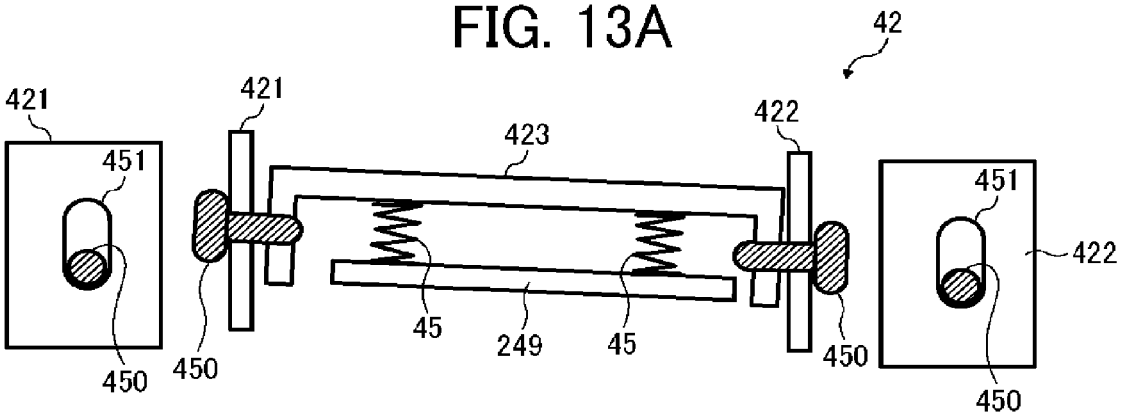
FIGS. 13A through 13C are schematic diagrams illustrating the retainer when two lateral plates are not aligned in a vertical direction.
Figure 13B:
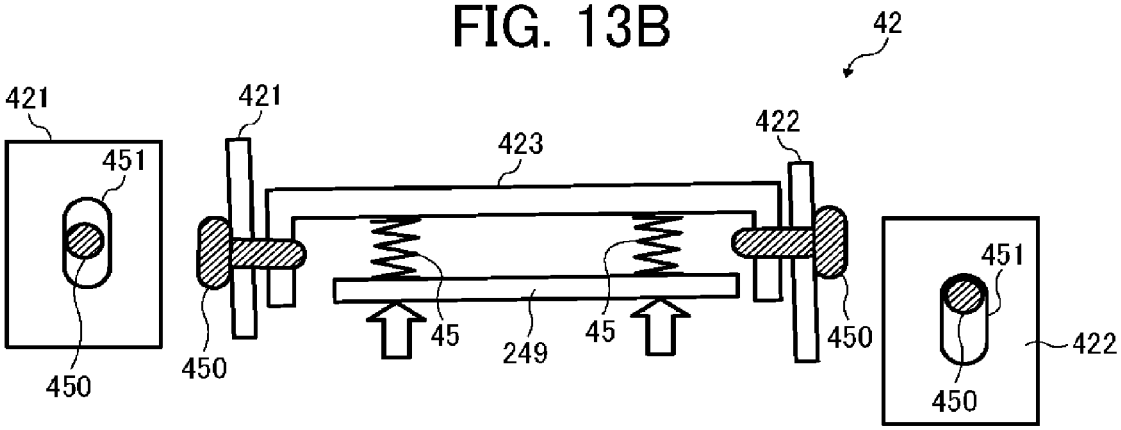
Figure 13C:
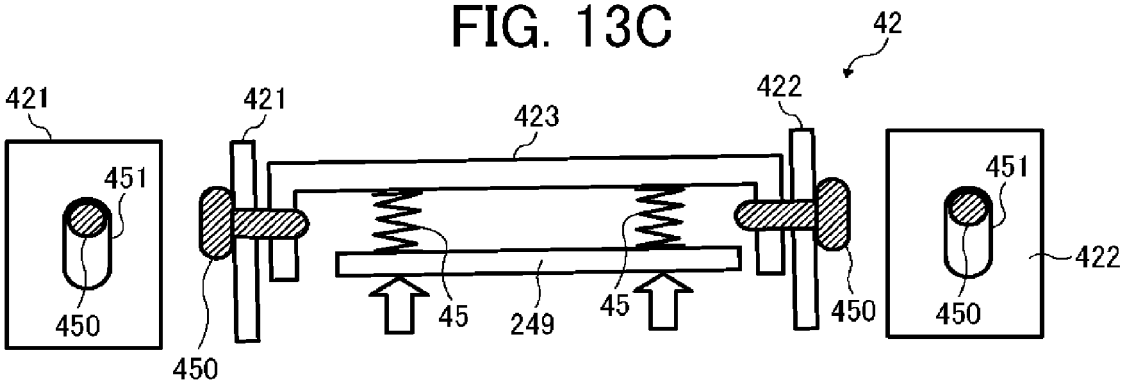

Next, with reference to FIGS. 13A through 13C, a description is provided of changes in the relative positions of the first stay 423, the shoulder screw 450, and the elongated hole 451, when the pressure of the compression spring 45 acts on the retainer 42.

FIGS. 13A through 13C schematically illustrate changes in the relative positions of the first stay 423, the shoulder screw 450, and the elongated hole 451, when the front lateral plate 421 and the rear lateral plate 422 are not aligned in the vertical direction and the pressure of the compression spring 45 acts on the retainer 42. In FIGS. 13A through 13C, the drawing on the left schematically illustrates the front lateral plate 421 on the Z-X plane. The drawing in the center illustrates the retainer 42 on the Y-Z plane. The drawing on the right illustrates the rear lateral plate 422 on the Z-X plane. FIG. 13A illustrates a state prior to application of the pressure. FIG. 13B illustrates a state at the beginning of application of the pressure. FIG. 13C illustrates a state during application of the pressure. In the examples shown in FIGS. 13A through 13C, an imaginary line connecting the tips of two pressure arms 246 is parallel with a horizontal plane, and the biasing forces of two compression springs 45 are equal.

In a state in which the pressure arm 246 does not push up the pressure stay 249, as illustrated in FIG. 13A, the shoulder screw 450 is situated at the bottom of the elongated hole 451. In this state, because the force of the pressure stay 249 pushing up the first stay 423 does not act, the first stay 423 is supported by the front lateral plate 421 and the rear lateral plate 422 via the shoulder screw 450 at the bottom of the elongated hole 451. In FIG. 13A, the front lateral plate 421 is situated at a position higher than the rear lateral plate 422. That is, the front lateral plate 421 and the rear lateral plate 422 are not aligned in the vertical direction, thus causing the first stay 423 to tilt with the end thereof at the rear lateral plate 422 side lower than the other end. In this state, the connecting nut 423*b* attached to the projection 249*a* allows the pressure stay 249 to dangle from the first stay 423.

When the rotation drive source 248 is driven by a controller, the pressure arm 246 rotates and the leading end thereof comes into contact with the bottom surface of the pressure stay 249, thereby pushing up the pressure stay 249. In this state, the imaginary line connecting the tips of two pressure arms 246 is horizontal, and the biasing forces of two compression springs 45 are equal. Thus, the first stay 423 and the pressure stay 249, which are oblique in the state shown in FIG. 13A, become horizontal and move upward.

As the first stay 423 moves up while the first stay 423 is horizontal, the shoulder screw 450 comes into contact only with the upper end of the elongated hole 451 formed in the rear lateral plate 422 which is situated lower than the front lateral plate 421. At this time, as illustrated in FIG. 13B, the shoulder screw 450 at the front lateral plate 421 side does not contact the upper end of the elongated hole 451 in the front lateral plate 421.

As the first stay 423 moves further up from the state shown in FIG. 13B, only the rear lateral plate 422 with the elongated hole 451, the upper end of which contacts the shoulder screw 450, starts to move up. The upward pressure is applied only to the rear lateral plate 422 so that the retainer 42 is deformed in such a manner that the relative position of the rear lateral plate 422 relative to the front lateral plate 421 changes upward.

More specifically, the upward pressure is applied only to the rear lateral plate 422 of the retainer 42, and the upward force also acts on the front lateral plate 421 via the second stay 424. However, the distance from the rotary shaft 43 as the fulcrum of the moment to the second stay 424 is relatively short so that the moment to cause the end portion of the front lateral plate 421 at the pressing side to move up is relatively small. Furthermore, since the front lateral plate 421 made of metal has some weight, the moment that causes the end portion of the front lateral plate 421 at the pressing side to move downward under its own weight is significant. Therefore, the front lateral plate 421 at the pressing side hardly moves up with the upward force that acts via the second stay 424.

The upward moment acts on the end portion of the rear lateral plate 422 at the pressing side due to the pressure. The downward moment acts on the front lateral plate 421 at the pressing side under its own weight. With this configuration, the structure constituted of three sides, i.e., the front lateral plate 421, the rear lateral plate 422, and the second stay 424, deforms in such a manner that the relative position of the end portion of the rear lateral plate 422 at the pressing side changes upward relative to the pressing side of the front lateral plate 421.

As the rear lateral plate 422 moves up to the same level as the front lateral plate 421 while the retainer 42 deforms, as illustrated in FIG. 13C, the shoulder screw 450 at the front lateral plate 421 side comes into contact with the upper end of the elongated hole 451 in the front lateral plate 421.

As the first stay 423 moves further up from the state shown in FIG. 13C, the rear lateral plate 422 and the front lateral plate 421 at the same level move up while maintaining the same level. Subsequently, as the pressure arm 246 arrives at a final position (a first rotation angle position), the nip forming roller 36 supported by the rear lateral plate 422 and the front lateral plate 421 which have risen together with the first stay 423 contacts the secondary-transfer back surface roller 33. If the nip forming roller 36 is not parallel with the secondary-transfer back surface roller 33 in the axial direction at this time, only one side of the nip forming roller 36 in the axial direction contacts the secondary-transfer back surface roller 33 first. The side of the nip forming roller 36 in the axial direction that contacts the secondary-transfer back surface roller 33 first is pushed by the reaction force of the secondary-transfer back surface roller 33.

Accordingly, the retainer 42 deforms such that the relative position of the pushed plate, that is, one of the front lateral plate 421 and the rear lateral plate 422, whichever is pushed, is lowered relative to another of the front lateral plate 421 and the rear lateral plate 422. Accordingly, upon completion of contact of the nip forming roller 36 and the secondary-transfer back surface roller 33, the nip forming roller 36 and the secondary-transfer back surface roller 33 are parallel with each other in the axial direction, thereby applying the transfer nip pressure evenly at the secondary transfer nip.

Figure 14A:
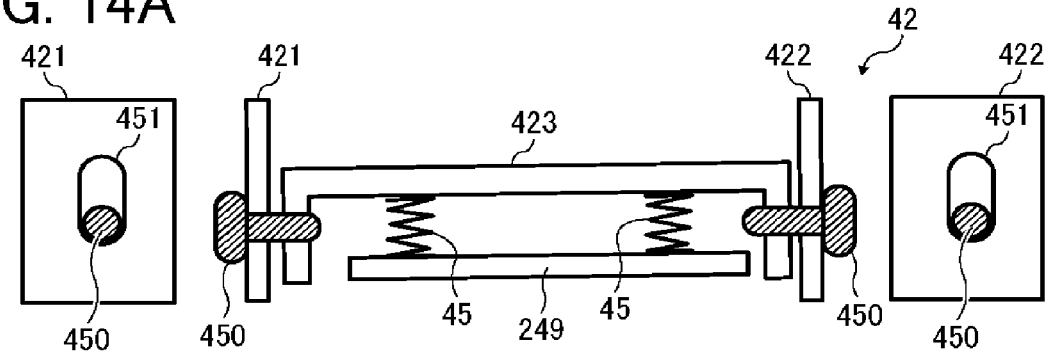
FIGS. 14A through 14D are schematic diagrams illustrating the retainer when the upper stay moves up while the upper stay is tilted.
Figure 14B:
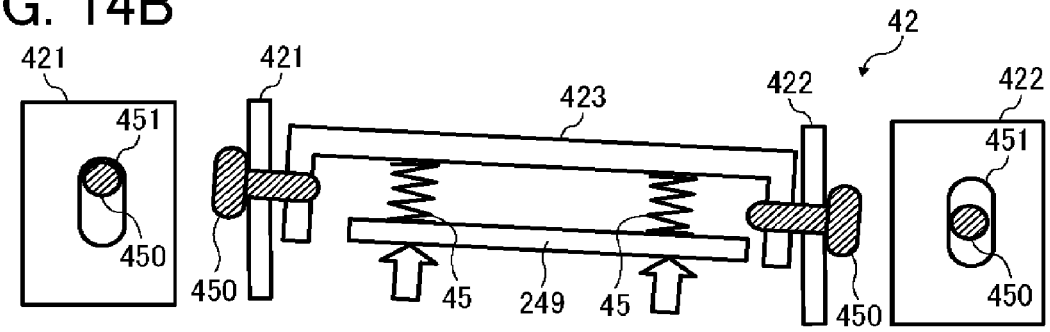
Figure 14C:
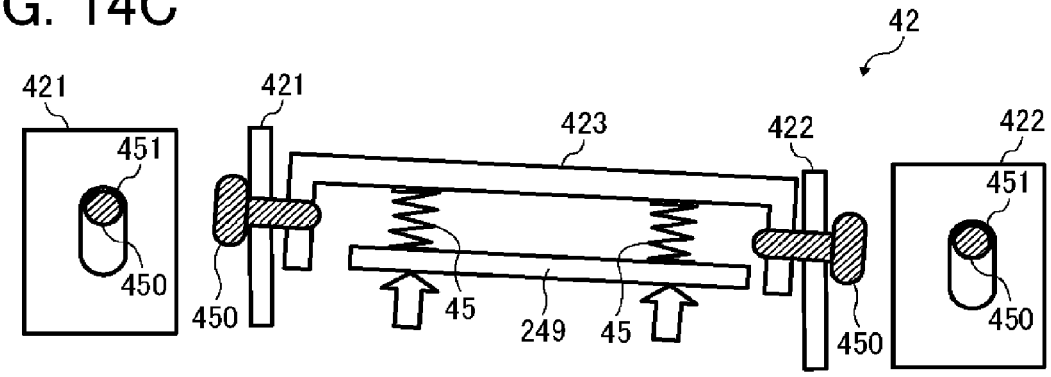
Figure 14D:
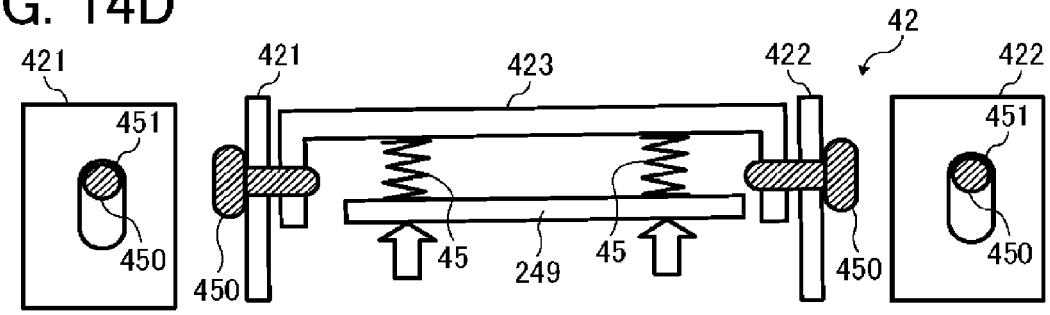

FIGS. 14A through 14D schematically illustrate changes in the relative positions of the first stay 423, the shoulder screw 450, and the elongated hole 451, when the imaginary line connecting the leading ends of the two pressure arms 246 is tilted in the pressing device 40 and the pressure of the compression spring 45 acts on the retainer 42. Similar to FIGS. 13A through 13C, in FIGS. 14A through 14D, the drawing on the left schematically illustrates the front lateral plate 421 on the Z-X plane. The drawing in the center illustrates the retainer 42 on the Y-Z plane. The drawing on the right illustrates the rear lateral plate 422 on the X-X plane. FIG. 14A illustrates a state prior to application of the pressure. FIG. 14B illustrates a state at the beginning of application of the pressure. FIG. 14C illustrates a state during application of the pressure. FIG. 14D illustrates a state when application of the pressure is completed. It is to be noted that in the examples illustrated in FIGS. 14A through 14D, the front lateral plate 421 and the rear lateral plate 422 are aligned in the vertical direction.

In a state in which the pressure arm 246 does not push up the pressure stay 249, as illustrated in FIG. 14A, the shoulder screw 450 is situated at the bottom of the elongated hole 451. In this state, because the force of the pressure stay 249 pushing up the first stay 423 does not act, the first stay 423 is supported by the front lateral plate 421 and the rear lateral plate 422 via the shoulder screw 450 at the bottom of the elongated hole 451. In FIG. 14A, the front lateral plate 421 and the rear lateral plate 422 of the retainer 42 are aligned in the vertical direction so that the first stay 423 is horizontal. In this state, the connecting nut 423*b* attached to the projection 249*a* allows the pressure stay 249 to dangle from the first stay 423.

When the rotation drive source 248 is driven by a controller, the pressure arm 246 rotates and the leading end thereof comes into contact with the bottom surface of the pressure stay 249, thereby pushing up the pressure stay 249. In this state, because the imaginary line connecting the leading ends of two pressure arms 246 is oblique, the first stay 423 and the pressure stay 249, which are horizontal in the state shown in FIG. 14A, tilt and move up. In the example shown in FIGS. 14A through 14D, the leading end of the pressure arm 246 at the proximal side is situated higher than the leading end of the pressure arm 246 at the distal side.

As the first stay 423 moves up while the first stay 423 is oblique, the shoulder screw 450 comes into contact only with the upper end of the elongated hole 451 in the front lateral plate 421 at which the first stay 423 is situated higher than at the rear lateral plate 422, as illustrated in FIG. 14B. In the state shown in FIG. 14B, the shoulder screw 450 is not in contact with the upper end of the elongated hole 451 in the rear lateral plate 422.

As the first stay 423 moves further up from the state shown in FIG. 14B, only the front lateral plate 421 with the elongated hole 451, the upper end of which contacts the shoulder screw 450, starts to move up. The upward pressure is applied only to the front lateral plate 421 so that the retainer 42 is deformed in such a manner that the relative position of the front lateral plate 421 changes upward relative to the rear lateral plate 422. Subsequently, as the first stay 423 moves up while the first stay 423 is oblique, the shoulder screw 450 at the distal side of the first stay 423 comes into contact with the upper end of the elongated hole 451 in the rear lateral plate 422, as illustrated in FIG. 14C. In the state shown in FIG. 14C, because the front lateral plate 421 is situated higher than the rear lateral plate 422, the nip forming roller 36 tilts with the proximal side thereof in the axial direction supported by the front lateral plate 421 being higher than the other side.

As the first stay 423 moves further up from the state shown in FIG. 14C, only the proximal end of the slanted nip forming roller 36 contacts the secondary-transfer back surface roller 33 first. As the first stay 423 moves further up from the state in which only the proximal end of the slanted nip forming roller 36 contacts the secondary-transfer back surface roller 33, the proximal side of the nip forming roller 36 in the axial direction is pushed by the reaction force of the secondary-transfer back surface roller 33. Due to this reaction force, the retainer 42 deforms such that the relative position of the front lateral plate 421 changes downward relative to the rear lateral plate 422. Accordingly, upon completion of contact of the nip forming roller 36 and the secondary-transfer back surface roller 33 such as shown in FIG. 14D, the nip forming roller 36 and the secondary-transfer back surface roller 33 are parallel with each other in the axial direction, thereby applying the transfer nip pressure evenly at the secondary transfer nip.

In the examples shown in FIGS. 14A through 14D, the imaginary line connecting the tips of two pressure arms 246 is oblique. Similar to the illustrative embodiments described above, the transfer nip pressure can be applied evenly to the secondary transfer nip in a case in which the biasing forces of two compression springs 45 vary.

As described above with reference to FIGS. 13A through 14D, when the first stay 423 is raised and the shoulder screw 450 fixed to the first stay 423 contacts the upper end of the elongated hole 451 of one of two lateral plates, only the lateral plate in contact with the shoulder screw 450 moves up. By moving the one of the lateral plates up, the retainer 42 can be deformed such that the relative positions of the connecting portion of the moved plate connected to the first stay 423 and the connecting portion of the other one of the lateral plates connected to the first stay 423 change.

The retainer 42 of Embodiment 1 allows changes in the relative positions of the connecting portion of the front lateral plate 421 connected to the first stay 423 and the connecting portion of the rear lateral plate 422 connected to the first stay 423. The permissible range of changes in the relative positions is from when the shoulder screw 450 contacts the upper end of the elongated hole 451 in one of the lateral plates to when the shoulder screws 450 contact the upper ends of the elongated holes in both plates.

According to Embodiment 1, the retainer 42 has a structure formed of three sides, thereby allowing the retainer 42 to deform easily as compared with the retainer 42 having a closed rectangular shape with four sides. With this configuration, the retainer 42 deforms such that the relative position of the lateral plate having the elongated hole 451 with the upper end thereof contacting the shoulder screw 450 first moves up to some extent, and then the shoulder screws 450 contact the upper ends of the elongated holes 451 in both plates. Subsequently, the end portion of the retainer 42 at the pressing side moves up while the shoulder screws 450 are in contact with the upper end of the elongated holes 451 in both the front lateral plate 421 and the rear lateral plate 422.

The elongated holes 451 in the front lateral plate 421 and in the rear lateral plate 422 of the retainer 42 according to Embodiment 1 are vertically long, that is, the elongated holes 451 is long in the pressing direction of the compression spring 45. With this configuration, after the shoulder screw 450 contacts the elongated hole 451 in one of the lateral plates, the retainer 42 can deform until the shoulder screw 450 contacts the elongated hole 451 in the other plate. Accordingly, the deviation of the relative positions of the front lateral plate 421 and the rear lateral plate 422 relative to the stay 423 in the pressing direction is absorbed. When the contact is complete, the shoulder screws 450 contact the upper end of the elongated holes 451 in both the front lateral plate 421 and the rear lateral plate 422. Even when the first stay 423 is movable in the Z-axis direction relative to the front lateral plate 421 and the rear lateral plate 422, the biasing force of the compression spring 45 can act on the nip forming roller 36 via the front lateral plate 421 and the rear lateral plate 422.

As described with reference to FIGS. 13A through 13C, the relative positions of the lateral plates 421 and the lateral plates 422 in the vertical direction are not aligned due to errors in the retainer 42. As a result, the position of the front-plate shaft bearing 36*a* relative to the rotary shaft 43 differs from the position of the rear-plate shaft bearing 36*b* relative to the rotary shaft 43. Even when there is no error in the retainer 42, but the rotary shaft of the secondary-transfer back surface roller 33 is oblique relative to the rotary shaft 43, the nip forming roller 36 obliquely contacts the secondary-transfer back surface roller 33 when the retainer 42 presses. When the nip forming roller 36 which has been tilted contacts the intermediate transfer belt, the nip forming roller 36 at one side in the axial direction starts to contact the intermediate transfer belt, causing the transfer nip pressure to vary. Even when the rotary shaft of the secondary-transfer back surface roller 33 tilts relative to the rotary shaft 43, hence causing the secondary-transfer back surface roller 33 at one side to start to contact, the retainer 42 capable of deformation to even the transfer nip pressure such as in Embodiment 1 can reduce the deviation of the transfer nip pressure.

In order to ensure uniform transfer nip pressure at the secondary transfer nip, in some embodiments three axes, that is, the rotary shaft of the nip forming roller 36, the rotary shaft of the secondary-transfer back surface roller 33, and the rotary shaft 43 are parallel. If one of the three axes tilts relative to other axes, the nip forming roller 36 obliquely contacts the secondary-transfer back surface roller 33 when the retainer 42 presses. By contrast, according to Embodiment 1, since the retainer 42 can deform to reduce the deviation of the transfer nip pressure, even when one of the three axes tilts relative to other axes, the transfer nip pressure is made even at the secondary transfer nip.

According to Embodiment 1, the transfer nip pressure is produced by two pressing members, that is, the tension spring 44 as a first pressing member and the compression spring 45 as a second pressing member. Alternatively, in some embodiments, the first stay 423 can be moved in the Z-axis direction relative to the front lateral plate 421 and the rear lateral plate 422 such as in Embodiment 1 with only one of the tension spring 44 and the compression spring 45 configured to press.

As long as the pressing member such as the tension spring 44 can bias the front lateral plate 421 and the rear lateral plate 422, the stay such as the first stay 423 and the second stay 424 is not necessary in some embodiments. Without the stay, a binding force to bind the relative positions of the front lateral plate 421 and the rear lateral plate 422 is weakened, thereby allowing the retainer 42 to deform to reduce the deviation of the transfer nip pressure. Furthermore, a configuration in which the stay at the pressing side is movable in the Z-axis direction relative to the front lateral plate 421 and the rear lateral plate 422 cannot be applied to a configuration without the stay.

If there is no stay, the permissible range of change in the relative positions of the front lateral plate 421 and the rear lateral plate 422 is too wide. The front lateral plate 421 and the rear lateral plate 422 are rotatable about the rotary shaft 43 which is inserted through the shaft bearing 43*a*. In such a configuration, if there is no stay, the position of the front lateral plate 421 and the rear lateral plate 422 can change in the axial direction, causing greater positional variation of the front lateral plate 421 and the rear lateral plate 422. Such positional variation can cause these lateral plates to bend inward or outward from the fulcrum at which the rotary shaft 43 is inserted.

When a relatively large transfer pressure, for example, 240 N as in the image forming apparatus 500, is applied, the upper portions of the front lateral plate 421 and the rear lateral plate 422 tilt inward (inward tilt). Such inward tilt occurs easily especially in a configuration in which the point of load (tension-acting portion 44*a*) of the biasing force is situated at the bottom portion of the front lateral plate 421 and the rear lateral plate 422. The inward tilt of the front lateral plate 421 and the rear lateral plate 422 narrows the space between the front lateral plate 421 and the rear lateral plate 422. As a result, the secondary transfer unit 41 cannot be disposed. Furthermore, when front lateral plate 421 and the rear lateral plate 422 tilt inward, the front lateral plate 421 and the rear lateral plate 422 become oblique and the position of the front-plate shaft bearing 36*a* and the rear-plate shaft bearing 36*b* becomes lower than the desired position, thereby reducing the nip pressure at the secondary transfer nip.

Alternatively, in some embodiments, the second stay 424 is disposed while omitting the stay at the pressing side such as the first stay 423. Such a configuration suppresses, if not prevented entirely, changes in the relative positions of the end portion of the front lateral plate 421 and the rear lateral plate 422 at the rotary shaft side. Accordingly, the inward tilt can be prevented as compared with having no second stay 424. However, the range of change in the relative positions of the end portions of the front lateral plate 421 and the rear lateral plate 422 is relatively wide so that the inward tilt is not prevented adequately.

By contrast, according to Embodiment 1, the retainer 42 includes the second stay 424 and the first stay 423, and the movement of the first stay 423 in the X-axis direction is regulated so as not to exceed a certain range relative to the front lateral plate 421 and the rear lateral plate 422. More specifically, the first stay 423 is movable in the Y-axis direction within the range of the shoulder length of the shoulder screw 450 and movable in the Z-axis direction within the longitudinal direction of the elongated hole 451. Movement exceeding such ranges is regulated. Therefore, the permissible range of change in the relative positions of the front lateral plate 421 and the rear lateral plate 422 is prevented from getting too wide. More specifically, as the front lateral plate 421 and the rear lateral plate 422 move to bend inward, the inner surfaces of the front lateral plate 421 and the rear lateral plate 422 come into contact with the first stay 423, hence preventing the inward tilt.

As described above, according to Embodiment 1, in the retainer 42, the first stay 423 is allowed to move in the Z-axis direction and the Y-axis direction in a predetermined range relative to the front lateral plate 421 and the rear lateral plate 422. With this configuration, even when the relative positions of the front lateral plate 421 and the rear lateral plate 422 are degraded due to manufacturing errors or the like, the entire structure constituted of three side, that is, the retainer 42 with the front lateral plate 421, the second stay 424, and the rear lateral plate 422 can deform little by little to correct the deviation of the relative positions. The retainer 42 can deform to reduce the deviation of the transfer nip pressure. In other words, with the configuration including the retainer 42 of Embodiment 1, while the inward tilt is prevented when a relatively large transfer pressure is applied, the deviation of the transfer nip pressure is reduced.

According to Embodiment 1, similar to the comparative example, while maintaining rigidity in the direction of a surface tilt such as the inward tilt, the torsional rigidity can be reduced relative to deformation of the retainer 42 in a twisting manner in which the relative positions of the front-plate shaft bearing 36*a* and the rear-plate shaft bearing 36*b* in the pressing direction change. Maintaining the rigidity in the direction of the surface tilt allows a relatively high transfer nip pressure. Reducing the rigidity allows changes in the relative positions of the front-plate shaft bearing 36*a* and the rear-plate shaft bearing 36*b* in the pressing direction so that the retainer 42 can deform, thereby reducing the deviation of the transfer nip pressure. Accordingly, unevenness of the transfer nip pressure is prevented.

According to the present illustrative embodiment, the connecting portion of the two lateral plates to which the first stay is connected coincides with a place on which a force in the pressing direction acts when pressure is applied. In Embodiment 1, the place of the lateral plates on which the pressure acts is the upper end of the elongated hole 451 in the lateral plates (421 and 422) which contacts the shoulder screw 450. In the pressing device 40 of Embodiment 1, the relative positions of the upper ends of the elongated holes 451 in the two lateral plates (421 and 422) are changeable in the pressing direction. Accordingly, when pressure is applied, the relative positions of the portions on the lateral plates on which the force acts are changeable in the pressing direction.

In Embodiment 1 in which the pressure member biases the front lateral plate 421 and the rear lateral plate 422, when the pressure acts, the place on the lateral plates (421 and 422) where the shoulder screws 450 contacts is the bottom end of the elongated hole 451. In a configuration in which the biasing force does not act on the first stay, the first stay is supported by two lateral plates. As long as the same configuration as in Embodiment 1 is employed except that the biasing member to bias the first stay is not employed, the relative positions of the bottom ends of the elongated holes 451 in the two lateral plates (421 and 422) in the pressing direction are also changeable similar to the upper ends of the elongated holes 451. Therefore, even in a configuration having only the pressing member that biases the front lateral plate 421 and the rear lateral plate 422, when pressure is applied, the relative positions of the portions on the lateral plates on which the force in the pressing direction acts are changeable.

Embodiment 2

Figure 15:
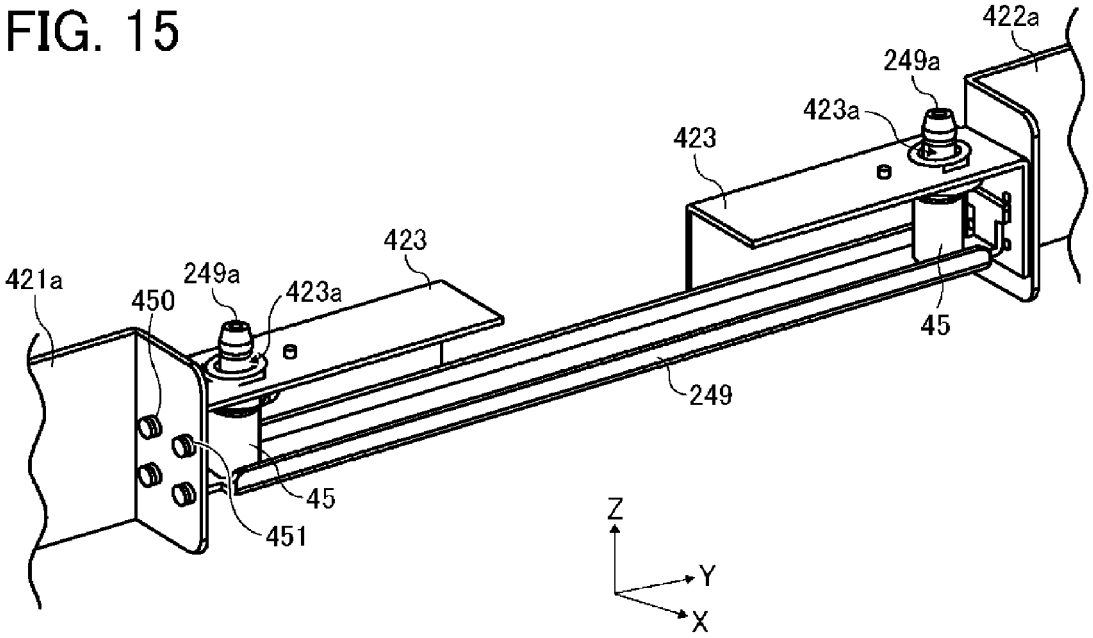
FIG. 15 is a perspective view schematically illustrating the upper stay of the retainer of the pressing device, according to Embodiment 2.

With reference to FIG. 15, a description is provided of another example of the pressing device 40 according to Embodiment 2 of the present disclosure.

The pressing device 40 of Embodiment 2 has the same configuration as the pressing device 40 of Embodiment 1, except for the first stay 423 of the retainer 42. Thus, only the difference will be described below.

FIG. 15 is a perspective view schematically illustrating the retainer 42 of the pressing device 40 near the first stay 423 according to Embodiment 2. FIG. 15 illustrates the pressing device 40 corresponds to the pressing device 40 of Embodiment 1 shown in FIG. 10.

As illustrated in FIG. 15, the first stay 423 of the retainer 42 of the present illustrative embodiment is split into two in the Y-axis direction as compared with the first stay 423 of Embodiment 1 which is a single part.

Although the first stay 423 is split into two, the split parts of first stay 423 are connected by the pressure stay 249. The pressure stay 249 is connected to the first stay 423 by the projection 249*a*. In a state in which the biasing force of the compression spring 45 does not act, the connecting nut 423*b* attached to the projection 249*a* allows the pressure stay 249 to dangle from the first stay 423. As the projection 249*a* fixed to the pressure stay 249 is fitted to the connecting hole 423*a* of the first stay 423, the relative positions of the pressure stay 249 and the first stay 423 in the X-axis direction and the Y-axis direction are regulated.

The relative positions of the pressure stay 249 and the first stay 423 moving away in the Z-axis direction are regulated as the bottom end portion of the connecting nut 423*b* attached to the projection 249*a* comes into contact with the upper surface of the first stay 423. The relative positions of the pressure stay 249 and the first stay 423 approaching in the Z-axis direction are regulated as the pressure stay 249 and the first stay 423 come into contact with the compression spring 45 disposed between the pressure stay 249 and the first stay 423. Accordingly, the relative positions of the pressure stay 249 and the first stay 423 in the Z-axis direction are changeable in a predetermined range.

Similar to Embodiment 1, the split parts of the first stay 423 are connected to the two lateral plates by the shoulder screws 450 fitted into the elongated holes 451. With this configuration, the movement of the first stay 423 in the X-axis direction is regulated relative to the front lateral plate 421 and the rear lateral plate 422 at the connecting portion at which the shoulder screw 450 and the elongated hole 451 are fitted while allowing the first stay 423 to move in the Z-axis direction and the Y-axis direction in a predetermined range.

Similar to Embodiment 1, in Embodiment 2, the first stay 423 is movable in the Y-axis direction within a range corresponding to the shoulder length of the shoulder screw 450 relative to the front lateral plate 421 and the rear lateral plate 422, but the movement of the first stay 423 exceeding this range is regulated. Thus, similar to Embodiment 1, in Embodiment 2, the front lateral plate 421 and the rear lateral plate 422 are difficult to deform in the direction of the surface tilt. More specifically, as the front lateral plate 421 and the rear lateral plate 422 move to tilt inward, the inner surfaces of the front lateral plate 421 and the rear lateral plate 422 come into contact with the first stay 423, hence preventing the inward tilt.

Accordingly, the relative positions of the pressure stay 249 and the first stay 423 in the Z-axis direction are changeable in a predetermined range. Accordingly, the relative positions of the split parts of the first stay 423 in the Z-axis direction connected by the pressure stay 249 are changeable within a predetermined range. In the present illustrative embodiment, the relative positions of the connecting portion of the front lateral plate 421 connected to the first stay 423 and the connecting portion of the rear lateral plate 422 connected to the first stay 423 are changeable more easily than the retainer 42 of Embodiment 1. Because the relative positions of the front lateral plate 421 and the rear lateral plate 422 in the Z-axis direction as the pressing direction are easily changeable, the retainer 42 can deform to reduce the deviation of the transfer nip pressure more easily than Embodiment 1. In other words, with the configuration including the retainer 42 of Embodiment 2, the deviation of the transfer nip pressure is reduced while the inward tilt is prevented when a relatively large transfer pressure is applied.

According to Embodiment 2, the first stay 423, which is a part biased in the retainer 42, is split into two, and the split parts are connected by a different part. With this configuration, the flexural rigidity of the first stay 423 to be biased does not contribute to the torsional rigidity of the retainer 42.

In Embodiment 2, the split parts of the first stay 423 are connected to the two lateral plates by the shoulder screws 450 and the elongated holes 451. Alternatively, as long as the relative positions of the split parts of the first stay 423 in the Z-axis direction are changeable, in some embodiments the connecting portions of the first stay 423 that connect to the two lateral plates can be fixed. Because the relative positions of the split parts of the first stay 423 in the Z-axis direction are changeable, the relative positions of the connecting portion of the front lateral plate 421 connected to the first stay 423 and the connecting portion of the rear lateral plate 422 connected to the first stay 423 in the Z-axis direction become changeable. Therefore, even when the connecting portions of the split parts (two parts) of the first stay 423 connected to the two lateral plates are fixed, the retainer 42 can deform to reduce the deviation of the transfer nip pressure.

When the relative positions of the split parts of the first stay 423 in the Z-axis direction are changeable and the first stay 423 is connected to the two lateral plates by the shoulder screw 450 and the elongated hole 451 in Embodiment 2, the retainer 42 can deform more easily. Therefore, even when the relative positions of the split parts of the first stay 423 in the Z-axis direction are changeable, it is more preferable that the relative positions of the first stay 423 and the two lateral plates be changeable.

According to Embodiment 2, while maintaining the rigidity in the direction of the surface tilt similar to the retainer of the comparative example, the torsional rigidity relative to the deformation of the retainer 42 in a twisting manner that changes the relative positions of the shaft bearing 36*a* and the shaft bearing 36*b* in the pressing direction can be decreased. The transfer nip pressure can be set relatively high by securing the rigidity in the direction of the surface tilt. Reducing the torsional rigidity allows changes in the relative positions of the front-plate shaft bearing 36*a* and the rear-plate shaft bearing 36*b* in the pressing direction so that the retainer 42 can deform to reduce the deviation of the transfer nip pressure. Accordingly, unevenness of the transfer nip pressure can be suppressed.

According to Embodiment 2, when the first stay 423 is cut or split, the biasing forces of the two compression springs 45 act independently on the two lateral plates. At this time, if the biasing forces of the two compression springs 45 are different from one another, the difference between the biasing forces results in the difference between the biasing forces acting on the two lateral plates, hence resulting in the deviation of the pressure at the proximal side and at the distal side in the axial direction of the nip forming roller 36. By contrast, in Embodiment 1, the biasing forces of the two compression springs 45 act on the first stay 423 formed of a single member, thereby exerting the biasing forces to the two lateral plates via the first stay 423. In Embodiment 1, even when the biasing forces of the two compression springs 45 are different from one another, the resultant force of the compression springs 45 acts on the two lateral plates via the first stay 423, so that the difference between the biasing forces of the two compression springs 45 does not cause unevenness of the biasing force acting on the two lateral plates.

According to the present illustrative embodiment, the connecting portion of the two lateral plates to which the first stay is connected coincides with a place on which a force in the pressing direction acts when pressure is applied. In Embodiment 2, the place of the lateral plates on which the pressure acts is the upper end of the elongated hole 451 in the lateral plates (421 and 422) which contacts the shoulder screw 450. In the pressing device 40 of Embodiment 2, the relative positions of the upper ends of the elongated holes 451 in the two lateral plates are changeable in the pressing direction. Accordingly, when pressure is applied, the relative positions of the portions of the lateral plates on which the force acts are changeable in the pressing direction.

Embodiment 3

Figure 16:
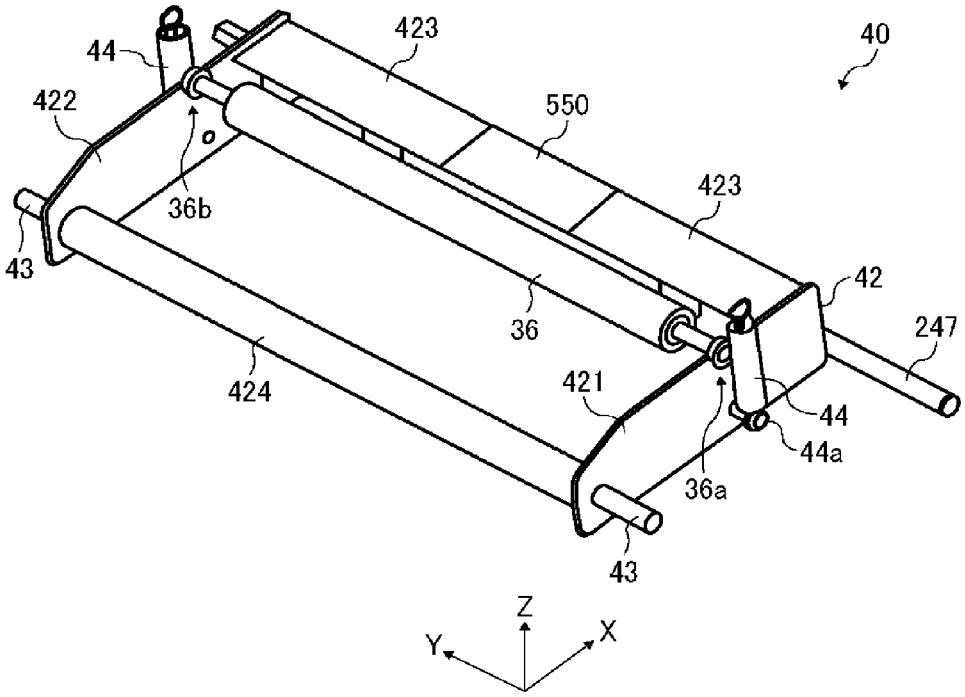
FIG. 16 is a perspective view schematically illustrating the pressing device, according to Embodiment 3.
Figure 17:
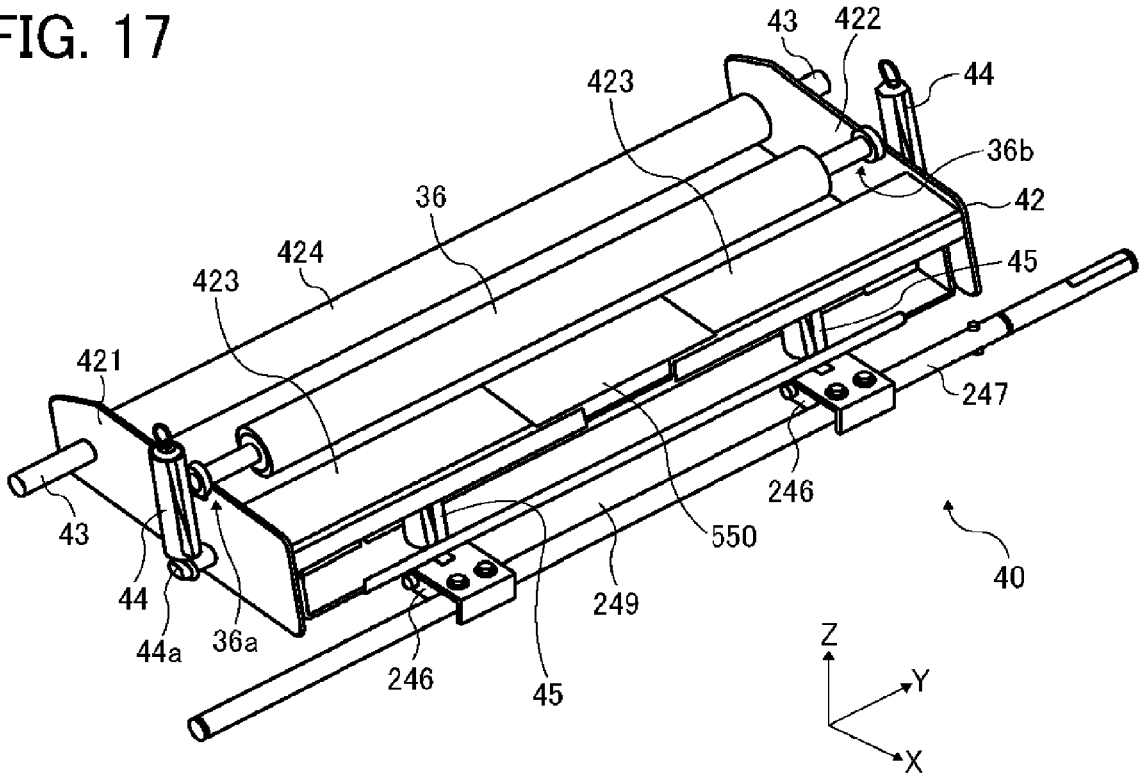
FIG. 17 is a perspective view schematically illustrating the pressing device of Embodiment 3 as viewed along a direction different from FIG. 16.

With reference to FIGS. 16 and 17, a description is provided of another example of the pressing device 40 according to Embodiment 3 of the present disclosure.

The pressing device 40 of Embodiment 3 has the same configuration as the pressing device 40 of Embodiment 1, except for the first stay 423 of the retainer 42. Thus, only the difference will be described below.

FIG. 16 is a perspective view of the pressing device 40 of Embodiment 3. FIG. 17 is a perspective view schematically illustrating the pressing device of Embodiment 3 as viewed along a direction different from FIG. 16.

As illustrated in FIGS. 16 and 17, the first stay 423 of retainer 42 of the present illustrative embodiment is split into two in the Y-axis direction as compared with the first stay 423 of Embodiment 1 which is a single member. The split parts of the first stay 423 are connected by a leaf spring 550. According to Embodiment 3, the front lateral plate 421 and the rear lateral plate 422 are fixed to the first stay 423 using a screw and through welding.

Similar to the retainer 42 of Embodiment 1, in Embodiment 3 the pressure stay 249 and the first stay 423 are connected by the connecting hole 423*a*, the projection 249*a*, and the connecting nut 423*b*.

The leaf spring 550 flexes easily in the vertical direction which is the pressing direction, but the leaf spring 550 does not flex easily in the surface tilt direction of the two lateral plates. According to the present illustrative embodiment, the first stay 423 which is a part biased in the retainer 42 is split and the split parts are connected by the leaf spring 550. With this configuration, the flexural rigidity of the first stay 423 to be biased does not contribute to the torsional rigidity of the retainer 42. Similar to the comparative example of the retainer 42, because the leaf spring 550 does not flex easily in the surface tilt direction of the two lateral plates the rigidity in the surface tilt direction is secured.

According to Embodiment 3, while securing the rigidity in the direction of the surface tilt similar to the retainer of the comparative example, the torsional rigidity relative to the deformation of the retainer 42 in a twisting manner that changes the relative positions of the shaft bearing 36*a* and the shaft bearing 36*b* in the pressing direction can be decreased. The transfer nip pressure can be set relatively high by maintaining the rigidity in the direction of the surface tilt. Reducing the torsional rigidity allows changes in the relative positions of the front-plate shaft bearing 36*a* and the rear-plate shaft bearing 36*b* in the pressing direction so that the retainer 42 can deform to reduce the deviation of the transfer nip pressure. Accordingly, unevenness of the transfer nip pressure can be suppressed.

Figure 18:
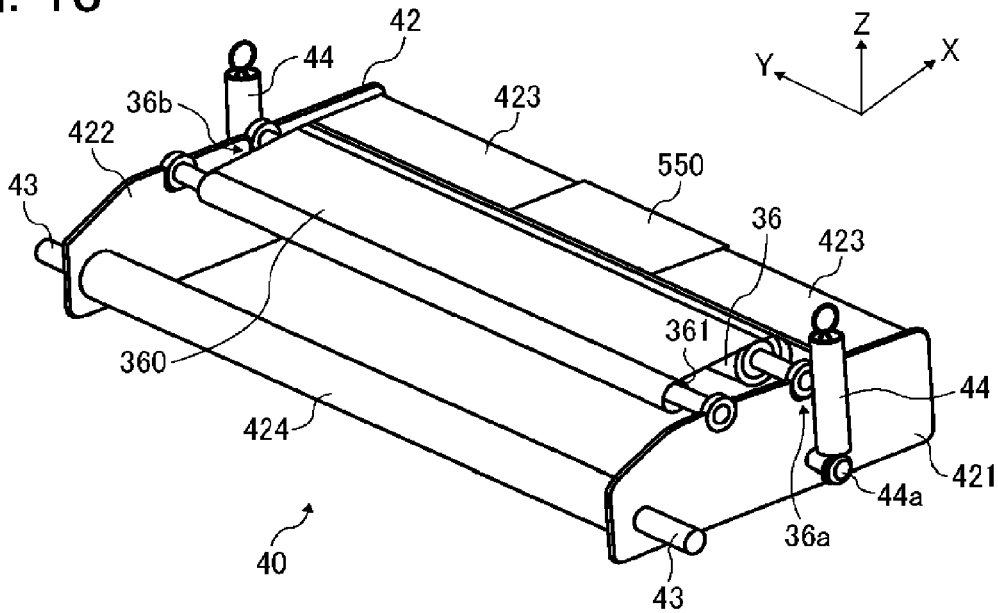
FIG. 18 is a perspective view schematically illustrating the pressing device of Embodiment 3 and a secondary transfer belt.

FIG. 18 is a perspective view schematically illustrating the pressing device 40 of Embodiment 3 and the secondary transfer belt 360. In some embodiments, the retainer 42 of Embodiment 3 is employed in a configuration in which the nip forming roller 36 contacts directly the intermediate transfer belt 31 such as illustrated in FIG. 16. Alternatively, in some embodiments, the retainer 42 of Embodiment 3 is employed in a configuration in which the nip forming roller 36 contacts indirectly the intermediate transfer belt 31 via the secondary transfer belt 360 such as illustrated in FIG. 18.

According to the illustrative embodiments of the present disclosure, the connecting portion of the two lateral plates to which the first stay is connected coincides with a place on which a force in the pressing direction acts when pressure is applied. In Embodiment 3, the place on which the pressure acts is a place (fixed portion) on the two lateral plates (421 and 422) where the first stay 423 is fixed by the screw and through welding. In the pressing device 40 of Embodiment 3, the relative positions of the fixed portions on the two lateral plates to which the first stay 423 is fixed are changeable in the pressing direction. Accordingly, when pressure is applied, the relative positions of the portions of the lateral plates on which the force in the pressing direction acts are changeable.

Embodiment 4

Figure 19:
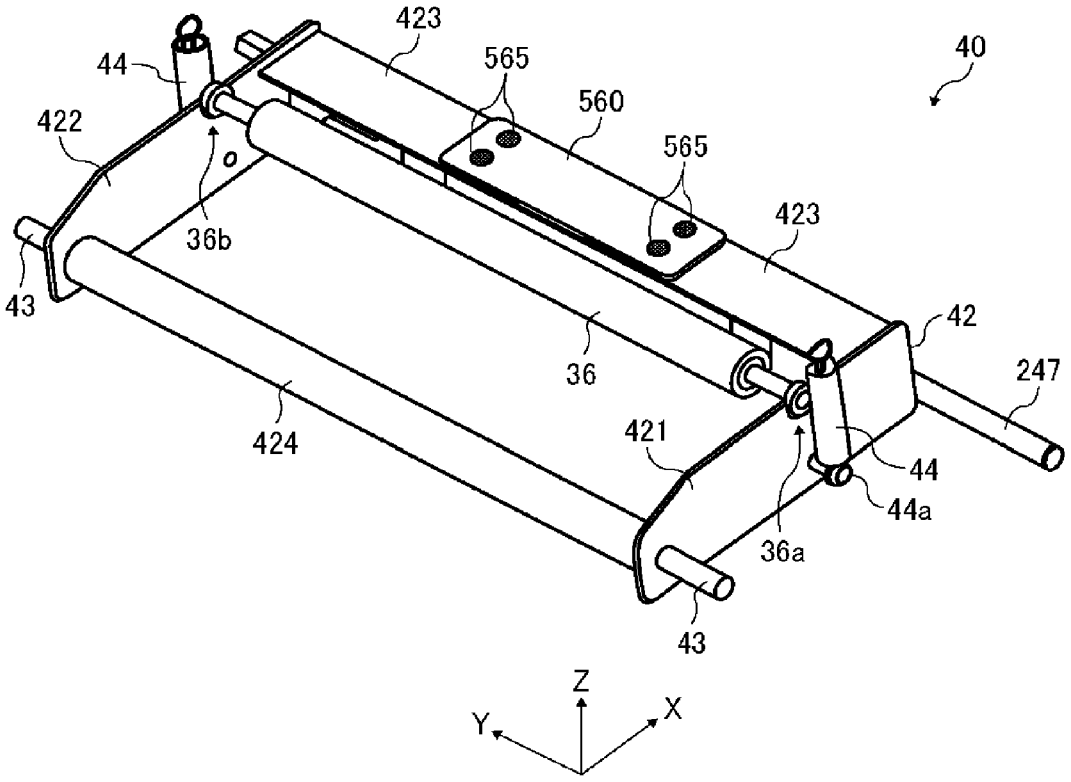
FIG. 19 is a perspective view schematically illustrating the pressing device, according to Embodiment 4.
Figure 20:
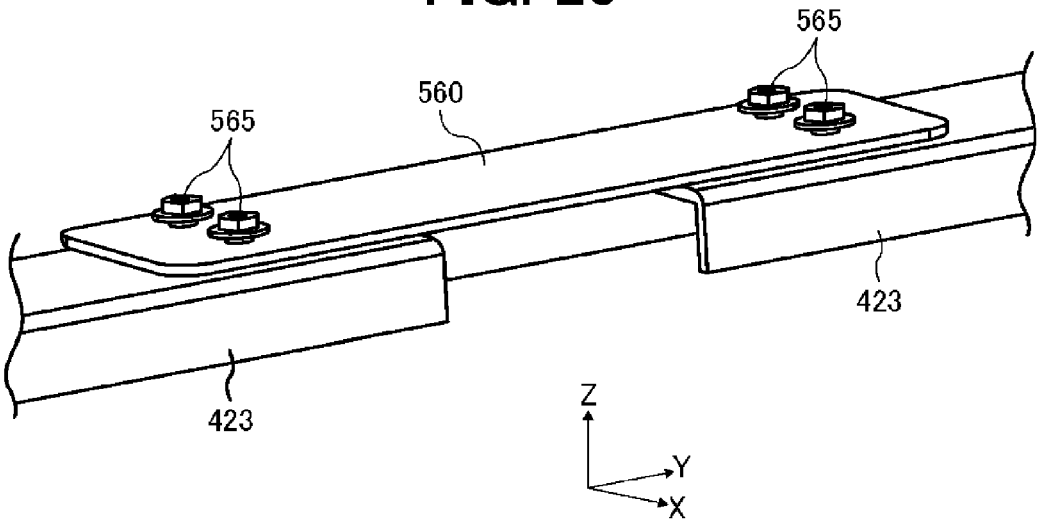
FIG. 20 is an enlarged perspective view schematically illustrating the connecting plate of the retainer of the pressing device according to Embodiment 4.

With reference to FIGS. 19 and 20, a description is provided of the pressing device 40 according to Embodiment 4 of the present disclosure.

The pressing device 40 of Embodiment 4 has the same configuration as the pressing device 40 of Embodiment 3, except for a part to connect the split parts of the first stay 423. Thus, only the difference will be described below.

FIG. 19 is a perspective view schematically illustrating the pressing device 40 according to Embodiment 4. FIG. 20 is a partially enlarged perspective view schematically illustrating the stay 423 split into two and a connecting plate 560 that connects the split parts of the stay 423 according to Embodiment 4.

According to Embodiment 4, two split parts of the first stay 423 are connected by the connecting plate 560, and the connecting plate 560 and the split parts of the first stay 423 are connected by shoulder screws 565 which provide freedom in the vertical direction. According to Embodiment 4, the front lateral plate 421 and the rear lateral plate 422 are fixed to the first stay 423 using a screw and through welding.

Similar to the retainer 42 of Embodiment 1, in Embodiment 4 the pressure stay 249 and the first stay 423 are connected by the connecting hole 423*a*, the projection 249*a*, and the connecting nut 423*b*.

According to Embodiment 4, the connecting plate 560 does not flex easily. By connecting the connecting plate 560 and the first stay 423 by the shoulder screws 565, the relative positions of the connecting plate 560 and the first stay 423 in the vertical direction are changeable. Accordingly, the relative positions of the two split parts of the first stay 423 connected by the connecting plate 560 are changeable in the vertical direction (the Z-axis direction) within a predetermined range. In Embodiment 4, the split parts of the first stay 423 are connected to the two lateral plates by the connecting plate 560 and the shoulder screw 565 such that the two split parts of the upper stay 423 are movable in the pressing direction. With this configuration, an increase in the torsional rigidity relative to the deformation of the retainer 42 in a twisting manner that changes the relative positions of the shaft bearing 36*a* and the shaft bearing 36*b* in the pressing direction, attributed to the first stay 423, is prevented.

According to Embodiment 4, the connecting plate 560 does not flex easily, and connecting the connecting plate 560 and the first stay 423 by the shoulder screws 565 does not allow the relative positions of the connecting plate 560 and the first stay 423 to change in the Y-axis direction. Thus, similar to the comparative example of the retainer 42, the retainer 42 of Embodiment 4 can secure the rigidity in the surface tilt direction.

According to Embodiment 4, while securing the rigidity in the direction of the surface tilt similar to the retainer 42 of the comparative example, the torsional rigidity relative to the deformation of the retainer 42 in a twisting manner that changes the relative positions of the shaft bearing 36*a* and the shaft bearing 36*b* in the pressing direction can be decreased. The transfer nip pressure can be set relatively high by securing the rigidity in the direction of the surface tilt. Reducing the torsional rigidity allows changes in the relative positions of the front-plate shaft bearing 36*a* and the rear-plate shaft bearing 36*b* in the pressing direction so that the retainer 42 can deform to reduce the deviation of the transfer nip pressure. Accordingly, unevenness of the transfer nip pressure is prevented.

Figure 21:
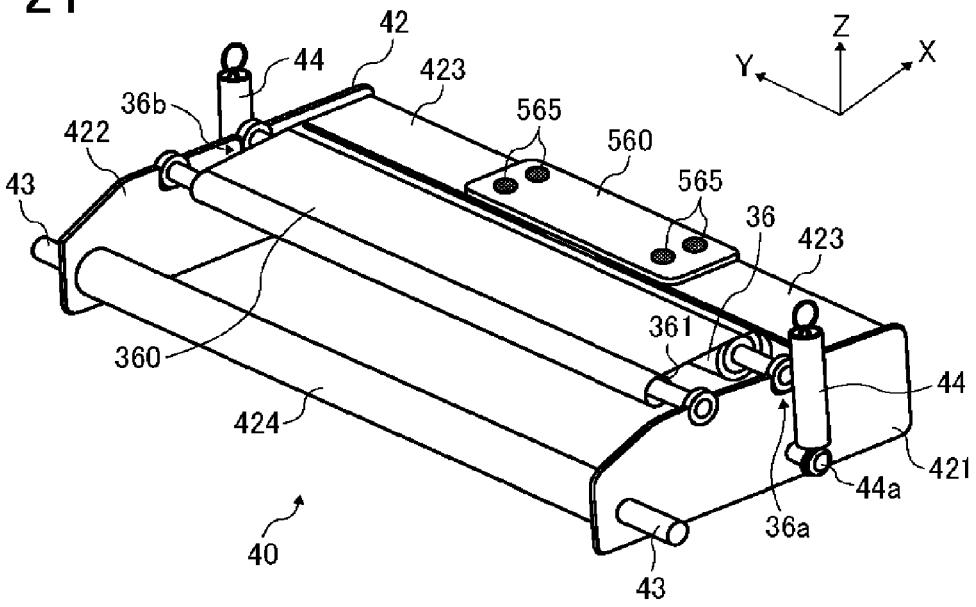
FIG. 21 is a perspective view schematically illustrating the pressing device of Embodiment 4 and the secondary transfer belt.

FIG. 21 is a perspective view schematically illustrating the pressing device 40 of Embodiment 4 and the secondary transfer belt 360. In some embodiments, the retainer 42 of Embodiment 4 is employed in a configuration in which the nip forming roller 36 contacts directly the intermediate transfer belt 31 such as illustrated in FIG. 19. Alternatively, in some embodiments, the retainer 42 of Embodiment 4 is employed in a configuration in which the nip forming roller 36 contacts indirectly the intermediate transfer belt 31 via the secondary transfer belt 360 such as illustrated in FIG. 21.

According to the illustrative embodiments of the present disclosure, the connecting portion of the two lateral plates to which the first stay 423 is connected coincides with the place of the lateral plates on which a force in the pressing direction acts when pressure is applied. In Embodiment 4, the place on the lateral plates (421 and 422) on which the pressure acts is a place at which the first stay 423 is fixed by the screw and through welding. In the pressing device 40 of Embodiment 4, the relative positions of the fixed portions of the two lateral plates to which the first stay 423 is fixed are changeable in the pressing direction. Accordingly, when pressure is applied, the relative positions of the portions of the lateral plates on which the force in the pressing direction acts are changeable.

Embodiment 5

With reference to FIGS. 24 through 27, a description is provided of the pressing device 40 according to Embodiment 5 of the present disclosure.

The pressing device 40 of Embodiment 5 has the same configuration as the pressing device 40 of Embodiment 1, except for the structure at the rotary shaft side. Thus, only the difference will be described below.

Figure 24:
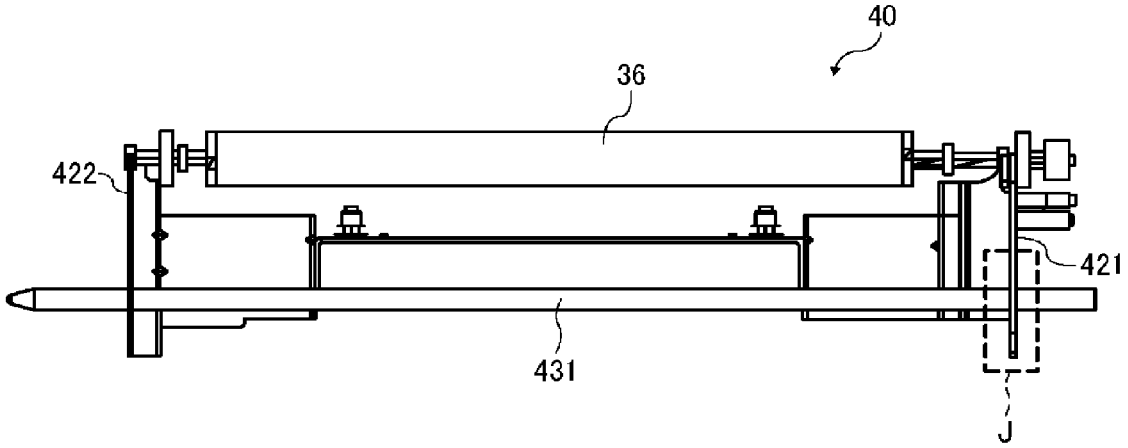
FIG. 24 is a front view schematically illustrating the pressing device, according to Embodiment 5.
Figure 25:
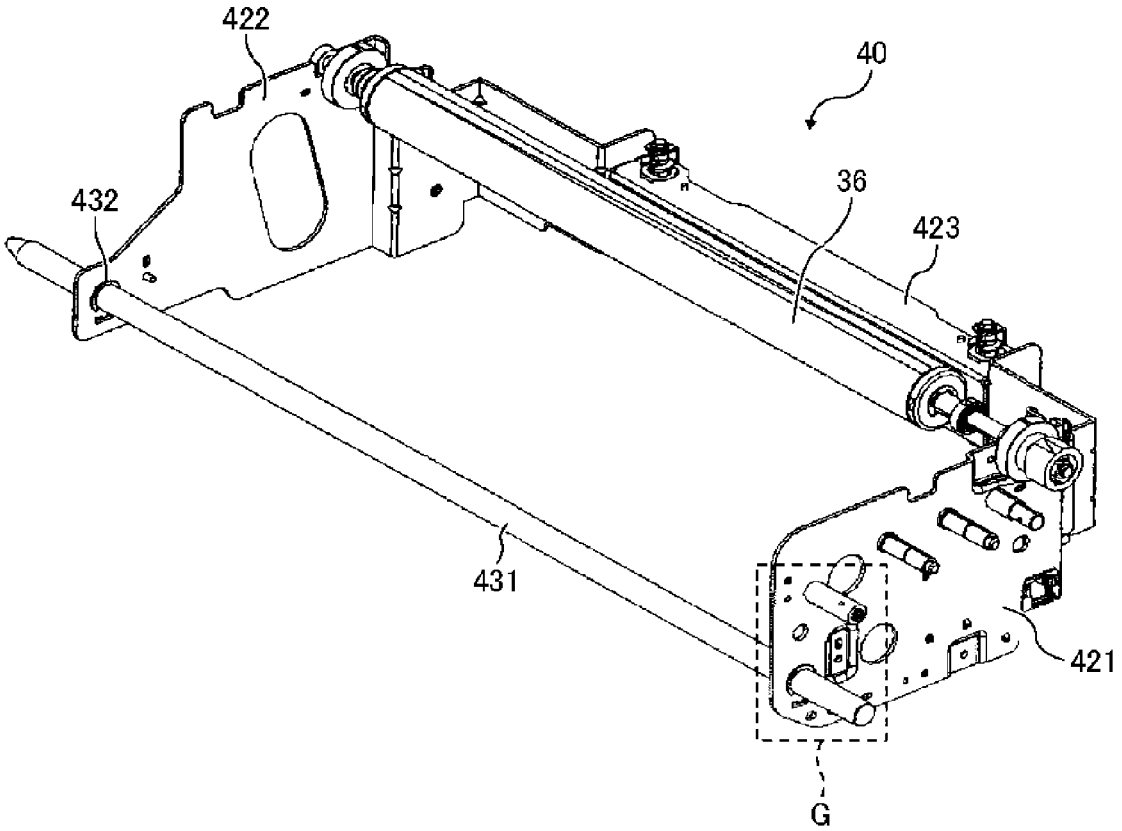
FIG. 25 is a perspective view schematically illustrating the pressing device, according to Embodiment 5.
Figure 26:
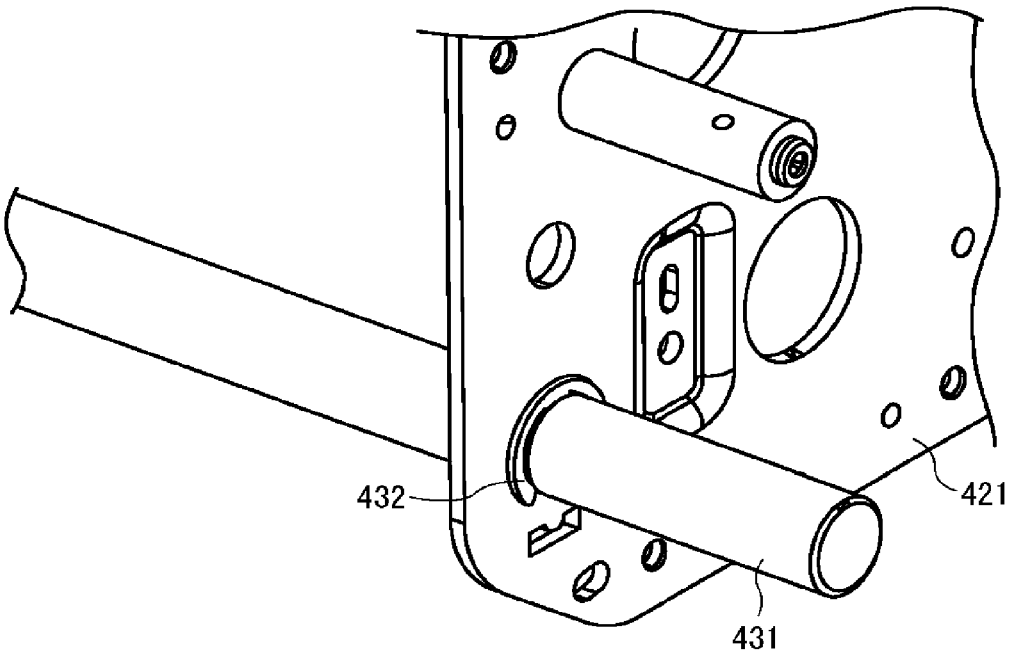
FIG. 26 is a partially enlarged diagram schematically illustrating a portion of the pressing device indicated by a dotted square G in FIG. 25.
Figure 27:
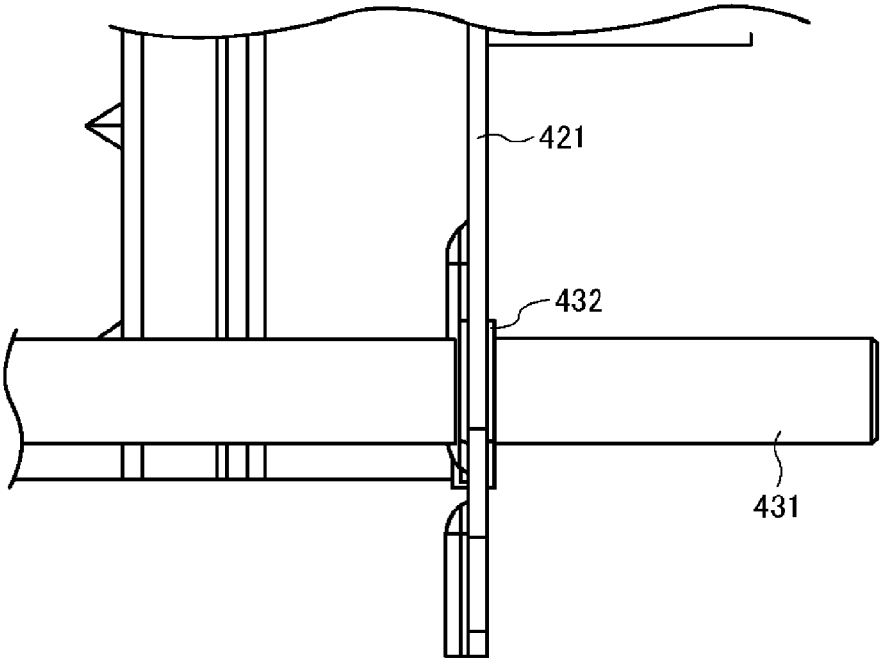
FIG. 27 is a partially enlarged diagram schematically illustrating a portion of the pressing device indicated by a dotted square J in FIG. 24.

FIG. 24 is a front view of the pressing device 40 of Embodiment 5. FIG. 25 is a perspective view schematically illustrating the pressing device 40 of Embodiment 5. FIG. 26 is a partially enlarged diagram schematically illustrating a portion of the pressing device 40 indicated by a dotted square G in FIG. 25. FIG. 27 is a partially enlarged diagram schematically illustrating a portion of the pressing device indicated by a dotted square J in FIG. 24.

According to the present illustrative embodiment, a rotary shaft 431 penetrates through the front lateral plate 421 and the rear lateral plate 422. The front lateral plate 421 and the rear lateral plate 422 are rotatably supported by an E-ring 432 relative to the rotary shaft 431. More specifically, the E-ring 432 is fitted to an annular groove formed near both ends of the rotary shaft 431 in the axial direction and is fitted also to through-holes in the front lateral plate 421 and the rear lateral plate 422 through which the rotary shaft 431 penetrates. According to the present illustrative embodiment, the front lateral plate 421 and the rear lateral plate 422 are rotatably supported by the rotary shaft 431, and the movement of the front lateral plate 421 and the rear lateral plate 422 in the longitudinal direction is regulated by the E-ring 432 via the rotary shaft 431. In Embodiment 5, a pair of E-rings 432 functions as an adjuster.

Embodiment 6

Figure 28:
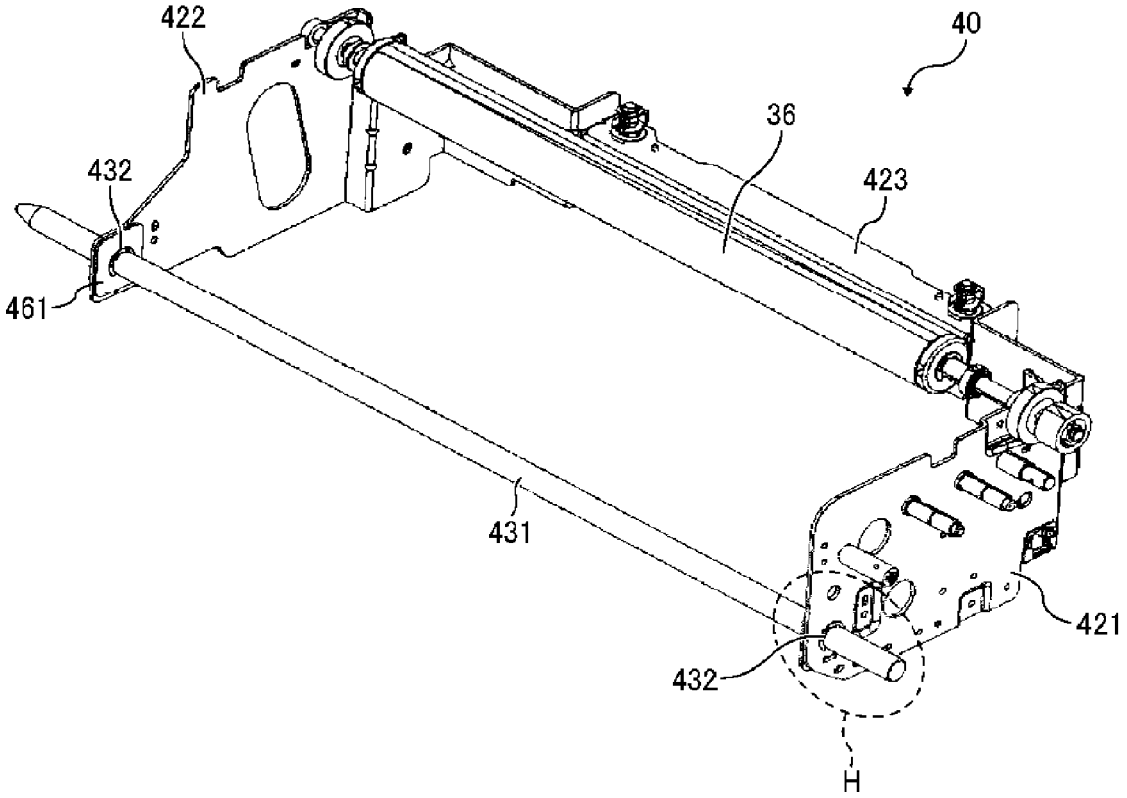
FIG. 28 is a perspective view schematically illustrating the pressing device, according to Embodiment 6.
Figure 29:
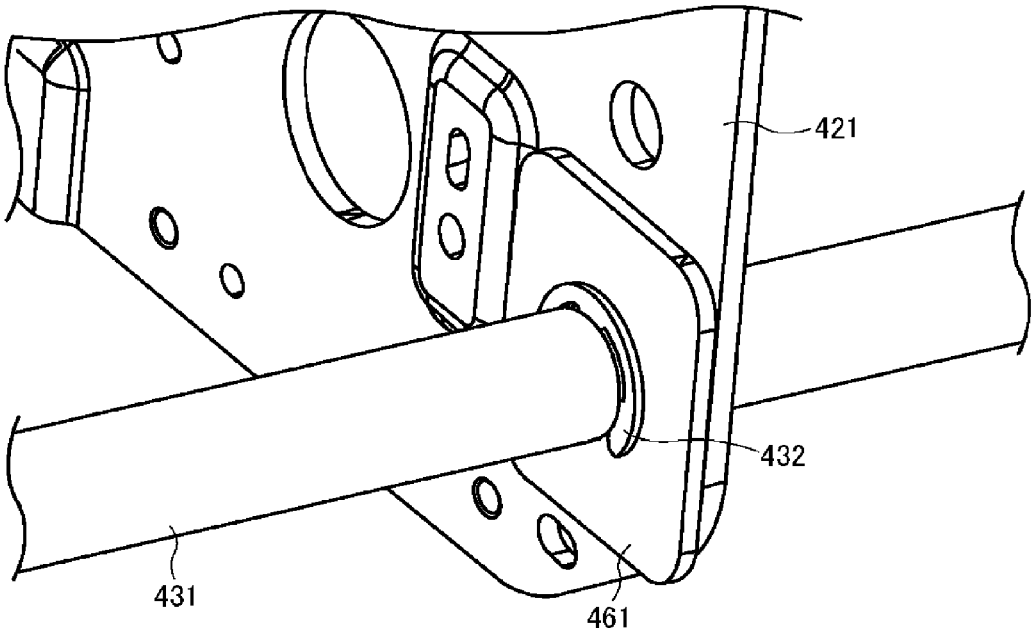
FIG. 29 is a partially enlarged diagram schematically illustrating a portion of the pressing device indicated by a dotted circle H in FIG. 28.
Figure 30:
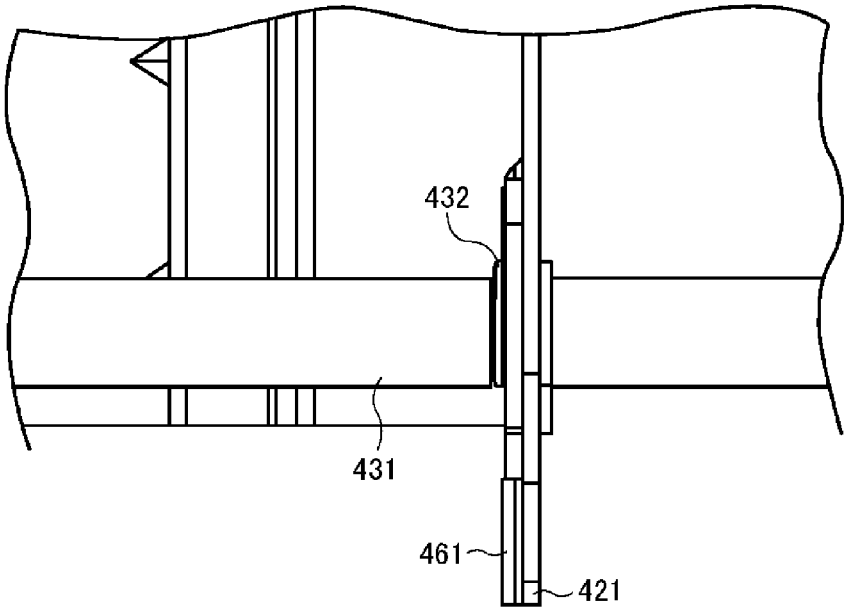
FIG. 30 is a partially enlarged front view schematically illustrating the portion of the pressing device indicated by the dotted circle H in FIG. 28.

With reference to FIGS. 28 through 30, a description is provided of the pressing device 40 according to Embodiment 6 of the present disclosure.

The pressing device 40 of Embodiment 6 has the same configuration as the pressing device 40 of Embodiment 5, except for a tilt stopper 461 as an opposing member. Thus, only the difference will be described below.

FIG. 28 is a perspective view schematically illustrating the pressing device 40 according to Embodiment 6. FIG. 29 is a partially enlarged diagram schematically illustrating a portion of the pressing device 40 indicated by a dotted circle H in FIG. 28. FIG. 30 is a partially enlarged front view of the pressing device 40 indicated by the dotted circle H in FIG. 28.

The tilt stopper 461 is fitted to an outer circumferential surface of each of the E-rings 432 and contacts the inner surface of the front lateral plate 421 and the rear lateral plate 422. The portion of the front lateral plate 421 and the rear lateral plate 422 facing the tilt stopper 461 is prevented from moving in the longitudinal direction by the tilt stopper 461. Accordingly, the front lateral plate 421 and the rear lateral plate 422 at the rotary shaft side are prevented from moving in the longitudinal direction in a wide range. As compared with Embodiment 5, the surface tilt of the front lateral plate 421 and the rear lateral plate 422 at the rotary shaft side is prevented more reliably.

Alternatively, in some embodiments, the tilt stopper 461 is disposed to contact the outer surface of the front lateral plate 421 and the rear lateral plate 422, thereby preventing the front lateral plate 421 and the rear lateral plate 422 at the rotary shaft side from tilting outward.

Figure 31:
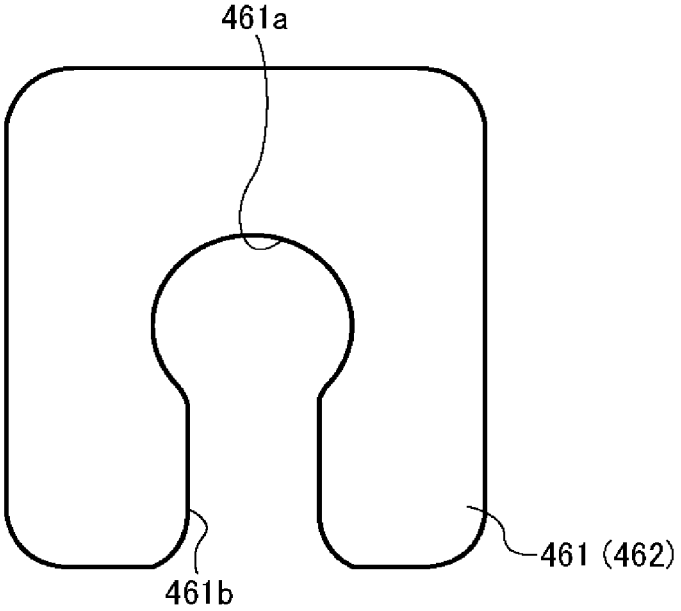
FIG. 31 is a schematic diagram illustrating a variation of a tilt stopper.

As illustrated in FIGS. 28 through 30, the tilt stopper 461 has a fitting hole in the center to which the E-ring 432 is fitted. Alternatively, as illustrated in FIG. 31, the tilt stopper 461 may include a slot 461*b* communicated with a fitting hole 461*a*. In FIGS. 28 through 30, the tilt stopper 461 is fitted to the rotary shaft 431, and then the rotary shaft 431 is inserted through through-holes in the front lateral plate 421 and the rear lateral plate 422. After the E-ring 432 is fitted to the groove on the rotary shaft 431 and to the through-holes in the front lateral plate 421 and the rear lateral plate 422, the tilt stopper 461 is fitted to the E-ring 432 by sliding the tilt stopper 461 in the axial direction.

As described above, the tilt stopper 461 shown in FIGS. 28 through 30 needs to be fitted to the rotary shaft 431 first. By contrast, in the example shown in FIG. 31 when the tilt stopper 461 is fitted to the E-ring 432, the rotary shaft 431 supported by the front lateral plate 421 and the rear lateral plate 422 is inserted to the fitting hole 461*a* via the slot 461*b* of the tilt stopper 461. The tilt stopper 461 is fitted to the E-ring 432 by sliding the tilt stopper 461 in the axial direction. With this configuration, the rotary shaft 431 does not need to be inserted to the fitting hole 461*a* of the tilt stopper 461 in advance. Thus, the tilt stopper 461 does not interfere with operation when the rotary shaft 431 is supported by the front lateral plate 421 and the rear lateral plate 422.

Alternatively, in some embodiment, the tilt stopper 461 is fixed to the front lateral plate 421 and the rear lateral plate 422 by a screw or the like, thereby reinforcing the front lateral plate 421 and the rear lateral plate 422 by the tilt stopper 461.

According to Embodiments 1 through 4 as described above, the first stay 423 is connected to the front lateral plate 421 and the rear lateral plate 422 such that relative positions of the connecting portions of the front lateral plate 421 and the rear lateral plate 422 to which the first stay 423 is connected are changeable. Alternatively, in some embodiments, the second stay 424 is connected to the front lateral plate 421 and the rear lateral plate 422 such that relative positions of the connecting portions of the front lateral plate 421 and the rear lateral plate 422 to which the stay 423 is connected are changeable. With this configuration, the relative positions of the second stay 424 relative to the front lateral plate 421 and the rear lateral plate 422 can be changed more easily as compared with a configuration in which the connecting portions of the second stay 424 are fixed relative to the front lateral plate 421 and the rear lateral plate 422. Accordingly, the deviation of the transfer nip pressure can be reduced, and the retainer can deform more easily.

According to Embodiments 1 through 4, the rotary shaft 43, a different part from the second stay 424, prevents changes in the relative positions of the shaft bearing 43*a* of the front lateral plate 421 and the shaft bearing 43*a* of the rear lateral plate 422. Thus, according to Embodiments 1 through 4, the first stay 423 serves as the adjuster that allows changes in the relative positions of the connecting portions of the front lateral plate 421 and the rear lateral plate 422 to which the first stay 423 is connected so that the retainer 42 is deformed more easily as compared with a configuration in which the second stay 424 serves as the adjuster that allows changes in the relative positions of the connecting portions of the front lateral plate 421 and the rear lateral plate 422 to which the second stay 423 is connected. As the retainer 42 deforms easily, the deviation of the transfer nip pressure can be reduced easily.

In Embodiments 5 and 6, the pair of E-rings 432 can serve as the adjuster that allows changes in the relative positions of the connecting portions of the two lateral plates. In this case, the through-holes in the front lateral plate 421 and the rear lateral plate 422 through which the rotary shaft 431 penetrates extend in the direction of pressure, thereby making the through-holes elongate. The E-rings 432 are fitted to the elongated hole. With this configuration, the E-rings 432 can move in the elongated holes, thereby changing the relative positions of the connecting portions (the through-holes through which the rotary shaft of the front lateral plate 421 and the rear lateral plate 422 penetrates) of the E-rings 432 relative to the front lateral plate 421 and the rear lateral plate 422.

Alternatively, the number of adjusters that regulate movement of the front lateral plate 421 and the rear lateral plate 422 in the longitudinal direction is three or more. In this case, a plurality of adjusters that allows changes in the relative positions of the connecting portions thereof relative to the two lateral plates may be provided.

The present disclosure is applied to a transfer device using an intermediate transfer method in which a toner image is transferred from an intermediate transfer belt onto a recording medium. The present disclosure can be also applied to a transfer device using a direct transfer method in which the toner image is transferred directly onto the recording medium from the photoconductor.

Although the embodiments of the present disclosure have been described above, the present invention is not limited to the foregoing embodiments, but a variety of modifications can be made within the scope of the present invention.

[Aspect A]

In Aspect A, a pressing device such as the pressing device 40 includes a pressing member such as the nip forming roller 36 to contact a target such as the intermediate transfer belt 31; a pair of lateral plates such as the front lateral plate 421 and the rear lateral plate 422 to support both ends of the pressing member in a longitudinal direction of the pressing member; a plurality of adjusters (e.g., the second stay 424 and the first stay 423), each of which connected to each lateral plate, to regulate relative movement of the pair of lateral plates in the longitudinal direction; and a biasing member such as the tension spring 44 and the compression spring 45 to bias at least one of the pair of the lateral plates and the plurality of adjusters to press the pressing member against the target. The plurality of adjusters includes an adjuster such as the first stay 423 including connecting portions connected to the pair of lateral plates, one of the connecting portions movably connected to one of the pair of lateral plates such that relative positions of the one of the connecting portions connected to the one of the pair of lateral plates in a pressing direction are changeable.

With this configuration, as described above, the plurality of adjusters regulates the relative movement of the two lateral plates in the longitudinal direction, hence preventing the two lateral plates from getting folded inward or tilting inward in the longitudinal direction. Because the two lateral plates are prevented from tilting inward, the force such as the transfer pressure acting on the contact portion can be set relatively high. The relative positions of the connecting portion (the upper end of the elongated hole 451 of the front lateral plate 421) of one of the lateral plates connected to the adjuster are changeable in the pressing direction relative to the connecting portion (the upper end of the elongated hole 451 of the rear lateral plate 422) of the other lateral plate. This configuration allows deformation of the pressing mechanism to change relative positions of the two lateral plates in the pressing direction. When the tilted pressing member contacts the target due to parts variations of the pressing mechanism, the pressing member at one side in the axial direction starts to contact the target. When the one side of the pressing member starts to contact, the portion of pressing member contacting the target receives a reaction force. At this time, the lateral plate that started to contact the pressing member Reducing the tilt can prevent the pressure such as the nip pressure at a nip portion, i.e., the transfer nip from varying. In Aspect A, it is possible to set the pressure of the pressing device against the target to be relatively large while preventing the pressure at the transfer nip or the like from varying.

[Aspect B]

According to Aspect A, at least one of the plurality of adjusters includes a reinforcing member (the opposing surfaces of the first stay 423 and the second stay 424 facing the front lateral plate 421 and the rear lateral plate 422 in the axial direction) to reinforce the pair of lateral plates.

With this configuration, each lateral plate is reinforced by the reinforcing member, hence preventing reliably the inward tilt.

[Aspect C]

According to Aspect A or Aspect B, the pressing device further includes a rotary shaft (the rotary shaft 431) to rotatably support the pair of lateral plates, and one of the plurality of adjusters except the adjuster regulates movement of the pair of lateral plates on the rotary shaft 431 in a longitudinal direction.

With this configuration, as described in Embodiments 5 and 6, movement of the two lateral plates in the longitudinal direction is regulated using the rotary shaft 431.

[Aspect D]

According to Aspect C, the adjuster such as the E-ring 432 that regulates movement of the pair of lateral plates on the rotary shaft in the longitudinal direction includes an opposing member such as 461 disposed opposite to the lateral plates.

With this configuration, as described in Embodiment 6, the opposing member regulates movement of the two lateral plates in the longitudinal direction having the wide area, hence reliably preventing the inward tilt.

[Aspect E]

According to any one of Aspects A through D, the adjuster such as the first stay 423 includes a plurality of subcomponents, and relative positions of the plurality of subcomponents are changeable in the pressing direction.

With this configuration, as described in Embodiments 2 through 4, the relative positions of the plurality of subcomponents constituting the adjuster in the pressing direction are changeable in the pressing direction, which allows changes in the relative positions of the connecting portion in the pressing direction at which the adjuster and the lateral plate are connected. Accordingly, the relative positions of the connecting portion of one of the lateral plates such as the front lateral plate 421 and the rear lateral plate 422 connected to the adjuster are changeable in the pressing direction relative to the connecting portion of the other one of the lateral plates.

[Aspect F]

According to Aspect E, the plurality of the subcomponents of the adjuster includes a first member connected to one of the pair of lateral plates, a second member connected to the other one of the pair of lateral plates, and a connector such as the leaf spring 550 and the connecting plate 560 disposed between the first member and the second member to connect the first member and the second member. The relative positions of a first connecting portion of the first member connected to the connector are changeable in the pressing direction relative to a second connecting portion of the second member connected to the connector.

With this configuration, as described in Embodiments 3 and 4, the relative positions of the plurality of subcomponents constituting the adjuster are changeable in the pressing direction, which allows changes in the relative positions of the plurality of subcomponents of the adjuster in the pressing direction.

[Aspect G]

According to Aspect E, the connector is a leaf spring such as the leaf spring 550 that flexes more easily in the pressing direction than in the longitudinal direction.

With this configuration, as described in Embodiment 3, when the leaf spring flexes in the pressing direction, the relative positions of the plurality of subcomponents constituting the adjuster connected to the leaf spring can change in the pressing direction. The relative positions of the first connecting portion of the first member connected to the connector can be changed in the pressing direction relative to the second connecting portion of the second member connected to the connector.

[Aspect H]

According to Aspect E, the connector is a planar member such as the connecting plate 560 that does not flex easily, and the first connecting portion of the first member is fastened to the connector by a shoulder screw such as a shoulder screw 565, thereby allowing changes in the relative positions of the first connecting portion in the pressing direction relative to the second connecting portion.

With this configuration, as described in Embodiment 4, when the relative positions of the planar member and the first member change in the pressing direction at the connecting portion using the shoulder screw, the relative positions of the connecting portion at which the planar member and the second member are connected can change in the pressing direction. The relative positions of the first connecting portion of the first member connected to the connector can be changed in the pressing direction relative to the second connecting portion of the second member connected to the connector.

[Aspect I]

According to any one of Aspects A through H, the pair of lateral plates such as the front lateral plate 421 and the rear lateral plate 422 includes an elongated hole such as the elongated hole 451 extending in the pressing direction, and the adjuster such as the first stay 423 is connected to the pair of lateral plates by a shoulder screw such as the shoulder screw 450 fitted to the elongated hole.

With this configuration, as described in Embodiment 1, the shoulder screw can move in the elongated hole in the pressing direction, which allows changes in the relative positions of the adjuster relative to the two lateral plates in the pressing direction. The relative positions of the adjuster are changeable in the pressing direction relative to the two lateral plates, which allows changes in the relative positions of the connecting portion in the pressing direction at which the adjuster and the lateral plates are connected. Accordingly, the relative positions of the connecting portion of one of the lateral plates connected to the first stay connected to the connector can be changed in the pressing direction relative to the connecting portion of the other lateral plate connected to the first stay.

[Aspect J]

According to any one of Aspects A through I, the biasing member such as the compression spring 45 biases at least one of the plurality of adjusters such as second stay 424 and the first stay 423.

With this configuration, as described in Embodiment 1, the pressing mechanism of the retainer 42 or the like is biased so that the pressing member such as the nip forming roller 36 is pressed against the target such as the intermediate transfer belt 31.

[Aspect K]

According to Aspect J, as the biasing member biases at least one of the plurality of adjusters such as the first stay 423, as described in the illustrative embodiments, separate parts such as the rotary shaft 43 do not interfere with changes in the relative positions of the connecting portions of the two lateral plates such as the front lateral plate 421 and the rear lateral plate 422 connected to the adjuster. With this configuration, the pressing mechanism such as the retainer 42 can deform easily, thereby preventing easily the transfer nip pressure at the contact area such as the transfer nip from varying.

[Aspect L]

According to Aspect J, the biasing member biases at least one of the plurality of adjusters except the adjuster.

With this configuration, as described above, the relative positions of the two lateral plates in the pressing direction can be changed more easily than a configuration in which the connecting portion of the adjusters connected to the two lateral plates is fixed and the adjusters are not biased. With this configuration, the pressing mechanism such as the retainer 42 can deform easily, thereby preventing easily the transfer nip pressure at the contact area such as the transfer nip from varying.

[Aspect M]

A transfer device includes a nip forming member such as the nip forming roller 36 disposed opposite to an image bearer that travels in a traveling direction and the pressing device of any one of Aspects A through L to press the nip forming member as the pressing member against the image bearer as the target. The nip forming member contacts an entire surface of the image bearer in a width direction perpendicular to the traveling direction to form a transfer nip.

With this configuration, as described above, the transfer nip pressure at the transfer nip is prevented from varying.

[Aspect N]

According to Aspect M, the transfer device includes a transfer conveyor belt such as the secondary transfer belt 360 formed an endless loop traveling in a certain direction. The nip forming member is disposed inside loop formed by the transfer conveyor belt and contacts the image bearer such as the intermediate transfer belt 31 via the transfer conveyor belt.

In the configuration in which the transfer conveyor belt contacts the image bearer as described above, the transfer nip pressure at the transfer nip is prevented from varying.

[Aspect O]

An image forming apparatus such as the image forming apparatus 500 includes an image bearer such as the intermediate transfer belt 31 on which a toner image is formed and the transfer device such as the transfer unit 30 of any one of Aspects M or N to transfer the toner image from the image bearer onto a recording medium.

With this configuration, as described above, the transfer nip pressure at the transfer nip is prevented from varying, hence preventing uneven image density.

[Aspect P]

According to Aspect O, the image bearer is an intermediate transfer member such as the intermediate transfer belt 31.

With this configuration, as described above, the transfer nip pressure at the transfer nip is prevented from varying, hence preventing uneven image density.

[Aspect Q]

The image forming apparatus includes an image bearer such as the intermediate transfer belt 31, a transfer member such as the nip forming roller 36, a first frame such as the front lateral plate 421 and a second frame such as the rear lateral plate 422 to support both ends of the transfer member, a spring such as the tension spring 44 and the compression spring 45 to press the transfer member against the image bearer, and a stay such as the first stay 423 to connect the first frame and the second frame by fitting a pin such as the shoulder screw 450 into the elongated hole 451 extending in the pressing direction of the spring.

[Aspect R]

The image forming apparatus includes an image bearer such as the intermediate transfer belt 31, a transfer member such as the nip forming roller 36, a first frame such as the front lateral plate 421 and a second frame such as the rear lateral plate 422 to support both ends of the transfer member, a spring such as the tension spring 44 and the compression spring 45 to press the transfer member against the image bearer, and a stay such as the first stay 423 to connect the first frame and the second frame via the leaf spring 550 capable of deforming in the pressing direction of the spring.

[Aspect S]

The image forming apparatus includes an image bearer such as the intermediate transfer belt 31, a transfer member such as the nip forming roller 36, a first frame such as the front lateral plate 421 and a second frame such as the rear lateral plate 422 to support both ends of the transfer member, a spring such as the tension spring 44 and the compression spring 45 to press the transfer member against the image bearer, and a stay such as the first stay 423 to connect the first frame and the second frame via the connecting plate 560 capable of moving in the pressing direction of the spring relative to the shoulder screw such as the shoulder screw 565.

[Aspect T]

The image forming apparatus according to any one of Aspects Q through S includes a second stay such as the second stay 424 to connect the first frame such as the front lateral plate 421 and the second frame such as the rear lateral plate 422.

[Aspect U]

The image forming apparatus according to any one of Aspects Q through T includes a rotary shaft such as the rotary shaft 43 that rotatably supports the first frame such as the front lateral plate 421 and the second frame such as the rear lateral plate 422.

[Aspect V]

In the image forming apparatus according to any one of Aspect Q through U, the spring such as the tension spring 44 contacts the first frame such as the front lateral plate 421 and the second frame such as the rear lateral plate 422 so as to press the transfer member such as the nip forming roller 36 against the image bearer such as the intermediate transfer belt 31.

[Aspect W]

In the image forming apparatus according to any one of Aspect Q through U, the spring such as the compression spring 45 contacts the stay such as the first stay 423 so as to press the transfer member such as the nip forming roller 36 against the image bearer such as the intermediate transfer belt 31.

[Aspect A']

A pressing device includes a pressing member, a first lateral plate, a second lateral plate, a first adjuster, and a biasing member. The pressing member includes a first end and a second end opposite to the first end in a longitudinal direction of the pressing member, to contact a target. The first lateral plate includes a first connecting portion, to support the first end of the pressing member. The second lateral plate includes a second connecting portion, to support the second end of the pressing member. The first adjuster is connected to the first lateral plate at the first connecting portion and to the second lateral plate at the second connecting portion to regulate relative movement of the first lateral plate and the second lateral plate in the longitudinal direction. The biasing member to bias at least one of the first lateral plate, the second lateral plate, and the first adjuster to press the pressing member against the target in a pressing direction. The first adjuster is connected to the first lateral plate and the second lateral plate such that a relative position of the second connecting portion relative to the first connecting portion is changeable in the pressing direction.

[Aspect B']

According to Aspect I', the first adjuster includes a reinforcing member to reinforce the first lateral plate and the second lateral plate.

[Aspect C']

The pressing device according to Aspect A' includes a rotary shaft and a second adjuster. The rotary shaft rotatably supports the first lateral plate and the second lateral plate. The second adjuster connects the first lateral plate and the second lateral plate to the rotary shaft to restrict movement of the first lateral plate and the second lateral in the longitudinal direction.

[Aspect D']

According to Aspect C', the second adjuster includes an opposing member disposed facing the first lateral plate and the second lateral plate.

[Aspect E']

According to Aspect A', the first adjuster includes a plurality of subcomponents, and relative positions of the plurality of subcomponents are changeable in the pressing direction.

[Aspect F']

According to Aspect E', the plurality of the subcomponents of the adjuster includes a first member connected to the first lateral plate, a second member connected to the second lateral plate, and a connector to connect the first member and the second member. The first member includes a third connecting portion connected to the connector, the second member includes a fourth connecting portion connected to the connector, and a relative position of the third connecting portion is changeable relative to the fourth connecting portion in the pressing direction.

[Aspect G']

According to Aspect F', the connector is a leaf spring that flexes more easily in the pressing direction than in the longitudinal direction.

[Aspect H']

According to Aspect F', wherein the connecter is a planar member that does not flex easily, and at least the third connecting portion of the first member is connected to the connector by a shoulder screw.

[Aspect I']

According to Aspect A', the first adjuster includes a shoulder screw, the first lateral plate and the second lateral plate include an elongated hole extending in the pressing direction, and the first adjuster is connected to the first lateral plate and the second lateral plate by fitting the shoulder screw in the elongated hole.

[Aspect J']

According to Aspect A', the biasing member biases the first adjuster.

[Aspect K']

According to Aspect A' the biasing member biases the first lateral plate and the second lateral plate.

[Aspect L']

A transfer device includes a nip forming member and the pressing device of Aspect A'. The nip forming member is disposed opposite to an image bearer that travels in a first direction, the nip forming member contacting an entire surface of the image bearer in a width direction perpendicular to the first direction to form a transfer nip. The pressing device of Aspect A' presses the nip forming member as the pressing member against the image bearer as the target.

[Aspect M']

According to Aspect L', the transfer device further includes a transfer conveyor belt. The transfer conveyor belt is formed an endless loop and travels in a certain direction. The nip forming member is disposed inside loop formed by the transfer conveyor belt and contacts the image bearer via the transfer conveyor belt.

[Aspect N']

An image forming apparatus includes an image bearer and the transfer device of Aspect L'. A toner image is formed on the image bearer. The transfer device of Aspect L' transfers the toner image from the image bearer onto a recording medium.

[Aspect O']

According to Aspect N', the image bearer is an intermediate transfer member.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A pressing device, comprising:

a pressing member including a first end and a second end opposite to the first end in a longitudinal direction of the pressing member, to contact a target;

a first lateral plate including a first connecting portion, to support the first end of the pressing member;

a second lateral plate including a second connecting portion, to support the second end of the pressing member;

a first adjuster connected to the first lateral plate at the first connecting portion and to the second lateral plate at the second connecting portion to regulate relative movement of the first lateral plate and the second lateral plate in the longitudinal direction; and a biasing member to bias the first adjuster to press the pressing member against the target in a pressing direction, wherein the first adjuster is connected to the first lateral plate and the second lateral plate such that a relative position of the second connecting portion relative to the first connecting portion is changeable in the pressing direction, the first adjuster is connected to the first lateral plate and the second lateral plate by corresponding elongated holes extending in the pressing direction and corresponding fastening members inserted into the corresponding elongated holes, and a biasing force of the biasing member is transmitted from the first adjuster to the first lateral plate and to the second lateral plate via the corresponding fastening members.

2. The pressing device according to claim 1, wherein the first adjuster includes a reinforcing member to reinforce the first lateral plate and the second lateral plate.

3. A pressing device, comprising:

a pressing member including a first end and a second end opposite to the first end in a longitudinal direction of the pressing member, to contact a target;

a first lateral plate including a first connecting portion, to support the first end of the pressing member;

a second lateral plate including a second connecting portion, to support the second end of the pressing member;

a first adjuster connected to the first lateral plate at the first connecting portion and to the second lateral plate at the second connecting portion to regulate relative movement of the first lateral plate and the second lateral plate in the longitudinal direction; and a biasing member to bias at least one of the first lateral plate, the second lateral plate, and the first adjuster, to press the pressing member against the target in a pressing direction, the first adjuster being connected to the first lateral plate and the second lateral plate such that a relative position of the second connecting portion relative to the first connecting portion is changeable in the pressing direction, wherein the pressing device further comprises:

a rotary shaft to rotatably support the first lateral plate and the second lateral plate; and a second adjuster to connect the first lateral plate and the second lateral plate to the rotary shaft to restrict movement of the first lateral plate and the second lateral in the longitudinal direction.

4. The pressing device according to claim 3, wherein the second adjuster includes an opposing member disposed facing each of the first lateral plate and the second lateral plate.

5. A pressing device, comprising:

a pressing member including a first end and a second end opposite to the first end in a longitudinal direction of the pressing member, to contact a target;

a first lateral plate including a first connecting portion, to support the first end of the pressing member;

a second lateral plate including a second connecting portion, to support the second end of the pressing member;

a first adjuster connected to the first lateral plate at the first connecting portion and to the second lateral plate at the second connecting portion to regulate relative movement of the first lateral plate and the second lateral plate in the longitudinal direction; and a biasing member to bias at least one of the first lateral plate, the second lateral plate, and the first adjuster, to press the pressing member against the target in a pressing direction, the first adjuster being connected to the first lateral plate and the second lateral plate such that a relative position of the second connecting portion relative to the first connecting portion is changeable in the pressing direction, wherein the first adjuster includes a plurality of subcomponents, and relative positions of the plurality of subcomponents are changeable in the pressing direction, wherein the plurality of the subcomponents of the first adjuster includes a first member connected to the first lateral plate, a second member connected to the second lateral plate, and a connector to connect the first member and the second member, and wherein the first member includes a third connecting portion connected to the connector, the second member includes a fourth connecting portion connected to the connector, and a relative position of the third connecting portion is changeable relative to the fourth connecting portion in the pressing direction.

6. The pressing device according to claim 5, wherein the connector is a leaf spring that flexes more easily in the pressing direction than in the longitudinal direction.

7. The pressing device according to claim 5, wherein the connecter is a planar member that does not flex easily, and at least the third connecting portion of the first member is connected to the connector by a shoulder screw.

8. The pressing device according to claim 1, wherein each fastening member includes a shoulder screw, the first adjuster includes the shoulder screws, the first lateral plate and the second lateral plate include the corresponding elongated holes, and the first adjuster is connected to the first lateral plate and the second lateral plate with the shoulder screws fitted in the corresponding elongated holes.

9. The pressing device according to claim 3, wherein the biasing member biases the first adjuster.

10. The pressing device according to claim 3, wherein the biasing member biases the first lateral plate and the second lateral plate.

11. A transfer device, comprising:

a nip forming member disposed opposite to an image bearer that travels in a first direction, the nip forming member contacting an entire surface of the image bearer in a width direction perpendicular to the first direction to form a transfer nip, and the pressing device of claim 1 to press the nip forming member as the pressing member against the image bearer as the target.

12. The transfer device according to claim 11, further comprising a transfer conveyor belt formed in an endless loop and to travel in a certain direction, wherein the nip forming member is disposed inside the loop formed by the transfer conveyor belt and contacts the image bearer via the transfer conveyor belt.

13. An image forming apparatus, comprising:

an image bearer on which a toner image is formed; and the transfer device of claim 11 to transfer the toner image from the image bearer onto a recording medium.

14. The image forming apparatus according to claim 13, wherein the image bearer is an intermediate transfer member.

15. The pressing device of claim 5, wherein the biasing member biases the first adjuster.

16. The pressing device of claim 5, wherein the biasing member biases the first lateral plate and the second lateral plate.

* * * * *